US010450101B2

(12) United States Patent
Bressan et al.

(10) Patent No.: US 10,450,101 B2
(45) Date of Patent: Oct. 22, 2019

(54) PACKAGE AND PROCESS OF MAKING THE SAME

(71) Applicant: I.G.B.S.R.L., Milan (IT)

(72) Inventors: Michel Bressan, Induno Olona (IT); Alessio Bressan, Varese (IT); Alberto Gandolla, Induno Olona (IT)

(73) Assignee: I.G.B. S.r.l, Milan (IT)

( * ) Notice: Subject to any disclaimer, the term of this patent is extended or adjusted under 35 U.S.C. 154(b) by 0 days.

(21) Appl. No.: 16/097,933

(22) PCT Filed: May 26, 2017

(86) PCT No.: PCT/IB2017/053115

§ 371 (c)(1),
(2) Date: Oct. 31, 2018

(87) PCT Pub. No.: WO2017/216662

PCT Pub. Date: Dec. 21, 2017

(65) Prior Publication Data

US 2019/0127108 A1 May 2, 2019

(30) Foreign Application Priority Data

Jun. 17, 2016 (IT) ..... 102016000062952

(51) Int. Cl.
*B65D 5/38* (2006.01)
*B65D 5/02* (2006.01)
(Continued)

(52) U.S. Cl.
CPC ..... *B65D 5/38* (2013.01); *B65D 5/0254* (2013.01); *B65D 5/10* (2013.01); *B65D 5/5038* (2013.01);
(Continued)

(58) Field of Classification Search
CPC ..... B65D 5/38; B65D 5/0254; B65D 5/5038; B65D 77/042; B65D 2215/02; B65D 5/503; B65D 2101/00; B65D 11/12
(Continued)

(56) References Cited

U.S. PATENT DOCUMENTS 1,253,489 A * 1/1918 Houghland ..... B65D 5/38 229/125.125
3,648,918 A 3/1972 Van Inwagen
(Continued)

FOREIGN PATENT DOCUMENTS

CN 204642380 U 9/2015
EP 2810885 U 12/2014
(Continued)

OTHER PUBLICATIONS

U.S. Appl. No. 10/189,625, filed Jan. 2019, Bressan; Michel.*
(Continued)

*Primary Examiner* — Christopher R Demeree
(74) *Attorney, Agent, or Firm* — Fish & Richardson P.C.

(57) ABSTRACT

A package includes a casing of made sheet material defining an inner volume, the casing including first lateral walls defining a first passage opening delimited by a first free edge, the casing including an engagement portion extending from a lateral wall of the first lateral walls inside of the inner volume to provide a projection, wherein the engagement portion extends from the first free edge of the casing in a direction towards the inner volume. The package also includes a container made of sheet material, separate from the casing, and configured for housing a product, the container comprising second lateral walls defining a second passage opening delimited by a second free edge, the second passage opening of the container being configured for insertion and withdrawal of the product from the container, and
(Continued)

the container being configurable between first and second operative positions.

16 Claims, 26 Drawing Sheets

(51) Int. Cl.
*B65D 5/50* (2006.01)
*B65D 77/04* (2006.01)
*B65D 5/10* (2006.01)
*B65D 85/10* (2006.01)

(52) U.S. Cl.
CPC ..... *B65D 77/042* (2013.01); *B65D 85/1054* (2013.01); *B65D 2101/0015* (2013.01); *B65D 2215/04* (2013.01)

(58) Field of Classification Search
USPC ..... 229/102, 125.125, 148, 122, 124, 220; 206/807; 220/345.4
See application file for complete search history.

(56) References Cited

U.S. PATENT DOCUMENTS 5,207,374 A * 5/1993 Lo Duca ..... B65D 5/0254 206/807
5,803,345 A * 9/1998 Jones ..... B65D 5/6608 206/807
6,491,211 B1 * 12/2002 Evans ..... B65D 5/38 206/532
7,810,640 B2 * 10/2010 Weston ..... B65D 5/38 206/483
8,408,451 B2 * 4/2013 Adam ..... B65D 5/6608 229/102
8,746,444 B2 * 6/2014 Dehlin ..... B65D 5/38 206/1.5
9,085,386 B2 * 7/2015 Hengami ..... B65D 5/723
9,475,605 B2 * 10/2016 Everett ..... B65D 5/38
9,815,584 B2 * 11/2017 Schwester ..... B65D 5/503
9,981,788 B2 * 5/2018 Skinner ..... B65D 5/38
2008/0308619 A1 * 12/2008 Adam ..... B65D 5/0254 229/222
2011/0180537 A1 * 7/2011 Zimmermann ..... B65D 5/0254 220/257.2
2012/0234701 A1 9/2012 Albrecht et al.
2014/0262839 A1 9/2014 Le et al.

FOREIGN PATENT DOCUMENTS

EP 2979992 U 2/2016
WO WO2015170203 U 11/2015

OTHER PUBLICATIONS

International Search Report and Written Opinion for Int'l Application No. PCT/IB2017/053115, dated Jul. 27, 2017, 15 pages.

* cited by examiner

FIG.19
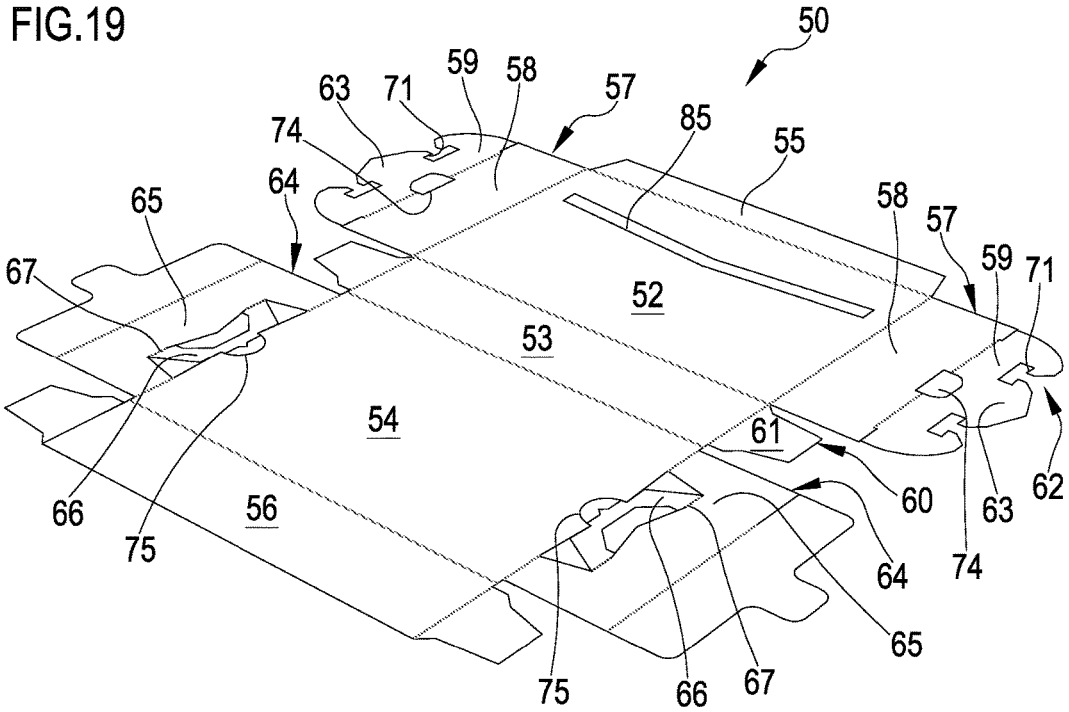
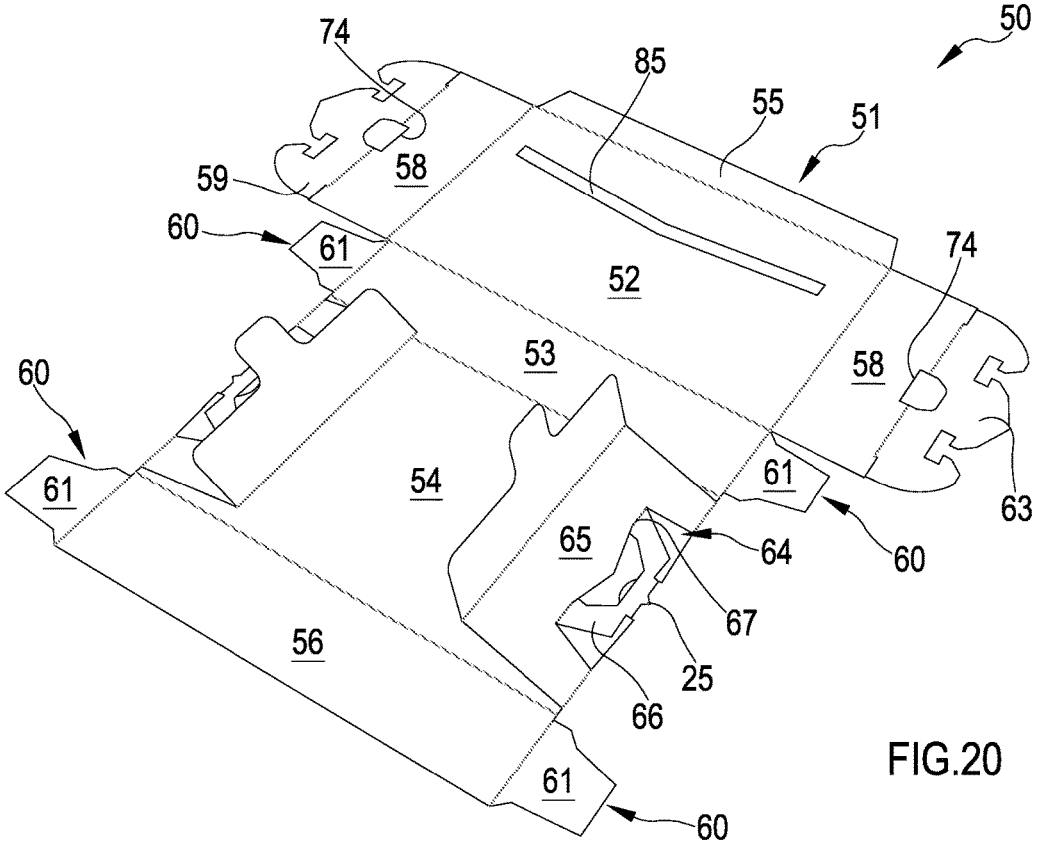
FIG.20

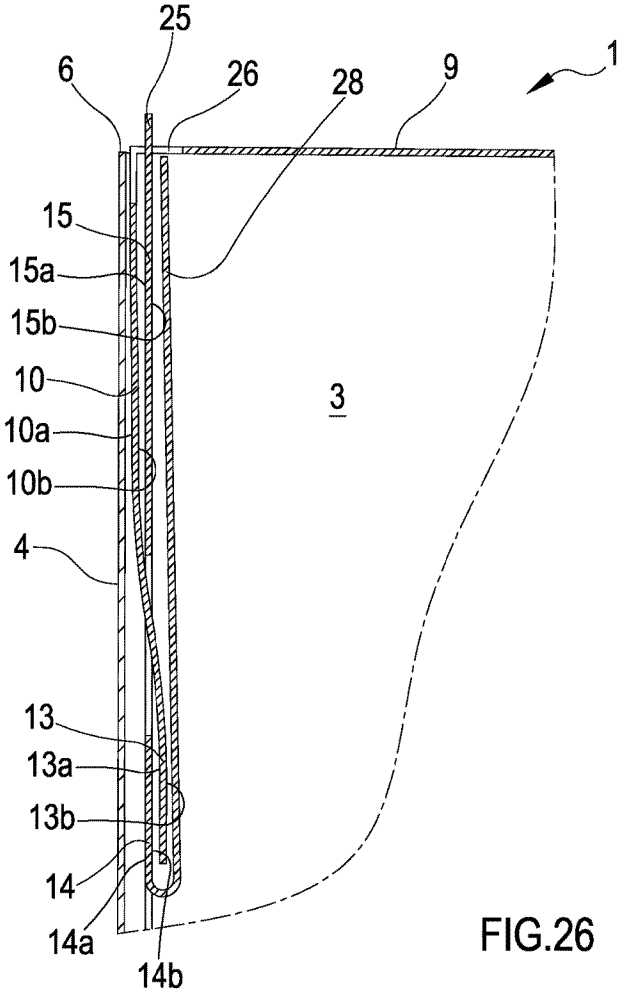
FIG.26
FIG.24
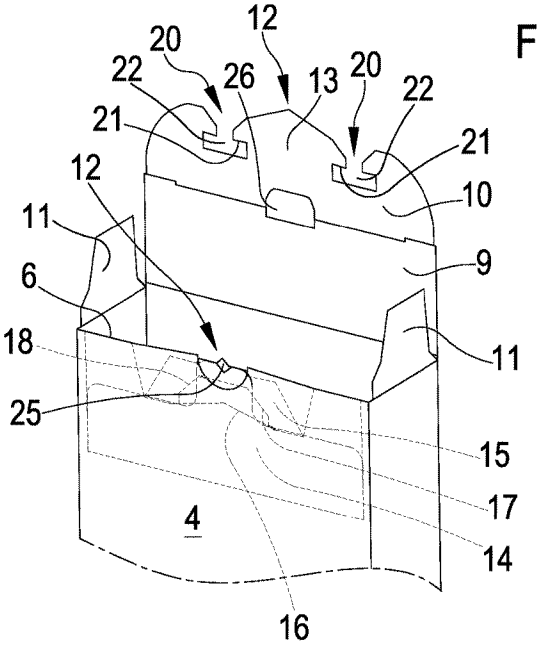
FIG.25
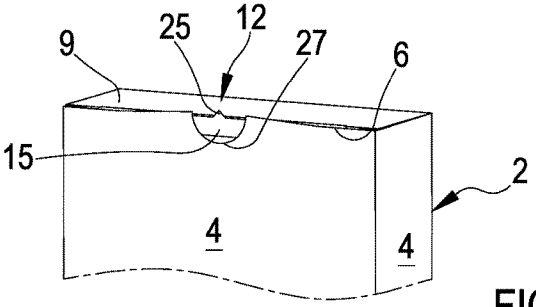

PACKAGE AND PROCESS OF MAKING THE SAME

CROSS REFERENCE TO RELATED APPLICATIONS

This patent application is a 371 U.S. National Application of PCT/IB2017/053115, filed May 26, 2017, which claims priority to Italian Patent Application No. 102016000062952, filed Jun. 17, 2016, the entire contents of which are incorporated herein by reference.

TECHNICAL FIELD

This disclosure relates to a package and process of making the same. The package, can for example find an application in the pharmaceutical and cosmetics fields. However, the package can find an advantageous application also in the food field for packaging food and, particularly, confectionery products and also in the cigars and cigarettes fields for packaging the same. The package finds an advantageous application in all the fields requiring, from the safety point of view, to prevent children from opening the package itself. Moreover, the package can find an application in all the fields in which products are packaged in a way which ensures the closure of the package itself, and provides a feature enabling to evidence a possible tampering of this latter.

BACKGROUND

Box-shaped packages configured for being easily reversibly opened and reclosed are commercially available. Nowadays, such packages are used for containing a wide range of products such as, for example: drugs, cosmetics, food products (confectionery products, for example), cigars, and cigarettes.

Generally, such packages include a container of paper material having a box-shape, exhibiting two accesses longitudinally opposite to each other. At each access, the container includes a tab rotatably with respect to the container itself between an open condition wherein the tab is distanced from the access, and a closed condition wherein the tab is inserted in the container and occludes the access. The tab, in the closed condition of the container, exhibits a "L" shape wherein an inserting portion of the tab itself inside the container, faces and contacts a front wall of this latter.

The package can include one or more wrappers—insertable and extractable from the container—in which the products are disposed (the wrapper can include a blister supporting a plurality of pharmaceutical-type products, for example) or the products are directly housed in the package (without any wrapper): the "loose" products are inserted in the package in the same way used nowadays for cigars and cigarettes.

However, it is noted that such types of packages can be easily openable by children which therefore can come in contact with elements which are potentially hazardous to them. It is also observed that such packages enable to completely extract the product (a blister containing medicines, cosmetics plastic tubes, and so on, for example) from the package itself: once the product is extracted, there is the possibility of forgetting it outside the package, consequently children can possibly come in contact with potentially hazardous elements.

A further embodiment of some packages includes a casing of paper material, having a box-shape; the inside of the casing receives a tray of plastic material which constrains to the inside thereof one or more blisters destined to contain a plurality of products.

The casing exhibits a standard open and close mechanism (the movable "L"-shaped tab is useless in the package); in the closed condition of the package, an engagement portion of the tab extends parallel to a front wall of the container itself.

Contrary to the preceding solutions, the casing of this latter package exhibits, at the opposite longitudinal lateral walls, two slots which are moreover disposed along a diagonal of the casing itself. The tray includes two projections adapted to be inserted in respective slots of the casing: in the condition, wherein the tray is housed in the casing, the engagement of the projections into the slots prevents the tray itself from being extracted by only pulling the casing itself. If somebody wants to extract the tray from the container, it is necessary to apply a pressure on the projections in order to push them towards the inside of the container itself and cause them to disengage from the slots; at this point, it is possible to extract the tray.

This latter solution has an open mechanism requiring to grasp and handle in a particular way the package, this condition makes arduous to open the same by children.

However, the described package is not devoid of limitations and inconveniences. Actually, it is noted that the structure of the package is somewhat complex, this fact adversely affects the manufacturing costs and the cost of the product itself; actually, the package for correctly operating requires a shaped tray of plastic material. Moreover, the particular structure of the tray requires to substantially modify the existing packaging plants used for making standard-type packages; particularly, such modification requires to insert a new closure line, to provide a suitable equipment for forming the tray consequently the manufacturing costs and therefore also the costs of the final product are substantially increased.

SUMMARY

Therefore, an object of the present invention includes substantially solving at least one of the inconveniences and/or limitations of the preceding solutions.

A first object of the present invention includes providing a package exhibiting a simple and compact structure which, at the same time, can: effectively prevent children to gain access and prevent to completely extract the products housed inside it. Moreover, it is an object of the present invention to provide a package exhibiting a highly flexible structure when used.

A further object of the present invention includes providing a package, advantageously a child-proof package, exhibiting a stable structure capable of ensuring the integrity thereof upon multiple openings and closings of the container itself.

Moreover, it is an object of the present invention to provide a package which can effectively and positively evidence a tampering at the first opening of the package itself, also to sight-impaired people.

An additional object of the present invention includes providing an associated package which can be readily manufactured at a low manufacturing cost. Specifically, it is an object of the invention to manufacture a package which does not require to modify already existent plants used for making standard-type packages, in order to adapt them to the manufacture of the package object of the present invention.

Then, it is an object of the present invention to provide a fast and extremely flexible process for making a package which can therefore minimize the manufacturing costs.

These and other objects, which will better appear in the following description, are substantially met by a package and associated making process according to what is expressed in one or more of the attached claims and/or following aspects, considered alone or in any combination with each other or in a combination with anyone of the attached claims and/or in a combination with anyone of the further aspects or characteristics described in the following.

The aspects of the invention are described in the following.

In a 1st aspect, it is provided a package (100) comprising:

at least one casing (102) of sheet material, particularly of paper sheet material, defining an inner volume (103), the casing (102) exhibiting a predetermined number of lateral walls (104) defining at least one passage opening (105) delimited by a free edge (106), said casing (102) comprising at least one engagement portion (107) emerging, from at least one lateral wall (104), inside the inner volume (103) of the casing (102) itself for defining a projection, at least one container (1) of sheet material, particularly of paper sheet material, distinct from the casing (102) and configured for housing at least one product, said container (1) exhibiting a predetermined number of lateral walls (4) defining at least one respective passage opening (5) delimited by a respective free edge (6), said passage opening (5) of the container (1) being configured for enabling to insert and withdraw the product (P) from the container (1), said container (1) being at least configurable between:

a first operative position wherein the container itself (1) is at least partially housed in the casing (102), in the first operative position, the passage opening (5) of this latter is at least partially defined inside the inner volume (103) of the casing (102) which—in such first operative position—prevents to insert and withdraw the product (P) from the container (1), a second operative position wherein the container (1) itself is at least partially disposed outside the inner volume (103) of the casing (102), in the second operative position, the passage opening of this latter is defined outside the casing (102) and is adapted to enable to insert and withdraw the product from the container (1), said container (1) comprising—at at least one lateral wall (4)—at least one stop element (90) configured for abutting, in the first operative position, against the engagement portion (107) of the casing (102) for preventing the container (1) from switching from the first to the second operative positions.

In a 2nd aspect according to the aspect 1, the package (100) includes at least one slot (150)—defined between at least one lateral wall (104) of the casing (102) and at least one lateral wall (104) of the container (1)—configured for enabling, at least in the first operative position, to insert at least one open device (160) adapted to enable to disengage the stop element (90) of the container (1) from the engagement portion (107) of the casing (102) for enabling the container (1) to switch from the first to the second operative positions.

In a 3rd aspect according to anyone of the preceding aspects, the casing (102) includes a front wall (104*a*) and rear wall (104*b*) facing and parallel to each other, the front wall and rear wall are connected to each other by a first and a second lateral walls (104*c*, 104*d*) also facing and parallel to each other, the front wall (104*a*) being distanced from the rear wall (104*b*), the first and second lateral walls (104*c*, 104*d*) of the casing (102) being distanced from each other, the engagement portion (107) of the casing (102) emerging from said front wall (104*a*) and/or from said rear wall (104*b*).

In a 4th aspect according to anyone of the preceding aspects, the engagement portion (107) of the casing (102) extends from the free edge (106) of the casing (102) according to a direction entering the inner volume (103).

In a 5th aspect according to anyone of the preceding aspects, the engagement portion (107) of the casing (102) is made of a sheet material, particularly of paper sheet material.

In a 6th aspect according to anyone of the preceding aspects, the engagement portion (107) includes at least one tab (107*a*) joined in a single piece to the front wall (104*a*) of the casing (102) itself.

In a 7th aspect according to the preceding aspect, wherein at least part of said tab (107*a*) extends along a rectilinear development direction sloped with respect to an extension direction of the rear front wall (104*a*) to which the tab (107*a*) itself is joined in a single piece, optionally the tab defines—with the front and/or rear walls to which the tab itself is joined in a single piece—an angle equal to or greater than 1°, particularly included between 1° and 15°, still more particularly included between 1° and 5°; said angle being defined in the inner volume and being subtended between the tab (107*a*) and front lateral wall (104*a*) of the casing.

In an 8th aspect according to the preceding aspects, the casing (102) exhibits, along a section transversal to the lateral walls, a parallelogram shape, particularly a square or rectangular shape, optionally the free edge (106) of the casing (102) defines a parallelogram shape, particularly a square or rectangular shape.

In a 9th aspect according to anyone of the aspects from 2 to 8, the slot (150) is defined between the lateral wall (104) of the casing directly supporting the engagement portion (102) and the lateral wall of the container (1) on which the stop element (90) is defined.

In a 10th aspect according to the preceding aspect, the slot (150) extends all along the development of the lateral wall (104) of the casing (102) directly supporting the engagement portion (107).

In an 11th aspect according to anyone of the preceding aspects, the casing (102) extends along a longitudinal development direction, between a first and a second longitudinal end portions (102*a*, 102*b*), the passage opening (105) of the casing (102) being defined at said first longitudinal end portion (2*a*), and defining a first passage opening (105), the casing (102)—at the second longitudinal end portion (102*b*)—comprising a second passage opening (205) delimited by a respective free edge (206).

In a 12th aspect according to the preceding aspect, the package includes an engagement portion (107) extending from the free edge (206) of the second passage opening (205) according to a direction entering the inner volume (103).

In a 13th aspect according to the preceding aspect, the engagement portion (107) engaged at the free edge (206) of the second passage opening (205), is of a sheet material, particularly of a paper sheet material; particularly said engagement portion includes at least one tab (107*a*) joined in a single piece to the front wall (104*a*) of the casing (102) itself. De facto, in the configuration wherein said casing includes a first and second passage openings, the casing itself can include an engagement portion (107) engaged at the free edge defining said first and/or second passage openings.

In a 14th aspect according to anyone of the aspects from 11 to 13, the casing (102) includes an occluding system (207) of sheet material engaged at the free edge (206) of the second passage opening (205), said occluding system (207) being configured for irreversibly closing the second passage opening (205), said occluding system (207) being configured for preventing the access from the outside to the inner volume (103) of the casing (102) through said second passage opening (205), particularly the inner volume of the casing (102) is accessible only through the first passage opening (5).

In a 15th aspect according to the preceding aspect, the occluding system (207) includes one tab (208) having a closing portion (209) engaged with the free edge (206) of the second passage opening (205) and at least one inserting portion (210) inserted inside the volume (103) of the casing (102), the occluding system (207) further comprising:

at least one first hooking portion (212) supported by the tab (208) of the occluding system (207) and disposed in the inner volume (103) of the casing (102), at least one second hooking portion (213) engaged with the casing (102) and disposed inside the inner volume (103), said second hooking portion (213) being configured for cooperating with said first hooking portion (212) of the occluding system (207), the first and second hooking portions (212, 213) of the occluding system (207) being stably engaged with each other inside the casing (102) and being configured for irreversibly occluding the second passage opening (205), the closing portion (209) of the tab (208) of the occluding system (207) exhibiting a shape delimited by a closed outer perimeter countershaped and substantially identical to the second passage opening (205), the closing portion (209) of the occluding system (207) completely covering said second passage opening, the closing portion of the occluding system (207) being devoid of through openings, optionally wherein the closing portion (209) is joined in a single piece to the inserting portion (210), the closing portion (209) and inserting portion (210) defining a body of sheet material exhibiting a substantially "L" shape, said closing portion (209) and inserting portion (210) defining a continuous single body delimited by a single outer closed perimeter devoid of through openings defined inside said closed outer perimeter.

In a 16th aspect according to anyone of the aspects from 2 to 15, the package includes at least one open device (160) of sheet material, particularly of paper sheet material, configured for being inserted at least partially, at least in the first operative position, through the slot (150) for enabling to disengage the stop element (90) of the container (1) and the engagement portion (107) of the casing (102).

In a 17th aspect according to anyone of the preceding aspects, the container (1)—in the first operative position—is completely housed in the casing (102), wherein the casing (102) includes at least one closing system (307) of sheet material, engaged at the free edge (106) of the passage opening (105) of the casing (102) and movable, particularly rotatably, with respect to the lateral walls (104), the closing system (307) being configured for defining at least a closed condition in which the closing system itself prevents the communication between the inner volume (103) of the casing (102) and the outer environment, the closing system (307) being further configured for defining an open condition in which the system itself enables the communication between the inner volume (103) and the outer environment, the closing system (307) comprising at least one tab (308) which exhibits a closing portion (309) engaged with the free edge (106) of the passage opening (105), and movable, particularly rotatably, with respect to this latter, the tab (308) further exhibiting at least one inserting portion (310) configured for being inserted, in the closed condition of the closing system (307), into the inner volume (103) of the casing (102), further the package comprising at least one safety device (312) of sheet material, stably engageable at least partially with at least one lateral wall (104) of the casing (102) itself and at least partially with the closing system (307) following a first closed condition of this latter, the safety device (312) comprising at least one removable portion (315) configured for separating from the safety device (312) following a first open condition of the closing system (307) following said first closed condition, for evidencing a tampering of the casing (102).

In an 18th aspect according to the preceding aspect, the engagement portion (107) is directly constrained, particularly joined in a single piece, to the front lateral wall (104*a*) of the casing (102) while the closing system (307) is directly constrained to the rear lateral wall (104*b*) of the casing (102), particularly the engagement portion (107) and closing system (307) are located oppositely to each other with respect to the casing (102) itself.

In an 19th aspect according to the aspect 17 or 18, the safety device (312) includes:

at least one first hooking portion (313) supported by the tab (308) and/or by the abutment portion (311) of the closing system (307), at least one second hooking portion (314) engaged with at least one lateral wall (104) of the casing (102) and configured for cooperating with said first hooking portion (313) of the safety device (312), the first and second hooking portions (313, 314) of the safety device (312) being configured for stably engaging with each other during a first closed condition of the closing system (307), the first and/or second hooking portions (313, 314) of the safety device (312) exhibiting at least one removable portion (315) configured for separating from the safety device (312) following a first open condition of the closing system (307) following said first closed condition for evidencing a tampering of the casing (102), and wherein the second hooking portion (314) of the safety device (312) is disposed in the inner volume (103) of the casing (102) and substantially lies in a plane parallel to one of the lateral walls (104) of this latter, in the closed condition of the closing system (307), the first hooking portion (313) of the safety device (312) being configured for being inserted at least partially in the inner volume (103) of the casing for stably engaging the second hooking portion (314) of the safety device (312) itself.

In a 20th aspect according to the preceding aspect, the removable portion (315) is directly supported by the second hooking portion (314) of the safety device (312).

In a 21st aspect according to anyone of the aspects from 18 to 20, the removable portion (315) comprising at least one undercut portion (316) configured for engaging the first hooking portion (313) of the safety device (312) itself in the first closed condition of the closing system (307).

In a 22nd aspect according to the preceding aspect, the undercut portion (316) of the removable portion (315) is delimited by a gripping edge (317) which, in the first closed condition of the closing system (307), is distinct and distanced from the free edge (106) of the passage opening (105) of the casing (102).

In a 23rd aspect according to the aspect 21 or 22, the undercut portion (316) of the removable portion (315) includes at least one hook (318) defining a seat (319) the concavity thereof faces, at least in the first closed condition of the closing system (307), at least one of the lateral walls (104) of the casing (2), wherein the first hooking portion (313) of the safety device (312) includes at least one respective undercut portion (320) delimited by a respective gripping edge (321), said respective undercut portion (320), in the first closed condition of the closing system (307), is configured for engaging the undercut portion (316) of the removable portion (315), optionally, the gripping edge (317) of the removable portion (315), in the first closed condition of the closing system, is interposed between the free edge (106) of the passage opening (105) of the casing (102) and the respective gripping edge (321) of the hooking portion (320) of the first hooking portion (313) of the safety device (312).

In a 24th aspect according to anyone of the aspects from 19 to 23, the second hooking portion (314) of the safety device (312) is directly engaged, particularly joined in a single piece, to the front lateral wall (104*a*) of the casing (102).

In a 25th aspect according to anyone of the aspects from 17 to 24, the casing (102) comprising at least one through recess (327) defined on the front lateral wall (104*a*), said recess (327) being defined at the free edge (106) of the passage opening (105), wherein the recess (327) is configured for enabling to be shown from the outside of the removable portion (315) before the first open condition of the casing (102).

In a 26th aspect according to the preceding aspect, the safety device (312) includes a control portion (328) of sheet material, particularly of paper sheet material, engaged with the front lateral wall (104*a*) of the casing (102) so that the second hooking portion (314) of the safety device (312) is interposed between said front lateral wall (104*a*) and said control portion (328), wherein the inserting portion (310) of the closing system (307) exhibits a through opening (310*a*) which—in the closed condition of the closing system (307)—faces the recess (327) of the casing (102), the recess (327) with said through opening (310*a*) of the engagement portion, being configured for enabling to show the control portion (328) following the first open condition of the casing (102) for evidencing a tampering of this latter.

In a 27th aspect according to the preceding aspect, at least part of the control portion (328)—visible through the recess (327) and the through opening of the inserting portion (310)—is different and discernible from at least one part of the removable portion (315) visible from the recess (327), the difference between said visible parts is adapted to show, from the outside, the tampering of the casing (102) after the first open condition.

In a 28th aspect according to anyone of the preceding aspects, the casing (102) extends along a longitudinal development direction, between a first and second longitudinal end portions (102*a*, 102*b*), the passage opening (105) of the casing (102) being defined at said first longitudinal end (2*a*) and defining a first passage opening (105), the casing (102) comprising—at the second longitudinal end portion (102*b*) a second passage opening (205) delimited by a respective free edge, the casing (102) comprising a closing system (307) and an associated safety device (312) at both the first and second passage openings (205) of the casing (102), each safety device (312) comprising at least one removable portion (315) configured for separating from the respective safety device (312) following a first open condition of the respective closing system (307) after a first closed condition for evidencing a tampering of the casing (102).

In a 29th aspect according to anyone of the aspects from 3 to 28, the container (1) includes a front wall (4*a*) and a rear wall (4*b*) facing and parallel to each other, the front and rear walls of the container (1) respectively facing the rear and front walls of the casing, the front wall and rear wall are connected to each other by a first and second lateral walls (4*c*, 4*d*) also facing and parallel to each other, the front wall (4*a*) of the container being distanced from the rear wall (4*b*) of the container itself, the first and second lateral walls (4*c*, 4*d*) of the container (1) being distanced from each other, optionally the container (1) is substantially countershaped to the casing (102), wherein the container (1) includes—at the front lateral wall (4*a*)—at least one seat (91) delimited by at least one stop wall (92) which delimits at least partially the passage opening (5) of the container (1) and further defines at least part of the stop element (90), optionally the passage opening (5) of the container (1) faces the front lateral wall (104*a*) of the casing (102).

In a 30th aspect according to the preceding aspect, the container (1) extends along a development direction, between a first and second end portions (2*a*, 2*b*), the container (1) comprising a plurality of seats (91) distanced from each other and aligned along the development direction of the container (1).

In a 31st aspect according to anyone of the preceding aspects, the container (1) defines an inner volume (3) configured for housing at least one product, the container (1) extending, along a longitudinal development direction, between a first and second longitudinal end portions, said passage opening (5) being defined at said first longitudinal end portion, the container (1) includes at least one closing system (7) also of sheet material, particularly of paper sheet material, engaged at the free edge (6) of the container and movable, particularly rotatably, with respect to the lateral walls (4) of this latter, the closing system (7) of the container (1) being configured for defining at least one closed condition in which the closing system (7) itself substantially occludes the passage opening (5) of the container (1) and prevents the communication between the inner volume (3) and the outer environment, the closing system (7) of the container (1) being further configured for defining an open condition in which the system (7) itself enables the communication between the inner volume (3) and outer environment, the closing system (7) of the container (1) comprising at least one tab (8) which exhibits a closing portion (9) engaged with the free edge (6) of the passage opening (5) of the container and movable, particularly rotatably, with respect to this latter, said tab (8) further exhibiting at least one inserting portion (10) configured for being inserted, in the closed condition of said closing system (7), in the inner volume (3) of the container (1).

In a 32nd aspect according to the preceding aspect, the container further includes at least one safety device (12) of sheet material stably engageable at least partially with at least one lateral wall (4) of the container and at least partially with the closing system (7) following a first closed condition of this latter, the safety device (12) of the container includes at least one removable portion (15) configured for separating from the safety device (12) itself following a first open condition of the closing system (7) of the container following said first closed condition for evidencing a tampering of the container (1).

In a 33rd aspect according to the preceding aspect, the safety device (12) of the container (1) includes:

at least one first hooking portion (13) supported by the tab (8) and/or by the abutment portion (11) of the closing system (7) of the container (1), at least one second hooking portion (14) engaged with at least a lateral wall (4) of the container (1) and configured for cooperating with said hooking portion (13) of the safety device (12), said first and second hooking portions (13, 14) of said safety device (12) being configured for stably engaging with each other during a first closed condition of the closing system (7), the first and/or second hooking portions (13, 14) of the safety device (12) of the container (1) exhibiting at least one removable portion (15) configured for separating from the safety device (12) following a first open condition of the closing system (7) of the container following said first closed condition for evidencing a tampering of this latter, wherein the second hooking portion (14) of the safety device (12) is disposed into the inner volume (3) of the container and substantially lies in a plane parallel to one of the lateral walls (4) of this latter, in the closed condition of the closing system (7) of the container, the first hooking portion (13) of the safety device (12) being configured for being inserted at least partially into the inner volume (3) of the container for stably engaging the second hooking portion (14) of the safety device (12) itself.

In a 34th aspect according to the preceding aspect, the removable portion (15) is directly supported by the second hooking portion (14) of the safety device (12).

In a 35th aspect according to the aspect 33 or 34, the removable portion (15) includes at least one undercut portion (16) configured for engaging the first hooking portion (13) of the safety device (12) itself in the first closed condition of the closing system (7) of the container.

In a 36th aspect according to the preceding aspect, the undercut portion (16) of the removable portion (15) is delimited by a gripping edge (17) which, in the first closed condition of the closing system (7), is distinct and distanced from the free edge (6) of the passage opening (5) of the container.

In a 37th aspect according to the aspect 35 or 36, the undercut portion (36) of the removable portion (15) includes at least one hook (18) defining a seat (19) the concavity thereof faces, at least in the first closed condition of the closing system (7), at least one of the lateral walls (4) of the container, wherein the first hooking portion (13) of the safety device (12) of the container includes at least one respective undercut portion (20) delimited by a respective gripping edge (21), said respective undercut portion (20), in the first closed condition of the closing system (7) of the container, being configured for engaging the undercut portion (16) of the removable portion (15), optionally, wherein the gripping edge (17) of the removable portion (15), in the first closed condition of the closing system, is interposed between the first edge (6) of the passage opening (5) of the container and the respective gripping edge (21) of the hooking portion (20) of the first hooking portion (13) of the safety device (12) of the container (1).

In a 38th aspect according to anyone of the aspects from 33 to 37, the second hooking portion (14) of the safety device (12) of the container (1) is directly engaged, particularly joined in a single piece, to the front lateral wall (4*a*) of the container itself, the container (1) comprising at least one through recess (27) and defined on the front lateral wall (4*a*), said recess (27) being defined at the free edge (6) of the passage opening (5) of the container, wherein the recess (27) is configured for enabling to show from the outside the removable portion (15) before the first open condition of the container (1).

In a 39th aspect according to the preceding aspect, the safety device (12) of the container (1) includes a control portion (28) of sheet material, particularly of paper sheet material, engaged with the front lateral wall (4*a*) of the container itself, so that the second hooking portion (14) of the safety device (12) is interposed between said front lateral wall (4*a*) and said control portion (28), wherein the inserting portion (10) of the closing system (7) of the container exhibits a through opening (26) which—in the closed condition of the closing system (7)—faces the recess (27) of the container, said recess (27) with said through opening (26) of the inserting portion being configured for enabling to show the control portion (25) following the first open condition of the container for evidencing a tampering of this latter.

In a 40th aspect according to the preceding aspect, at least part of said control portion (28)—visible through the recess (27) and the through opening (26) of the inserting portion (10)—is different and discernible from at least part of the removable portion (15) of the container visible from the recess (27), the difference between said visible parts is adapted to show, from the outside, the tampering of the container (1) following the first open condition.

In a 41st aspect according to anyone of the aspects from 31 to 40, the passage opening (5) of the container (1)—at least in the first operative position—faces the first or second lateral walls (104*c*, 104*d*) of the casing (102).

In a 42nd aspect according to anyone of the aspects from 31 to 41, the passage opening (5) of the container—defined at the first longitudinal end portion—defines a first passage opening, the container (1) comprising, at the second longitudinal end portion of the container (1), a second passage opening delimited by a respective free edge, the container (1) comprising a closing system (7) and an associated safety device (12) at both the first and second passage openings, each safety device (12) comprising at least one removable portion (15) configured for separating from the respective safety device (12) following a first open condition of the respective closing system (7) after a first closed condition for evidencing a tampering of the container (1).

In a 43rd aspect according to anyone of the aspects from 31 to 42, the container (1) includes at least one auxiliary through opening (93) defined on a lateral wall (4), which is delimited by an edge (94) defining the stop element (90).

In a 44th aspect according to the preceding aspect, the auxiliary through opening (93) is disposed on a lateral wall (4) opposite to the lateral wall (4) of the container itself supporting the second hooking portion (14) of the safety device (12), particularly the second hooking portion (14) of the safety device (12) is directly supported by the front lateral wall (4*a*)

of the container, while the through auxiliary opening (93) is defined on the rear lateral wall (4*b*) of the container (1) itself.

In a 45th aspect according to the aspect 43 or 44, the through auxiliary opening (93) extends along a transversal prevalent development direction, particularly normal to the development direction of the container (1), said through auxiliary opening exhibiting a length—measured normal to the longitudinal development direction of the container—equal to or greater than a width of the engagement portion (107) of the casing (102), said width being measured normal to the longitudinal development direction of the casing (102), said through auxiliary opening (93) being configured for receiving through—at least in the first operative position of the container—the passing engagement portion (107) of the casing.

In a 46th aspect according to anyone of the preceding aspects, the casing (102) is made by folding a flat sheet of paper material.

In a 47th aspect according to anyone of the preceding aspects, the container (1) is made by folding a flat sheet of paper material.

In a 48th aspect according to anyone of the preceding aspects, the casing (102) is made of a paper sheet material, and includes:

a front lateral wall (104*a*), a rear lateral wall (104*b*) facing and parallel to the front lateral wall (104*a*), at least one first and one second lateral walls (104*c*, 104*d*) also facing and parallel to each other and connected to the front and rear lateral walls, the front wall (104*a*) being distanced from the rear lateral wall (104*b*), the first and second lateral walls (104*c*, 104*d*) of the casing (102) being distanced from each other, the first and second lateral walls being instead connected to each other by the front lateral wall and rear lateral wall, said lateral walls (104*a*, 104*b*, 104*c*, 104*d*) defining an inner volume (103) of the casing and at least one passage opening (105) delimited by a free edge (106), said casing (102) comprising at least one engagement portion (107) emerging, from at least the front and/or rear lateral walls of the casing, inside the inner volume (103) in order to define a projection, the front and/or rear lateral walls supporting the engagement portion (107) being configured for deforming—particularly elastically (reversibly)—away respectively from the rear and front lateral walls following a crushing action of the first and/or second lateral walls (104*c*, 104*d*), said lateral and/or rear walls supporting said engagement portion (107), following the deforming action, being configured for enabling to disengage the stop element (90) of the container (1) from the engagement portion (107) of the casing (102) for enabling the container (1) to switch from the first to the second operative positions.

In a 49th aspect, it is provided a process of making a package according to anyone of the preceding aspects.

In a 50th aspect according to the preceding aspect, the process includes at least the following sub-steps:

providing the casing (102) of sheet material, exhibiting at least one engagement portion (107) emerging, from at least one lateral wall (104), inside the inner volume (103) of the casing (102) itself in order to define a projection, providing the container (1), inserting at least partially the container (1) into the inner volume (103) of the casing (102) so that the engagement portion (107) of this latter abuts against the stop element (90) of the container (1) for defining the first operative position.

In a 51st aspect according to the preceding aspect, the step of providing the casing (102) includes at least the following steps:

providing a first flat semifinished product (500) of paper sheet material exhibiting:

at least one first sheet (501) comprising at least one first and one second portions (502, 504) interconnected by a central connecting portion (503), further the first sheet (501) comprising at least one first and one second lateral connecting portions (505, 506), the first portion (502) being interposed between the first lateral connecting portion (505) and the central connecting portion (503), the second portion (504) being interposed between the central connecting portion (503) and the second lateral connecting portion (506), each of said portions (502, 503, 504, 505, 506) comprising at least one first and one second longitudinal edges opposite to each other and a first and second end edges opposite to each other, the first end edges of the portions (502, 503, 504, 505, 506) of the first sheet (501) defining a first end edge of said first sheet, the second end edges of the portions (502, 503, 504, 505, 506) of the first sheet (501) defining a second end edge of said first sheet, said portions (502, 504), said central connecting portion (503) and said lateral connecting portions (505, 506) being joined along the longitudinal edges and aligned along a single connecting direction, at least one second sheet (521) connected and joined in a single piece to the first end edge of the second portion (504) of the first sheet (501), folding the second sheet (521) on the second portion (504) of the first sheet (501), folding the first sheet (501) along the longitudinal edges of the portions of the central sheet itself in order to define the casing (102) exhibiting at least an opening (105), said second sheet (521) defining the engagement portion (107) inside the casing (102).

In a 52nd aspect according to the preceding aspect, the first flat semifinished product (500) includes:

at least one third sheet (507) connected to the second end edge of the first portion (502) of the first sheet (501), the second sheet (507) comprising a first and second portions (508, 509) joined in a single piece to each other, the first portion (508) of the second sheet (507) being interposed between the first portion (502) of the first sheet (501) and the second portion (509) of the second sheet (507), at least one fourth sheet (510) exhibiting at least one portion (511) joined in a single piece to the second portion (509) of the third sheet (507), the second portion (509) of the third sheet (507) being interposed between the first portion (507) of the third sheet (507) itself and the portion (511) of the fourth sheet (510), at least one fifth sheet (512) connected to the second end edge of the second portion (504) of the first sheet (501), the fifth sheet (512) comprising a first portion and second portion (513, 514), the fifth sheet (512) and third sheet (507) being disposed on the same end edge of the first sheet (501) opposite to the second sheet (521), wherein the process includes at least the following steps:

folding the fifth sheet (521) on the second portion (504) of the first sheet (501) in order to define the second hooking portion (214) of the occluding system (207), folding the second sheet (521) on the second portion (504) of the first sheet (501), following the step of folding the second sheet and fifth sheet, folding the first sheet (501) along the longitudinal edges of the portions of the same central sheet for defining the casing (102) exhibiting at least one opening (105), following the step of folding the first sheet, folding the third and fourth sheets in order to define the occluding system (207).

In a 53rd aspect according to the preceding aspect, the step of folding the fifth sheet (512) includes:

a step of constraining, for example by gluing, the first portion (513) to the second portion (504) of the first sheet (501), folding the second portion (514) of the fifth sheet (512) with respect to the first portion (513) of the fifth sheet (512) itself.

In a 54th aspect according to anyone of the aspects from 51 to 53, the first flat semifinished product (500) includes:

at least one third sheet (507) connected to the second end edge of the first portion (502) of the first sheet (501), the second sheet (507) comprising a first and second portions (508, 509), joined in a single piece to each other, the first portion (508) of the second sheet (507) being interposed between the first portion (502) of the first sheet (501) and the second portion (509) of the second sheet (507), at least one fourth sheet (510) exhibiting at least one portion (511) joined in a single piece to the second portion (509) of the third sheet (507), the second portion (509) of the third sheet (507) being interposed between the first portion (507) of the third sheet (507) itself and the portion (511) of the fourth sheet (510), at least one fifth sheet (512) connected to the second end edge of the second portion (504) of the first sheet (501), the fifth sheet (512) comprising a first portion and a second portion (513, 514), the fifth sheet (512) and third sheet (507) being disposed on the same end edge of the first sheet (501) opposite to the second sheet (521), said second portion (514) of the fifth sheet (512) being constrained to the first portion (513) of the same fifth sheet (512) by at least one weakening line (514*a*), wherein the process includes at least the following steps:

folding the fifth sheet (512) on the second portion (504) of the first sheet (501) for defining the second hooking portion (314) of the closing system (307), folding the second sheet (521) on the second portion (504) of the first sheet (501), following the step of folding the second sheet and fifth sheet, folding the first sheet (501) along the longitudinal edges of the portions of the central sheet itself for defining the casing (102) exhibiting at least the first and second openings (105, 205), following the step of folding the first sheet, folding the third and fourth sheets for defining the closing system (307).

In a 55th aspect according to anyone of the aspects from 51 to 54, the step of providing the container (1) includes at least the following steps:

providing a second flat semifinished product (50) of paper sheet material exhibiting:

at least one first sheet (51) comprising a first and second portions (52, 54) interconnected by a central connecting portion (53), further the first sheet (51) comprising at least one first and one second lateral connecting portions (55, 56), the first portion (52) being interposed between the first lateral connecting portion (55) and the central connecting portion (53), the second portion (54) being interposed between the central connecting portion (53) and the second lateral connecting portion (56), each of said portions (52, 53, 54, 55, 56) comprising at least one first and one second longitudinal edges opposite to each other and a first and second end edges opposite to each other, the first end edges of the portions (52, 53, 54, 55, 56) of the first sheet (51) defining a first end edge of said first sheet, the second end sheets of the portions (52, 53, 54, 55, 56) of the first sheet (51) defining a second end edge of said first sheet, said portions (52, 54), said central connecting portion (53) and said lateral connecting portions (55, 56) being joined along the longitudinal edges and aligned along a single connecting direction, said first sheet exhibiting, on the first portion (54), at least one cut (85*a*), folding the first sheet (51) along the longitudinal edges of the portions of the central sheet itself by joining said lateral connecting portions (55, 56) for defining the container (1) exhibiting at least the opening (5), the cut (85*a*) being adapted to define on the first sheet (51) said at least one stop element (90).

In a 56th aspect according to the preceding aspect, the cut (85*a*) on the first sheet exhibits an open outline and defines a tab (85), the process, following the step of folding the first sheet (51), includes at least one step of folding said tab (85) for defining on the container.

In a 57th aspect according to the aspect 55 or 56, the second flat semifinished product (50) of paper sheet material, further includes:

optionally, at least one third sheet (60) exhibiting at least one portion (61) connected to at least one central and/or lateral connection portions of the first sheet (51) and emerging with respect to this latter from the same side from which the second sheet (57) emerges, at least one fourth sheet (62) comprising at least one portion (63) joined in a single piece to the second portion (59) of the second sheet (57) and/or to the portion (61) of the third sheet (60), the portion (63) of the fourth sheet (62) longitudinally emerging from the second and/or third sheets (57, 60) oppositely to the first sheet (51), said fourth sheet (62) being configured for defining the first hooking portion (13) of the container (1), at least one fifth sheet (64) comprising at least one portion (65) joined in a single piece to the first sheet (51), and configured for defining the second hooking portion (14) of the container (1), wherein, with reference to the fourth and/or fifth sheets (62, 64) the process includes a step of forming, on the respective portion (63, 65), at least one further portion (66) joined in a single piece to said portion (63, 65) by a weakening line (67), said further portion being configured for defining the removable portion (15), optionally supporting at least one projection (25), wherein the process includes at least the following steps:

folding the portion (65) of the fifth sheet (64) on the second portion (54*a*) of the first sheet (51), said portion (65) of the fifth sheet (65) forming the second hooking portion (14) of the safety device (12), folding the first sheet (51) along the longitudinal edges of the portions of the central sheet itself by joining said lateral connecting portions (55, 56) for defining the container (1) exhibiting at least the opening (5), optionally, folding the portion (61) of the third sheet (60) in order to form the abutment portion (11) of the container (1), folding the first and second portions of the second sheet for respectively forming the closing portion (9) and inserting portion (10) of the closing system (7), at the end of the folding steps, the removable portion (15) being completely contained into the inner volume (3) of the container.

BRIEF DESCRIPTION OF THE DRAWINGS

Some embodiments and some aspects of the invention will be described in the following with reference to the attached drawings, given only in an indicative and therefore non-limiting way, wherein:

FIG. 19 is a perspective view of a second semifinished product for making a container of the package according to the present invention;

FIGS. 20 to 23 schematically illustrate the steps of making said container;

FIGS. 24 to 28 are schematic details of the container of the package according to the present invention;

DEFINITIONS AND CONVENTIONS

Figure 1:
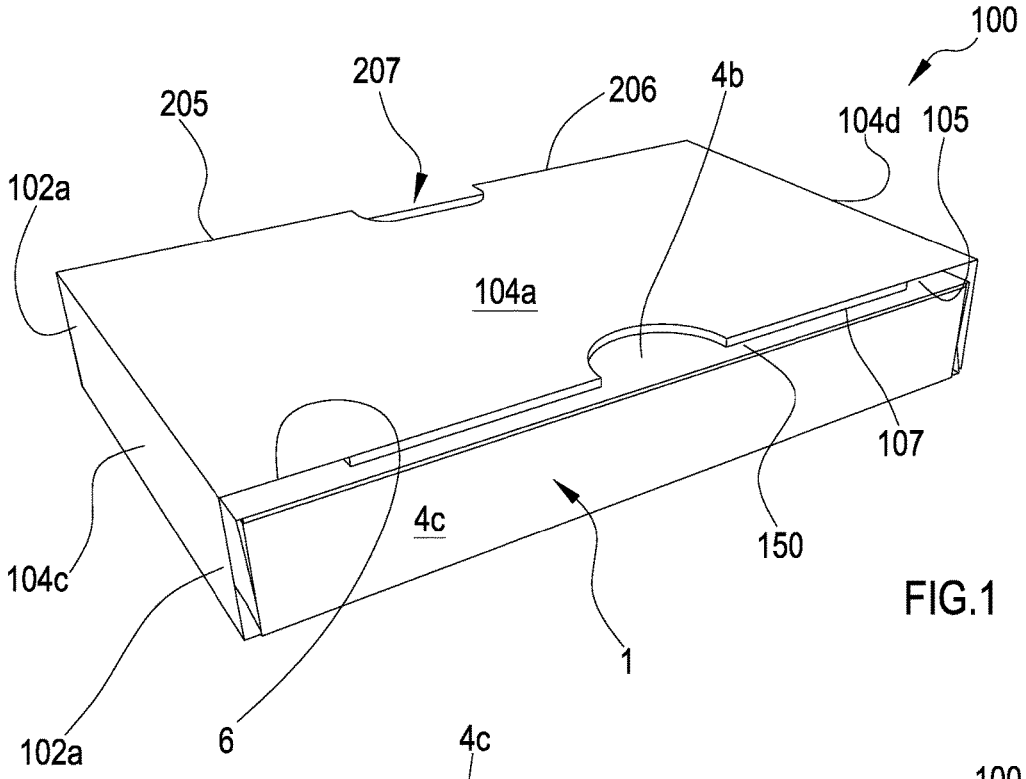
FIGS. 1 and 2 are respectively a perspective view and a cross-section schematic view of a package according to the present invention.

It is observed that in the present detailed description, corresponding parts illustrated in the different figures, are indicated by the same numeral references. The figures could illustrate the object of the invention by not-to-scale representations, therefore parts and components illustrated in the figures regarding the object of the invention could only refer to schematic representations.

Instead, the term product means an article or a composition of articles of any type. For example, the product can be a drug or a medicine in a solid, liquid, or gel state, in other words as two or more of said aggregation states. Moreover, the product can include, for example: food products (confectionery products, for example), cigarettes or cigars.

In addition, the term product can mean a package, for example a blister, supporting a plurality of articles. Moreover, the term "product" can mean at least one selected in the group among: one or more bottles of cosmetics articles, one or more bottles of drugs.

The term paper material means paper or paperboard; particularly, the sheet material useable for making the package can exhibit a grammage included between 100 and 500 $g/m^2$, particularly included between 200 and 400 $g/m^2$. The discussed paper material extends between a first and second prevalent development surfaces. The paper sheet material used for making the package can, in an embodiment variant thereof, be covered for at least a part of the first and/or second prevalent development surfaces by a coating of plastic material, for example a film, whose object includes reinforcing the package. When the coating is arranged for covering an outer surface of the package, this can be further used for defining a water and/or moisture barrier useful for avoiding the weakening and loss of structurality of the package with a consequent warping of the paper material forming this latter. Advantageously but in a non-limiting way, the coating can include a plastic film adapted to completely cover both sides (the first and second prevalent development surfaces) of the paper material defining the package; the thickness of the coating film can exhibit values varying between 5 and 300 μm, particularly between 10 and 200 μm, still more particularly between 10 and 100 μm. The plastic material of the coating can be for example selected among the following materials: LDPE, HDPE, PP, PE.

DETAILED DESCRIPTION

1. Package 100

100 generally indicates a package for example useable for containing products, which can find an application in all the fields requiring, for safety reasons, to prevent the package itself from being opened by children; advantageously but in a non-limiting way, the package 100 can further find an application in all the fields which provide to close the package itself and exhibit a safety feature enabling to evidence a possible tampering of this latter.

1.1 First Embodiment of the Package 100

A first embodiment of the package 100 includes a casing 102 made of a sheet material, particularly of a paper sheet material, defining an inner volume 103. Particularly, the casing 102 includes a predetermined number of lateral walls 104 defining at least one passage opening 105 delimited by a free edge 106; the passage opening 105 is configured for enabling the inner volume 103 to communicate with the outer environment. The attached figures illustrate, in a non-limiting way, a configuration of the casing exhibiting two passage openings opposite to each other, so that the casing 102 can substantially define a conduit or tube laterally delimited by said walls 104 and open at longitudinal ends. Still more particularly, the casing 102 extends between a first and second longitudinal end portions 102*a*, 102*b* along a longitudinal development direction of the casing 102 itself; the lateral walls 104 therefore define:

- a first passage opening 105 delimited by a free edge 106 and located at the first longitudinal end portion 102*a*,
- a second passage opening 205 delimited by a respective free edge 206 and located at the second longitudinal end portion 2*b*.

Figure 44:
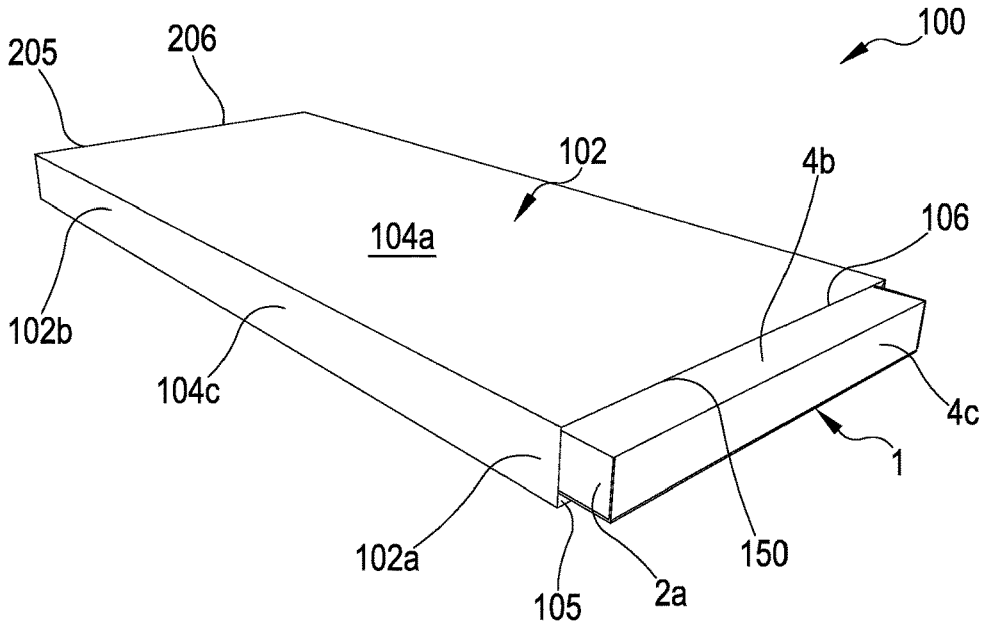
FIG. 44 is a perspective view of a further embodiment variant of a package according to the present invention.
Figure 45:
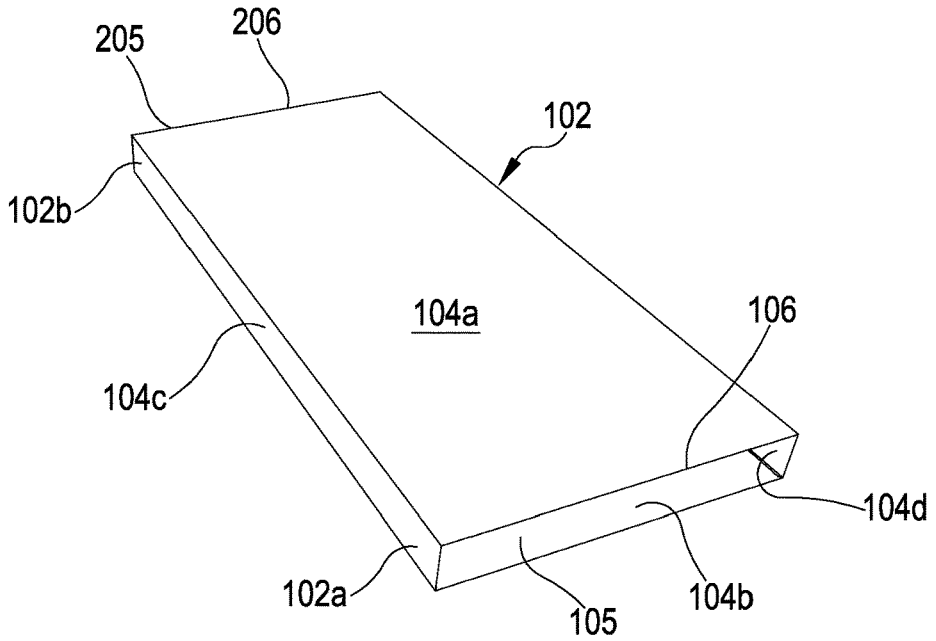
FIGS. 45 and 46 illustrate respectively a casing and a container of the package in FIG. 44.

See FIGS. 44 and 45 for example. The attached figures illustrate a preferred but non-limiting configuration of the casing 102, which exhibits a rectangular prismatic shape (the flat lateral walls 104 have a rectangular shape). Actually, the casing 102 exhibits a front wall 104*a* and a rear wall 104*b* facing and parallel to each other: the front wall and rear wall are connected to each other by a first and second lateral walls 104*c*, 104*d* also facing and parallel to each other. The front wall 104*a* is distanced from the rear wall 104*b*; the first and second lateral walls 104*c*, 104*d* are also distanced from each other (see FIG. 45). The casing 102 exhibits, along a cross-section transversal to the lateral walls, a parallelogram shape, particularly a square or rectangular shape. However, it is not excluded the possibility of making a casing 102 having a different shape, for example a square, trapezoidal shape.

In the first embodiment of the package 1, the second passage opening 205 of the casing is occluded by a closing system (this system is not illustrated in the attached figures) which can include one or more tabs of sheet material glued to each other. De facto, in the first embodiment of the package 100, the casing 102 exhibits a single access to the inner volume 103, represented by the first passage opening 105: the second passage opening is occluded. The casing, at the second end portion 102*b*, exhibits substantially a bottom wall adapted to prevent the access to the inner volume 103.

Figure 14:
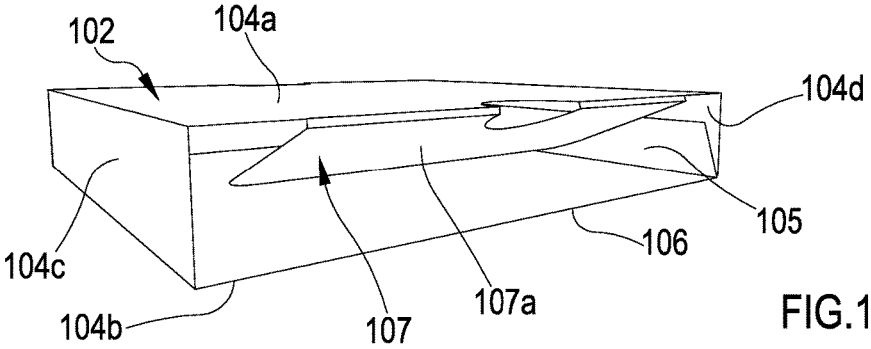
FIG. 14 is a perspective view of a casing of the package according to the present invention.

In the first embodiment of the package, the casing 102 includes, at the first end portion 102*a*, an engagement portion 107 emerging, from at least a lateral wall 104, inside the inner volume 103 for defining a projection (see FIG. 14, for example). In such embodiment, the engagement portion 107 is directly constrained, particularly is joined in a single piece, to the free edge 106 of the passage opening 105: the engagement portion 107 emerges from the free edge 106 according to a direction entering the inner volume 103, in other words towards the second passage opening 205 of the casing 102. Still more particularly, the engagement portion 107 is constrained to the front lateral wall 104*a* of the casing 102 (see FIG. 14 again). The engagement portion is movable with respect to the lateral walls 104 by rotating about the free edge 106 to which is constrained. Particularly, the engagement portion 107 is joined in a single piece to the front lateral wall 104*a* and is rotatably with respect to this latter.

The engagement portion 107 includes at least one tab 107*a* (FIG. 14) of sheet material, particularly of paper sheet material, joined in a single piece to the front wall 104*a*. At least part of the tab 107*a* extends along a rectilinear development direction sloped with respect to an extension direction of the front wall 104*a* to which the tab 107*a* itself is joined in a single piece. The tab defines—with the front wall to which the tab itself is joined in a single piece—an angle equal to or greater than 1°, particularly included between 1° and 15°, still more particularly included between 1° and 5°; said angle being defined in the inner volume 103 and being subtended between the tab 107*a* and the front lateral wall 104*a*.

From the dimensional point of view, the casing 102 defines an inner volume 103 substantially greater than 20,000 $mm^3$, particularly included between 40,000 and 200,000 $mm^3$. However, the casing 102, object of the present invention, can be used for packaging medium-sized products: in such condition, the casing 102 can exhibit an inner volume greater than 500,000 $mm^3$, particularly included between 800,000 and 1,400,000 $mm^3$. However, it is not excluded the possibility of using the package 100 for packaging large-sized products; in such condition, the casing 102 can exhibit an inner volume 103 greater than the above specified volumes, for example greater than 10,000 $cm^3$ but in a non-limiting way.

In the first embodiment of the package 100, the same includes at least one container 1 of sheet material, particularly of paper sheet material, distinct from the casing 102 and configured for housing at least one product. The container 1 exhibits a predetermined number of lateral walls 4 defining at least one respective passage opening 5 delimited by a respective free edge 6. The passage opening 5 of the container 1 is configured for enabling to insert and withdraw the product from the container 1. In the first embodiment of the package, the container 1 extends between a first and second end portions 2*a*, 2*b* along a longitudinal development direction; therefore, the lateral walls 4 define:

- a first longitudinal passage opening delimited by a free edge and located at the first longitudinal end portion,
- a second longitudinal passage opening delimited by a respective free edge and located at the second longitudinal end portion.

The container substantially defines a conduit or tube laterally delimited by said walls 4 and open at the longitudinal ends. In the first embodiment of the package, the container 1 exhibits a rectangular prismatic shape (the flat lateral walls 4 have a rectangular shape). Actually, the container exhibits a front wall 4*a* and a rear wall 4*b* facing and parallel to each other: the front wall and rear wall are connected to each other by a first and second lateral walls 4*c*, 4*d* also facing and parallel to each other. The front wall 4*a* is distanced from the rear wall 4*b*; the first and second lateral walls 4*c*, 4*d* are also distanced from each other. The container exhibits, according to a cross-section transversal to the lateral walls, a parallelogram shape, particularly a square or rectangular shape (see FIGS. 44 and 46). However, it is not excluded the possibility of making a container 1 having a different shape, for example a square, trapezoidal shape. Advantageously, the container is at least partially counter-shaped to the casing 102.

In the first embodiment of the package 1, the first and second longitudinal passage openings of the container 1 are occluded by a closing system (this system is not illustrated in the attached figures) which can include one or more tabs of sheet material glued to each other.

In the first embodiment of the package, the container 1—at the rear lateral wall 4*b*—includes at least one seat 91 delimited by at least one stop wall 92 delimiting at least partially the package opening 5 of the container 1: the stop wall 92 delimiting at least part of the seat 91 further defines at least one stop element 90 which, as it will be better described in the following, is adapted to cooperate with the engagement portion 107 of the casing 102.

Figure 46:
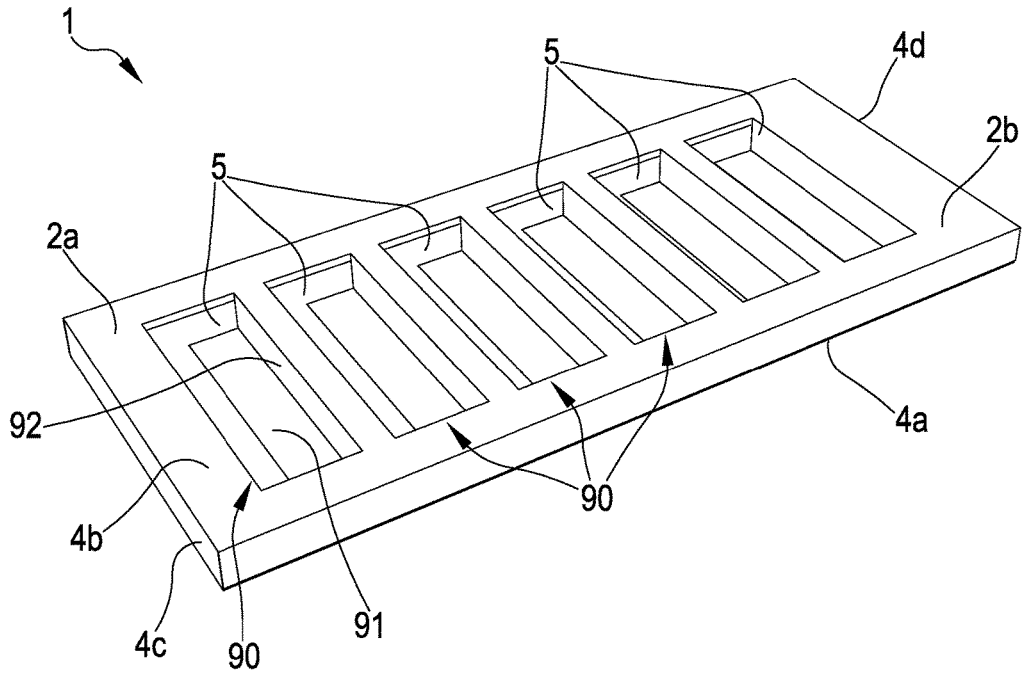

FIG. 46 illustrates an embodiment of the container 1 comprising—between the first and second lateral walls 4*c*, 4*d*—a plurality of seats 91 distanced from each other and aligned along a single direction transversal, particularly normal, to the development direction of the container 1. Each seat defines a respective stop element 90 and a respective passage opening 5 for withdrawing and inserting a product into the container.

The container 1 is configurable between:

- a first operative position wherein the container 1 itself is at least partially housed in the casing 102 (see FIG. 44, for example). In the first operative position, the passage opening 5 (optionally a plurality of passage openings 5) of this latter is at least partially defined inside the inner volume 103 of the casing 102 which—in such first operative position—prevents the product from being inserted and withdrawn from the container 1,
- a second operative position wherein the container 1 itself is at least partially disposed outside the inner volume 103 of the casing 102. In the second operative position, the passage opening 5 of this latter is defined outside the casing 102 and is adapted to enable to insert and withdraw the product from the container 1.

More particularly, in the first operative position, the front and rear lateral walls 4*a*, 4*b* of the container 1 face respectively the rear and front walls 104*b*, 104*a* of the casing 102. As hereinbefore described, the stop element 90 is defined on the rear lateral wall 4*b* of the container 1, which is configured for abutting, in the first operative position, against the engagement portion 107 of the casing 102 for preventing the container 1 from switching from the first to the second operative positions.

Figure 2:
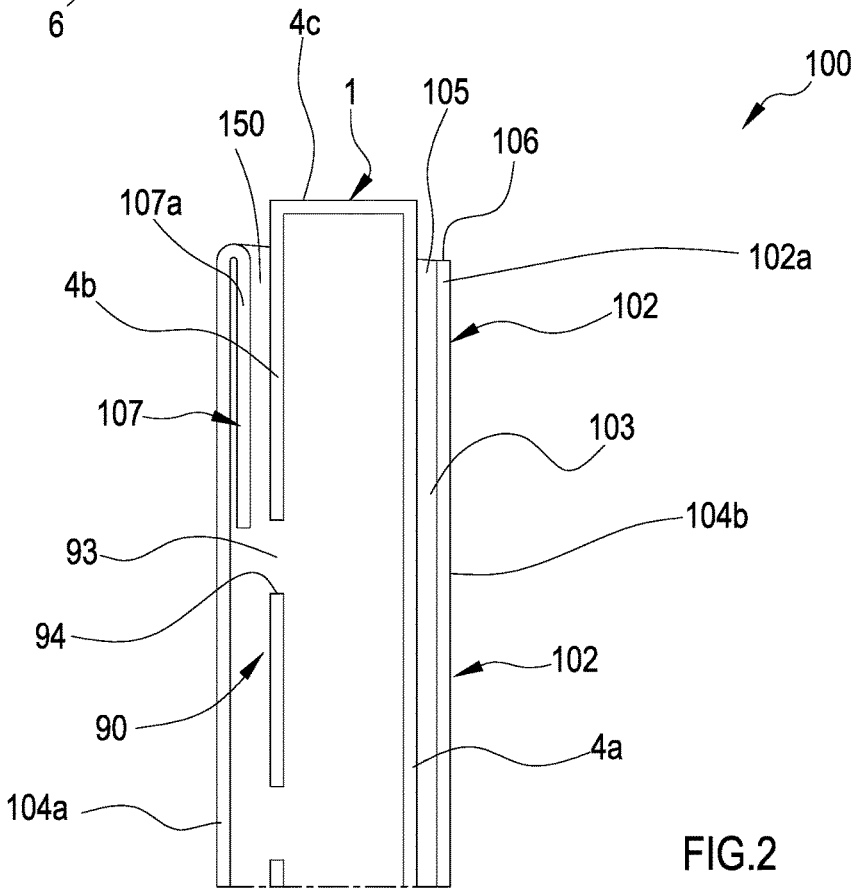
Figure 3:
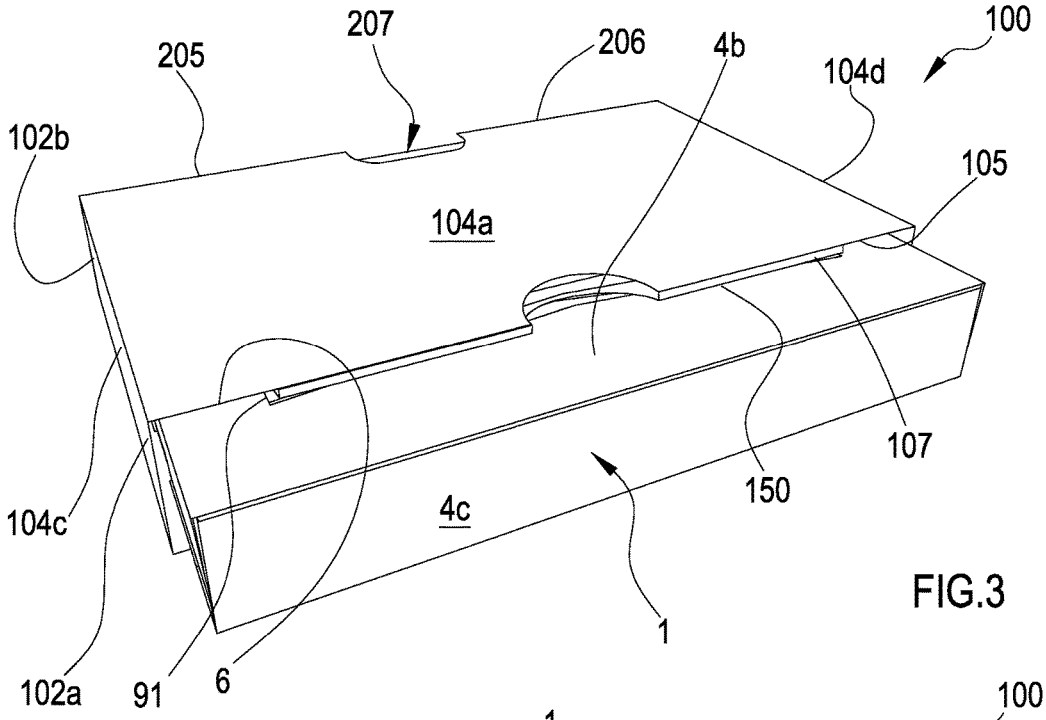
FIGS. 3 and 4 are respectively a perspective view and a cross-section schematic view of a package according to the present invention in a first operative position.

FIG. 2 schematically shows a condition wherein the container 1 is disposed in the casing 102; particularly FIG. 2 illustrates a condition wherein the container 1 is disposed in a condition of maximum insertion inside the casing.

Figure 4:
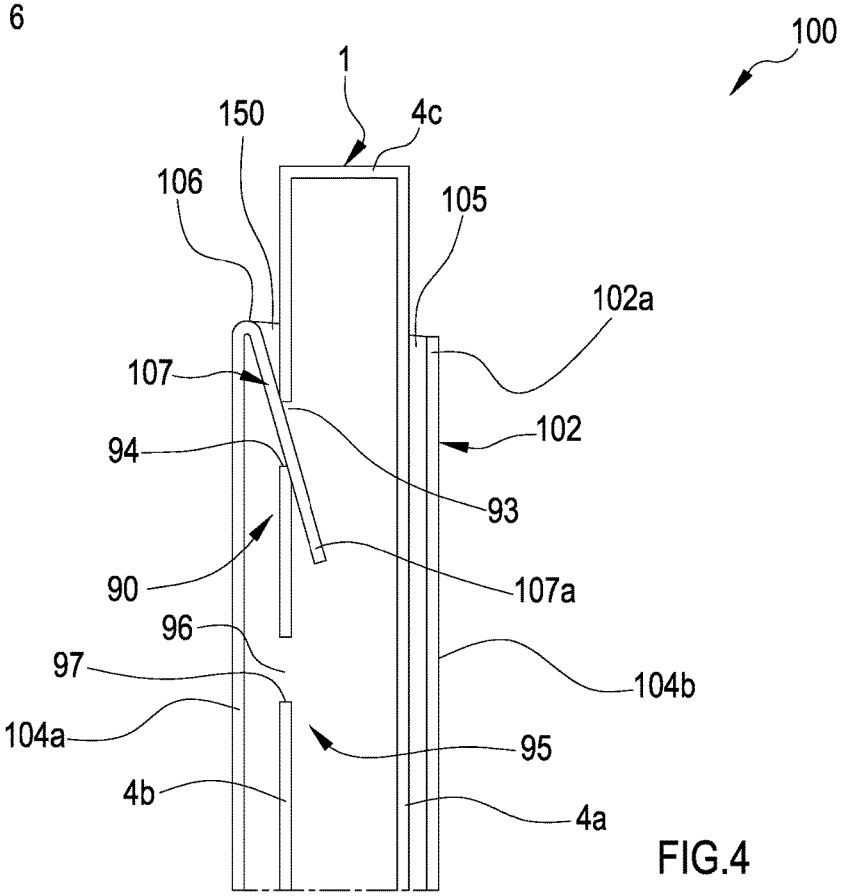
Figure 5:
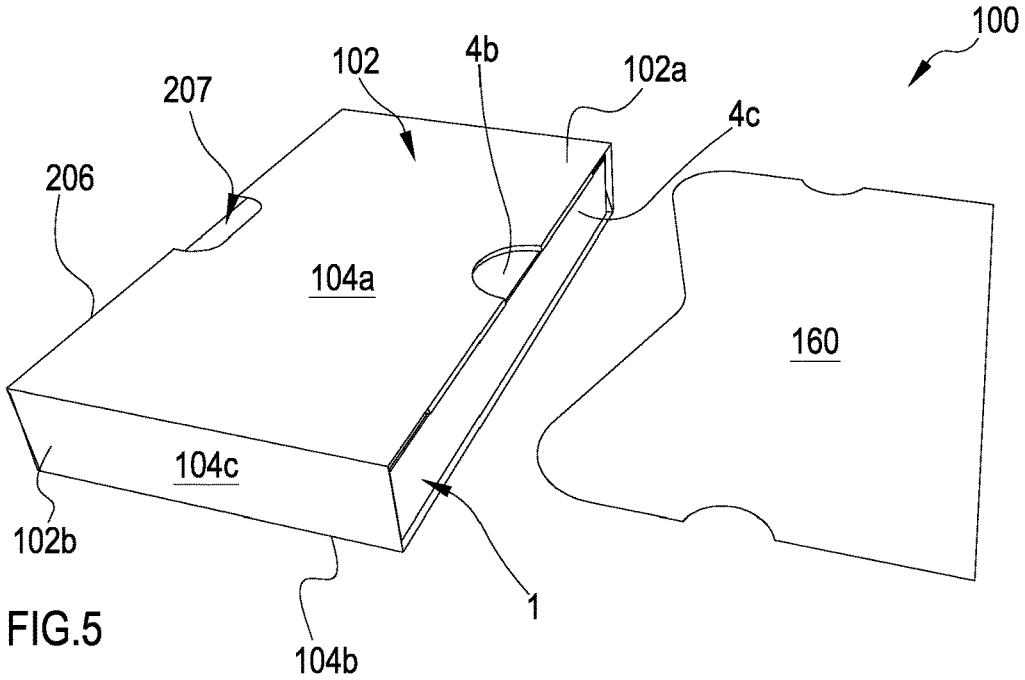
FIG. 5 is a perspective view of a package comprising, in a non-limiting way, an open device according to the present invention.

When somebody tries to extract the container 1 from the casing 102, the engagement portion 107 abuts against the stop element 90 of the container 1 as schematically shown for example in FIG. 4: fitting the engagement portion 107 with the stop element 90 prevents the container 1 from exiting the casing 102 and therefore from uncovering the passage opening 5. De facto, the incapability of extracting the container 1 prevents the products from being withdrawn from the container 1.

When the container 1 exhibits a plurality of stop elements 90 (FIG. 46), it is noted that each of them is configured for cooperating with the engagement portion 107 of the casing for defining a first operative position.

The attached figures illustrate a preferred but non-limiting embodiment of the invention wherein the seat 91 is delimited by a free edge having a rectangular shape extending along a direction transversal to the prevalent development direction of the container. The seat 91 and consequently the stop element 90 extend along a direction transversal, particularly normal, to the extension direction of the engagement portion 107.

In the first embodiment of the package, the seat 91 and consequently the passage opening 5 of the container 1, are defined on the rear lateral wall 4*b* and face the front lateral wall 104 of the casing 102. The container 1, at least in the first operative position, exhibits the first and second lateral walls 4*c*, 4*d* respectively disposed at the first and second passage openings 105, 205 of the casing 102.

As it is for example visible in the schematic views in FIGS. 2, 4, 6, 7 and 47, the package 100 includes at least one slot 150—defined between at least one lateral wall 104 of the casing 102 and at least one lateral wall 4 of the container 1—configured for enabling, at least in the first operative position, to insert at least one open device 160 adapted to enable to disengage the stop element 90 of the container 1 from the engagement portion 107 of the casing 102 for enabling the container 1 to switch from the first to the second operative positions.

Particularly, the package 100 includes an open device 160 of sheet material, particularly of paper sheet material, configured for being inserted at least partially, at least in the first operative position, through the slot 150 for enabling to disengage the stop element 90 of the container 1 and the engagement portion 107 of the casing 102.

More particularly, the slot 150 is defined between the lateral wall 104 of the casing directly supporting the engagement portion 102, and the lateral wall of the container 1, on which the stop element 90 is defined. In the first embodiment of the package 100, the slot 150 is defined between the rear lateral wall 4*b* of the container 1 and the front lateral wall 104*a* of the casing.

Advantageously, the slot 150 extends all along the development of the lateral wall 104 of the casing 102 directly supporting the engagement portion 107 as illustrated in FIG. 1, for example.

Figure 6:
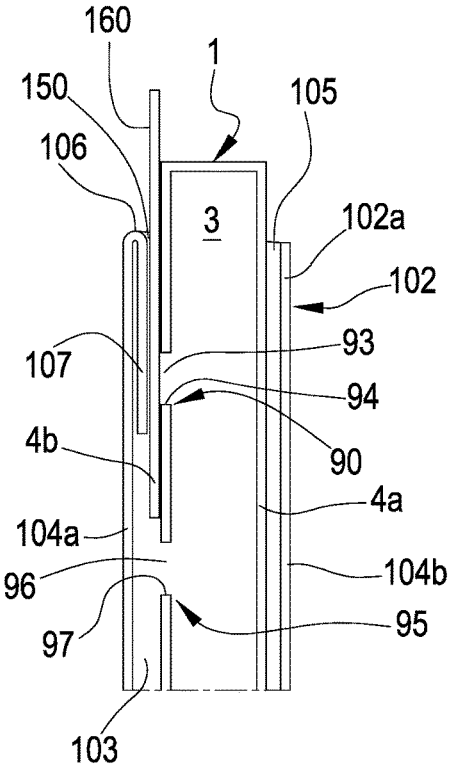
FIGS. 6 and 7 are further cross-section schematic views of a package according to the present invention disposed in different operative conditions.
Figure 7:
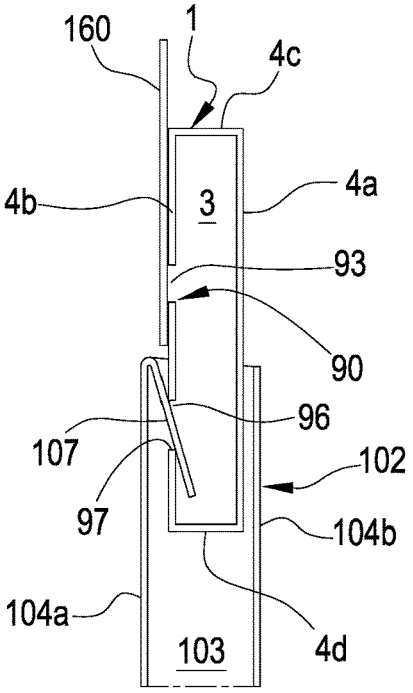
Figure 49:
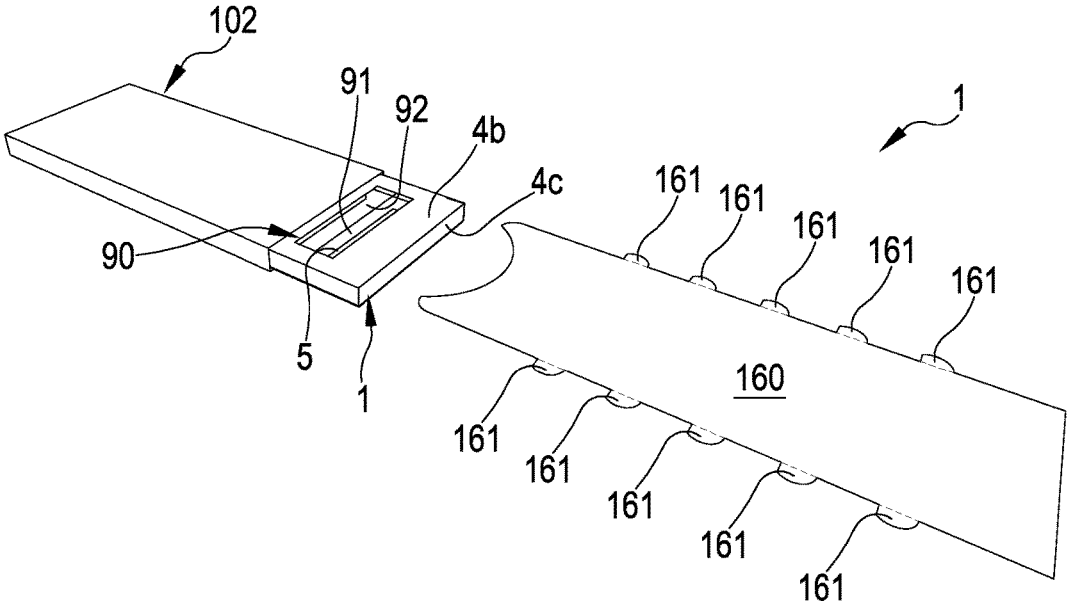

FIG. 6 schematically shows an operative condition in which the open device 160 is inserted, so that is interposed between the stop element 90 and the engagement portion 107 for enabling their disengagement: upon disengaging the element 90 and portion 107 from each other, the container 1 can switch from the first to the second operative positions as illustrated in FIGS. 7 and 49, for example.

Figure 47:
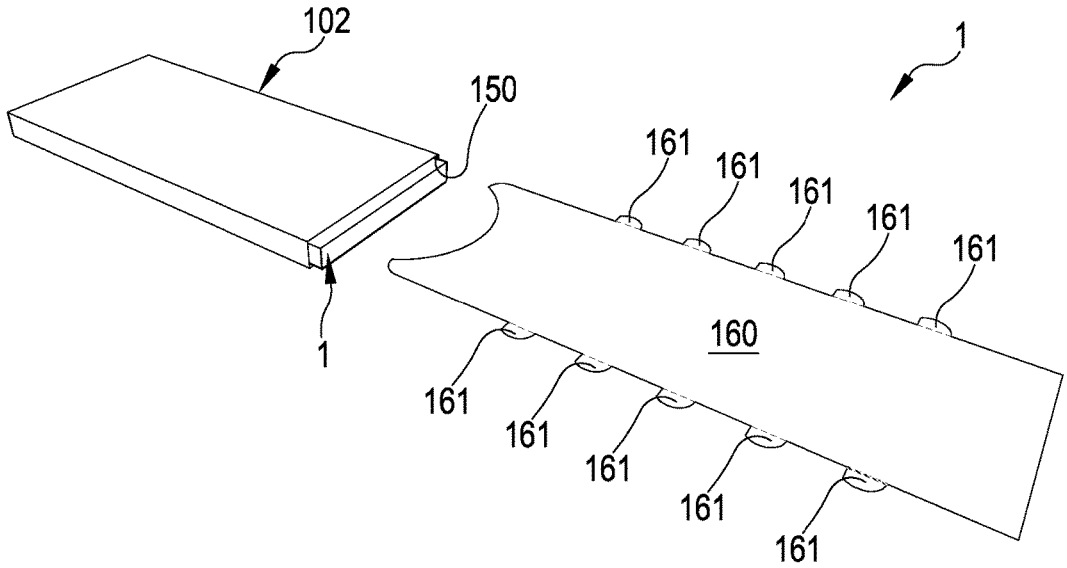
FIGS. 47 to 49 schematically illustrate the package of FIG. 44 in different operative conditions.
Figure 48:
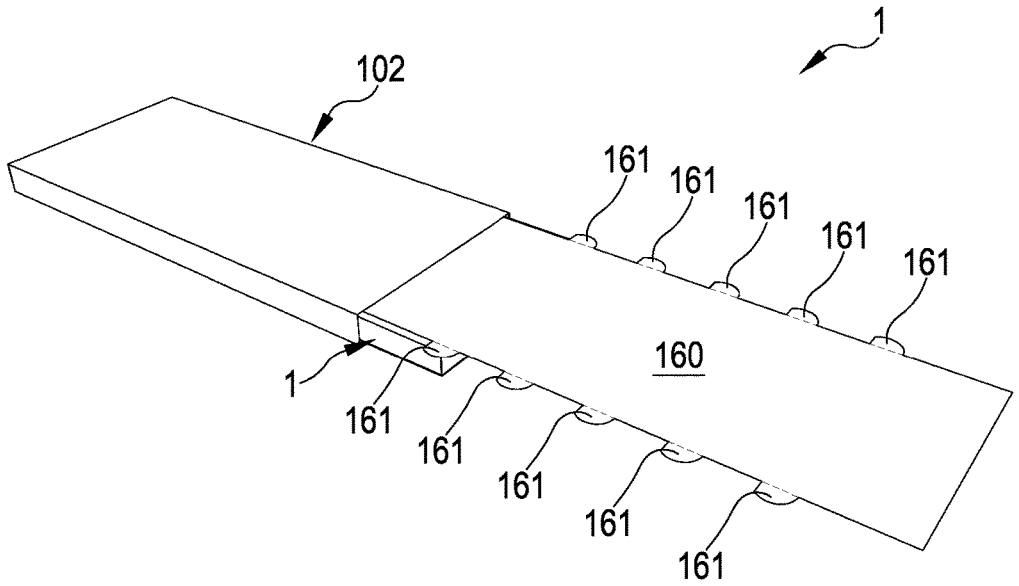

The open device 160 extends along a development direction between a first and second longitudinal portions 160*a*, 160*b* (FIG. 47). Advantageously, the open device 160 exhibits a width—defined by the maximum distance between said longitudinal portions 160*a*, 160*b*-substantially equal to the extension of the container 1, defined by the maximum distance between the first and second end portions 2*a*, 2*b*.

In an embodiment illustrated in FIG. 47 for example, the open device 160 includes a main body 160*a* and a plurality of transversal distanced blocking elements 161 laterally emerging from the main body according to a direction transversal to the development direction of the device 160 itself; particularly, the distance between two blocking elements 161 immediately consecutive along the development direction of the device 160, is substantially equal to the distance between two immediately consecutive stop elements 90 of the container 1. Each blocking element 161 being configured for enabling to partially insert the open device 160 for enabling to extract the container to a predetermined passage opening 5. Advantageously, the blocking elements 161 are constrained to the main body 160*a* by weakening lines adapted to enable to remove (tear) the blocking elements of the main body 160*a*.

Advantageously, the container 1 can include an auxiliary seat 96 defined on the lateral wall 4 itself, on which the stop element 90 is defined; the auxiliary seat 96 being delimited by an edge 97 which defines an auxiliary stop element 95 also configured for cooperating with the engagement portion 107 of the casing 102. More particularly, the auxiliary stop portion 95—in the first operative portion of the package 100—is distanced from the opening 105 so that the stop element 90 is interposed between said passage opening 105 and the auxiliary stop portion 95 (see FIG. 4, for example).

The auxiliary stop portion 95 is configured for abutting against the engagement portion of the casing 102 for preventing to completely extract the container 1 from the casing 102. De facto, when somebody tries to further extract the container 1 from casing 102—starting from the second operative position of the package—the engagement portion 107 is configured for being inserted in the seat 96 and abutting against the edge 97 (FIG. 7), so that it prevents to completely extract the container 1 from the casing 102.

1.2 Second Embodiment of the Package 100

In a second embodiment of the package 100, the same includes a casing 102 made of sheet material, particularly of paper sheet material, as hereinbefore described with reference to the first embodiment. Unlike the first embodiment, the casing 102 exhibits—as a substitute for the closing system of the second passage opening 205, an occluding system 207 (FIGS. 1, 3, 5 and 8). De facto, at the second end portion 102*b*, the casing 102 includes an occluding system 207 of sheet material, particularly of paper sheet, engaged with the free edge 206 of the second opening 205.

Therefore, the occluding system 207 is defined oppositely to the passage opening 105. The occluding system 207 is configured for irreversibly closing the second passage opening 205 and therefore preventing to gain access from the outside into the inner volume 103 through said second passage opening 205. In the second embodiment of the package 100, the casing 102 is open only at the first passage opening 105.

The occluding system is configured for blocking the access to the inner volume 103 of the casing 102 through the opening 205 following a first closed condition of the occluding system 207. The system 207, following a first closed condition of the same, is configured for being irreversibly blocked and preventing therefore the same to be opened again.

Figure 16:
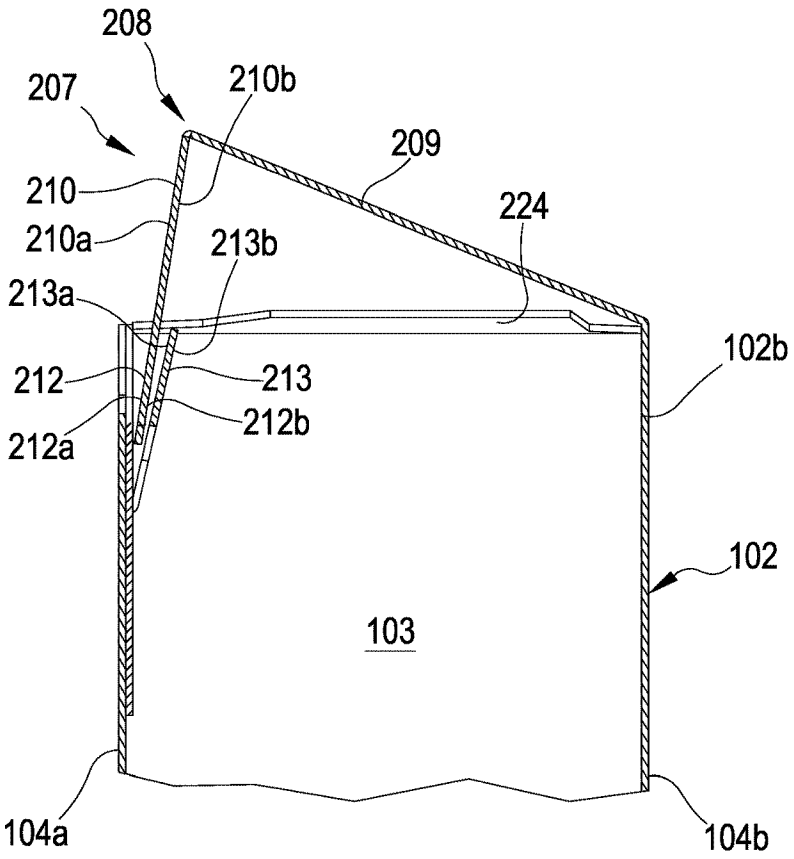
FIGS. 15 to 18 are schematic details of the casing of the package according to the present invention.
Figure 15:
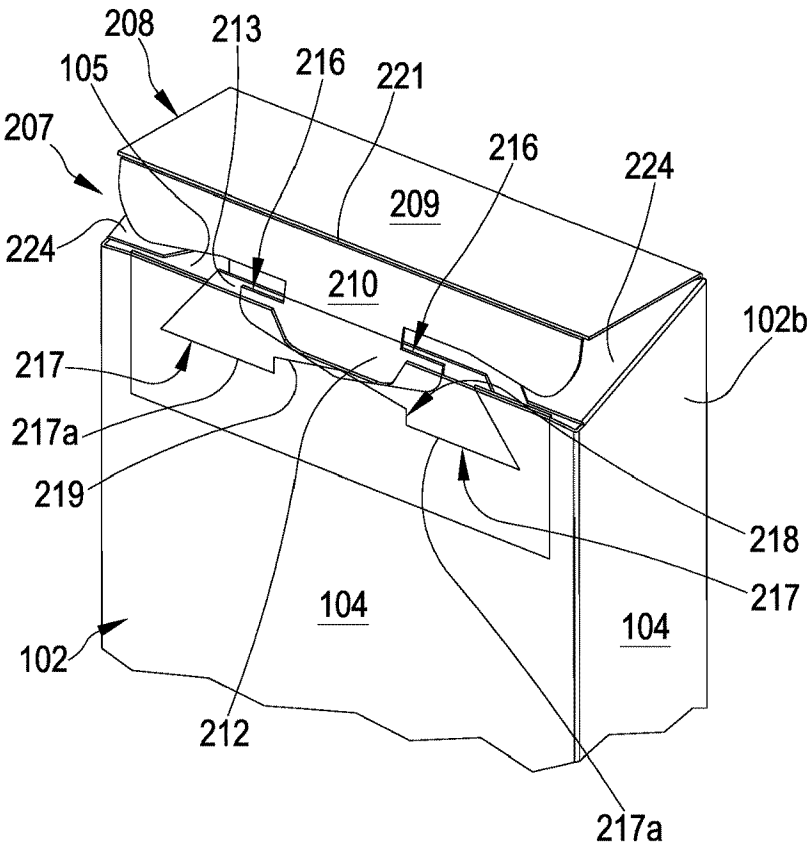
Figure 18:
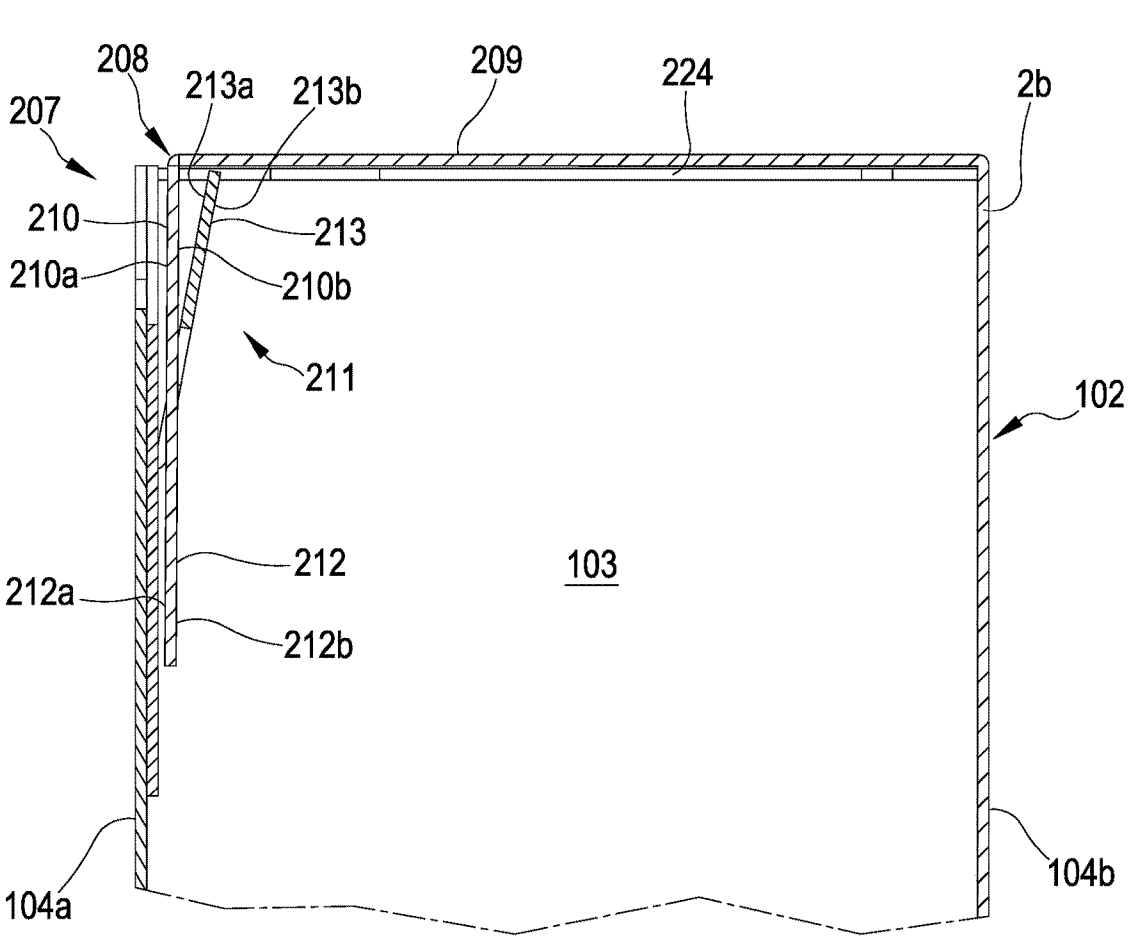
Figure 21:
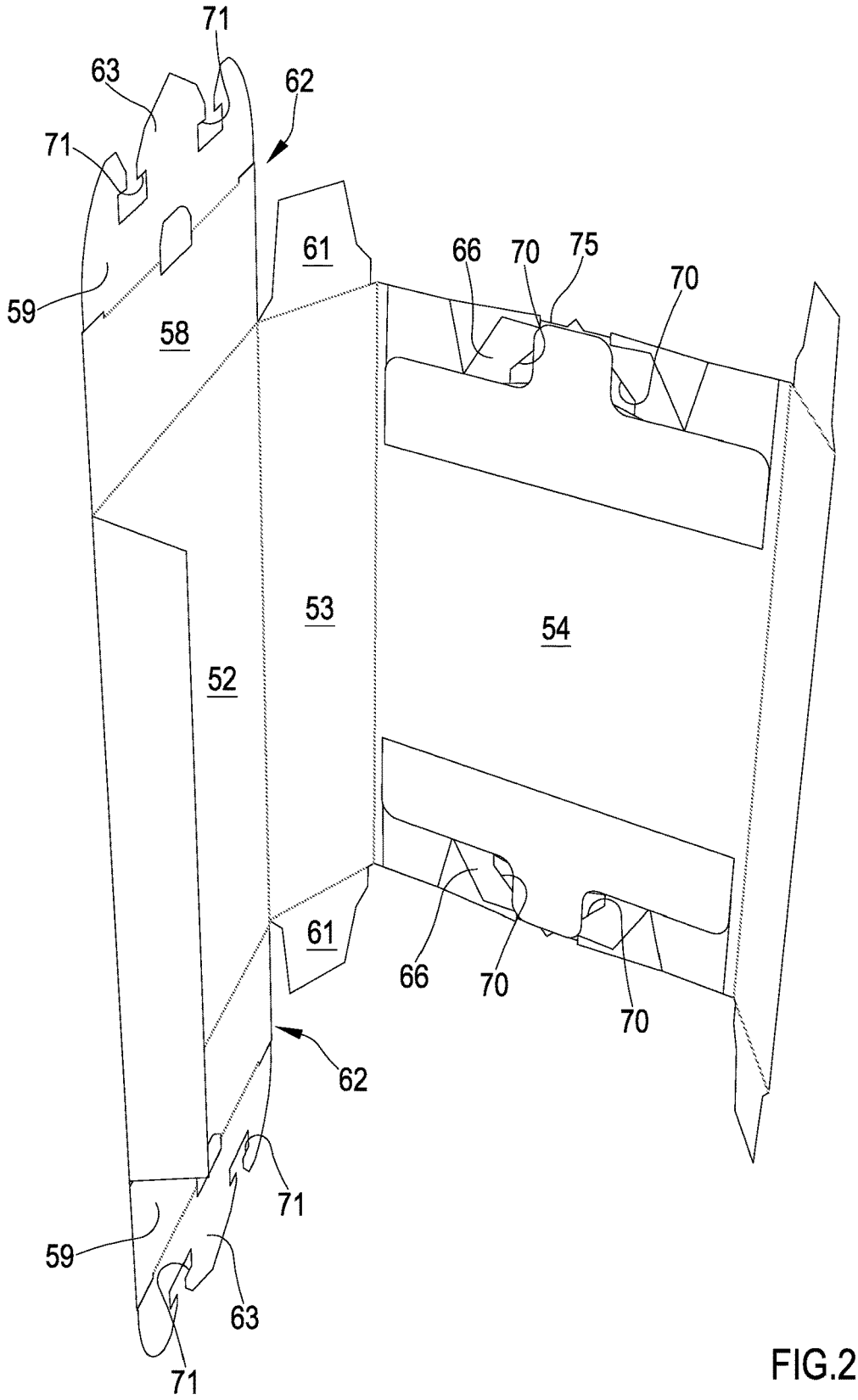
Figure 22:
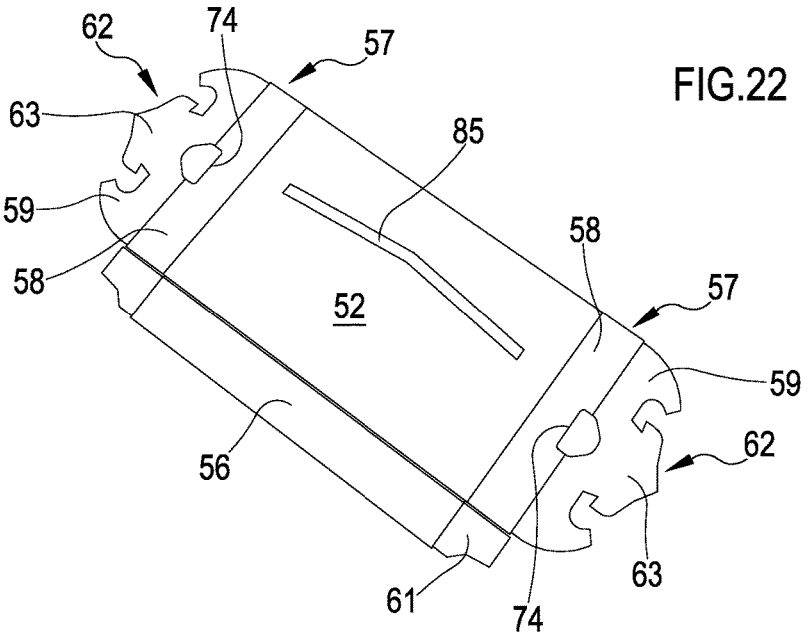
Figure 23:
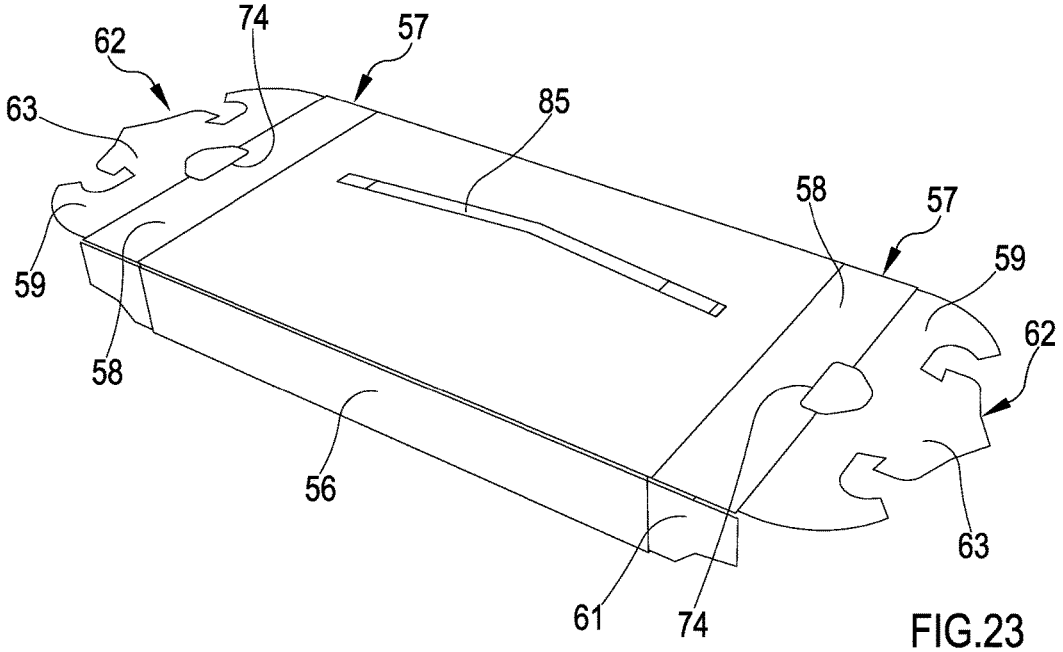

For a better comprehension of the structure of the occluding system 207, FIGS. 15 and 16 schematically illustrate a first closing step of the occluding system, at the end of it, the system 207 irreversibly occludes the passage opening 205. Instead, FIGS. 18 and 19 schematically illustrate the blocked occluding system.

As it is visible in FIG. 15, the occluding system 207 includes at least one tab 208 which exhibits a closing portion 209 directly engaged with and joined in a single piece to the free edge 206: the closing portion 209 is a component of the tab 208 configured for preventing the passage through the opening 205 of the system 207 itself. As it is visible in FIG. 15, for example, the closing portion 209 substantially includes a flat body of sheet material countershaped to the free edge 206 of the opening 205. The attached figures schematically illustrate a preferred configuration of the closing portion 209 exhibiting a rectangular shape completely countershaped to the free edge 206.

The tab 208 includes an inserting portion 210 disposed inside the volume 103. The inserting portion 210 is joined in a single piece to the closing portion 209, and emerges from this latter: the inserting portion 210 is substantially an extension of the closing portion 209. Particularly, the inserting portion 210, in an operative condition defined after the first closed condition of the occluding system 207, is completely inside the volume 103. As it is visible in FIGS. 15 and 16, also the inserting portion 210 substantially includes a flat body of sheet material having, in a non-limiting way, a rectangular shape. As it is visible for example in the cross-section view of FIG. 16, the inserting portion 210 extends between a first and second prevalent development surfaces 210*a*, 210*b* respectively facing the outside (directly facing the front lateral wall 104*a* of the casing) and towards the inner volume 103: at least one portion of the first development surface 210*a* of the inserting portion 210 faces, particularly contacts, directly a portion of a lateral wall 104 (particularly of the front wall 104*a*). The surface 210*a* extends at least particularly parallel to the front lateral wall 104*a*, particularly to a wall 104 opposite to the wall directly connected to the system 207, in other words opposite to the rear wall 104*b*.

The closing portion 209 and inserting portion 210 exhibit a reciprocal connecting edge opposite to the free edge 206 with respect to the closing portion 209 itself. The inserting portion 210 is configured for defining, according to a cross-section transversal and cooperatively with the closing portion 209, a substantially "L" shape.

More particularly, the closing portion 209 of the tab 208 of the occluding system 207 exhibits a shape delimited by a closed outer perimeter countershaped and substantially identical to the second passage opening 205: the closing portion 209 of the occluding system 207 completely covers the second passage opening 205. As it is visible in FIG. 15, the closing portion 209 of the occluding system 207 is devoid of through openings; particularly, the closing portion 209 is joined in a single piece to the inserting portion 210 for defining a single continuous body delimited by a single outer closed perimeter devoid of through openings defined inside said closed outer perimeter.

As it is visible in FIG. 15, for example, the occluding system 207 can include at least one abutment portion 224 engaged with the free edge 206 of the casing 102 adjacent the tab 209: the abutment portion 224 is configured for being interposed between the inner volume 103 and tab 208 so that it cooperates with this latter in order to have a better blockage of the system 207. The abutment portion 224 substantially includes a flat tab of sheet material joined in a single piece to the free edge 206 adjacent the closing portion 209. The abutment portion 224 exhibits, in a non-limiting way, a rectangular or trapezoidal shape.

More particularly, the abutment portion 224 is constrained to the free edge 206 so that it can engage at least part of the inserting portion 210 and/or of the closing portion 209 for stably holding the tab 208 in said condition. Advantageously, the container 1 includes two abutment portions 224 opposite to each other with respect to the tab 208: this latter is interposed between the two abutment portions 224 (FIG. 15). In such configuration, the two abutment portions 224 operate symmetrically on the tab 208 and cooperatively with the occluding system 207 for holding stably blocked this latter.

Advantageously, the occluding system 207 is made of a paper sheet material and is obtained by folding; particularly the system 207 is made in a single piece with the lateral walls 104 and particularly is directly connected in a single piece to the front and rear lateral walls 104*a*, 104*b*.

More particularly and as it is visible in FIG. 15, for example, the occluding system 207 includes at least one first hooking portion 212, supported by the tab 208 and at least one second hooking portion 213, engaged with the lateral wall (particularly the front lateral wall 104*a*) of the casing. The first and second hooking portions 212, 213 are stably and irreversibly engaged with each other. Following the first closed condition of the system 207, the casing is substantially in a blocked condition in which the access to the casing 102 at the second passage opening 205 (at the second end portion 102*b* of the casing 102), is prevented by the engagement itself between the first and second hooking portions 212, 213. The second hooking portion 213 is disposed inside the inner volume 103 and substantially lies in a plane parallel to one of the lateral walls 104. Particularly, the second hooking portion 213 includes a tab of sheet material, optionally of paper sheet material, extending along a development plane: the tab of the hooking portion 213 includes a body exhibiting a substantially "C" shape the concavity thereof faces away from the closing portion 209 of the occluding system 207. As it is visible for example in the cross-section view of FIG. 16, the tab of the second hooking portion 213 of the occluding system 207 is sloped with respect to the inserting portion 210 facing said second hooking portion 213; particularly, the tab of the second hooking portion 213 of the occluding system 207 exhibits an angle of inclination with respect to the inserting portion 210 facing said second hooking portion 213, less than 20°, optionally less than 10°.

The second hooking portion 213 develops completely inside the volume 103 (is disposed completely inside the casing). The first hooking portion 212 is also disposed completely inside the inner volume 103. Particularly, the first hooking portion 212 is completely contained inside the volume 103 and is distanced from the free edge 206 of the second passage opening: the engagement between the second hooking portion 213 and first hooking portion 212 is defined completely inside the inner volume 103. The engagement between the first and second hooking portions 212, 213 is of an irreversible type; in other words, after a first closed condition of the occluding system is obtained, the first and second hooking portions 212, 213 cannot be disengaged anymore and therefore they cannot define an open condition of the casing 102 at the second end portion 102*b*. This is possible because the closing portion 209 and inserting portion 210 include, as hereinbefore described, solid bodies devoid of openings configured for covering the engagement between the portions 212 and 213: in this way, the hooking portions 212 and 213 cannot be reached in any way from the outside and therefore cannot be disengaged in any way.

More particularly, the first hooking portion 212 is engaged, particularly is directly supported, by the tab 208 of 207. Advantageously, the first hooking portion 212 is only supported, but in a non-limiting way, by the inserting portion 210 of the tab 208: the two portions 212 and 210 are advantageously joined in a single piece to each other in order to form a single body, particularly a single sheet of paper material. De facto, the first hooking portion 212 includes a body of a flat sheet emerging, particularly without interruption, from the inserting portion 210 oppositely to the closing portion 209: the inserting portion 210 is therefore interposed between the closing portion 209 and first hooking portion 212.

The body of sheet material of the first hooking portion 212 extends between a first and second prevalent development surfaces 212*a*, 212*b* (FIG. 16) respectively facing in the same direction of the first and second surfaces 210*a*, 210*b* of the inserting portion 210: the first surfaces 210*a*, 212*a* extends, without interruption between them and directly face a same lateral wall 104 (the front wall 104*a*) opposite to the lateral wall 104 directly connected to the closing portion 209 (the rear wall 104*b*). The second surfaces 210*b*, 212*b* extend also without interruption between them and face the inner volume 103.

Figure 17:
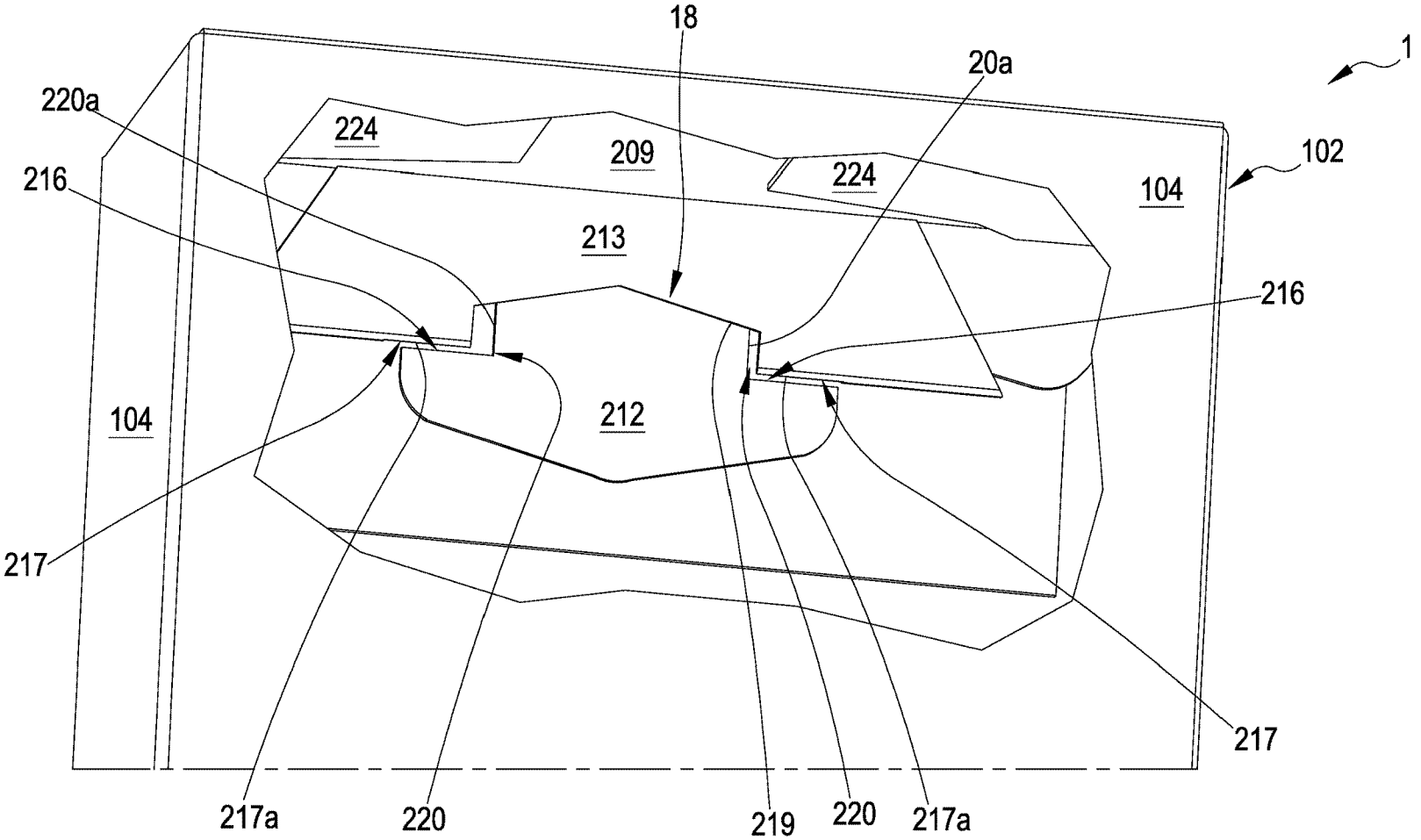

More particularly, the first hooking portion 212 exhibits at least one undercut 216 stably engaged with the second hooking portion 213 disposed in the inner volume 103. The undercut 216 is distinct and distanced from the free edge 206. As illustrated in FIG. 16, the undercut 216 includes at least one hook 220 having a seat 220*a* provided with a concavity. Preferably, the first hooking portion 212 includes two hooks 220 having respective seats 220*a*, the concavities thereof face away from each other. The undercut 216 is engaged with the second hooking portion 213 (FIG. 17). The second hooking portion 213 is engaged, in a non-limiting way, with a lateral wall 104 (the front wall 104*a*) directly facing the inserting portion 210.

The body of sheet material of the second hooking portion 213 extends between a first and second prevalent development surfaces 213*a*, 213*b* (FIG. 16). The first surface 213*a* is directly connected to the front lateral wall 104*a* of the casing 102 and faces the second surface 210*b* of the inserting portion 210.

The second hooking portion 213 exhibits in turn at least one undercut 217 which is disposed in the inner volume 103 stably (irreversibly) engaged with the undercut 216 of the first hooking portion 212. As illustrated in FIG. 15 for example, the undercut 217 exhibits a gripping edge 217*a* distinct and distanced from the free edge 206 of the casing 102. The undercut 217 exhibits at least one hook 218, which defines a seat 219. The seat 219 exhibits a substantially "C" shape. The seat 219 further exhibits a concavity facing a lateral wall 104 (the front wall 104*a*) inside which the first hooking portion 212 is housed (held). In other words, the first hooking portion 212 is engaged inside the seat 219 and the undercuts 216, 217 are engaged with each other (see FIG. 17, for example). The concavity of the seat 219 of the hook 218 of the second hooking portion 213 faces the concavity of the seat 220*a* of the hook 220.

In the second embodiment of the package, the container 1 is identical to the one described with reference to the first embodiment, and is configured for cooperating with the casing as described with reference to the first embodiment. Also in the second embodiment, the package 100 includes at least one open device 160 as described in the first embodiment, and configured for cooperating with the casing and container as described in the first embodiment of the package 100.

1.3 Third Embodiment of the Package 100

In a third embodiment of the package 100, the same includes a casing 102 made of a sheet material, particularly of a paper sheet material, as hereinbefore described with reference to the second embodiment (the casing 102 with the occluding system 207).

In the third embodiment, the container 1 is different from the ones described with reference to the first and second embodiments of the package.

Particularly, in the third embodiment, the container 1 defines an inner volume 3 configured for housing at least one product. The container 1 includes a predetermined number of lateral walls 4 defining at least one passage opening 5 delimited by a free edge 6: the passage opening 5 is configured for enabling the inner volume 3 to communicate with the outer environment. The attached figures illustrate, in a non-limiting way, a configuration of the container 1 exhibiting two passage openings opposite to each other so that this latter can substantially define a conduit or tube laterally delimited by said walls 4 and open at the longitudinal ends. However, it is not excluded the possibility of making, for example, a container 1 exhibiting a single passage opening.

The attached figures illustrate a preferred but non-limiting configuration of the container 1 which exhibits a rectangular prismatic shape (the flat lateral walls 4 have a rectangular shape). Actually, the container 1 exhibits a front wall 4*a* and a rear wall 4*b* facing and parallel to each other: the front wall and rear wall are connected to each other by a first and second lateral walls 4*c*, 4*d* also facing and parallel to each other. The front wall 4*a* is distanced from the rear wall 4*b*; the first and second lateral walls 4*c*, 4*d* are also distanced from each other. The container 1 exhibits, along a cross-section transversal to the lateral walls, a parallelogram shape, particularly a square or rectangular shape. However, it is not excluded the possibility of making a container having a different shape, for example a square, trapezoidal shape. Advantageously, the container is at least partially countershaped to the container 102. However, it is not excluded the possibility of making a container 1 having a different shape, for example a square, trapezoidal or cylindrical shape. From the dimensional point of view, the container can define an inner volume 3 substantially larger than 20,000 $mm^3$, particularly included between 40,000 and 200,000 $mm^3$. However, the container 1, object of the present invention, can be used for packaging medium-sized products; in such condition, the container can exhibit an inner volume 3 larger than 500,000 $mm^3$, particularly included between 800,000 and 1,400,000 $mm^3$. However, it is not excluded the possibility of using the container 1, object of the present invention, for packaging large-sized products; in such condition, the container exhibits an inner volume 3 larger than the above given volumes, for example greater than 10,000 $cm^3$.

As it is visible in FIGS. 24 and 25, for example, the container 1 can include, at the free edge 6, a recess 27; as it is visible in the attached figure, the recess 27 contacts the free edge 6 for defining on this latter a type of depression. Advantageously, the recess 27 is defined on the lateral wall 4 (particularly on the front lateral wall 4*a*) adapted to directly abut against a closing system 7 of the container 1, which will be better described in the following. The recess 27 exhibits an open perimetral outline which exhibits a substantially "C" or "V" of "U" shape, the concavity thereof facing away from the inner volume.

As it is visible in the attached figures, the container 1 further includes at least one closing system 7, also made of sheet material, engaged at the free edge 6 and movable, particularly rotatively movably, with respect to the lateral walls 4. Particularly, the closing system 7 is configured for defining at least one closed condition in which the system 7 itself prevents the communication between the inner volume 3 and outer environment; the closing system 7 is further configured for defining at least one open condition in which the system 7 enables the communication between the inner volume 3 and outer environment. De facto, the system 7 is substantially a cover adapted to cooperate with the lateral walls for managing the access to the inner volume 3. Advantageously, the container 1 includes a closing system 7 for each passage opening 5.

The attached figures illustrate, in a non-limiting way, a configuration of the container 1 exhibiting two passage openings 5; in such condition, the container 1 exhibits two closing systems 7 engaged with the respective free edges 6: the systems 7 are disposed oppositely to each other with respect to the lateral walls 4. The closing system 7 is advantageously, but in a non-limiting way, joined in a single piece to the rear lateral wall 4*b*, particularly to the free edge 6, and is rotatably about this latter, between at least the closed and open conditions.

More particularly, the closing system 7 includes at least one tab 8 exhibiting a closing portion 9 directly engaged and joined in a single piece to the free edge 6 (particularly to the portion of the free edge of the rear lateral wall 4*b*): the closing portion 9 is the component of the tab 8 configured for preventing the passage through the opening 5 in the closed condition of the system 7 itself. As it is visible in the attached figures, the closing portion 9 substantially includes a flat body of sheet material countershaped to the free edge 6 of the opening 5. The attached figures schematically illustrate a preferred configuration of the closing portion 9 exhibiting a rectangular shape completely countershaped to the free edge 6. Moreover, the tab 8 exhibits at least one inserting portion 10 configured for being inserted, in the closed condition of the system 7, inside the volume 3. The inserting portion 10 is joined in a single piece to the closing portion 9: the inserting portion 10 is substantially an extension of the closing portion 9 adapted to be inserted, in the closed condition of the system 7, inside the inner volume 3 of the container 1. As it is visible in the attached figures, also the inserting portion 10 substantially includes a flat body of sheet material having, in a non-limiting way, a rectangular shape. As it is visible for example in the cross-section view of FIG. 26, the inserting portion 10 extends between a first and second prevalent development surfaces 10*a*, 10*b* respectively facing the outside (directly facing a lateral wall 4 of the container 1) and towards the inner volume 3. In the closed condition of the system 7, at least one portion of the first development surface 10*a* of the engagement portion 10 faces, particularly contacts, directly part of a lateral wall 4 (particularly the lateral wall 4*a*): the surface 10*a* extends at least partially parallel to the wall 4*a* opposite to the wall directly connected to the closing portion 9.

The closing portion 9 and inserting portion 10 exhibit a reciprocal connecting edge opposite to the free edge 6 with respect to the closing portion 9 itself: the inserting portion 10 is rotatably with respect to the closing portion 9 about said reciprocal connecting edge. The inserting portion 10, in the closed condition of the system 7, is configured for defining, along a cross-section transversal to and cooperatively with the closing portion 9, a substantially "L" shape: in such condition, the inserting portion 10 substantially extends parallel to a lateral wall 4*a*.

Figure 9:
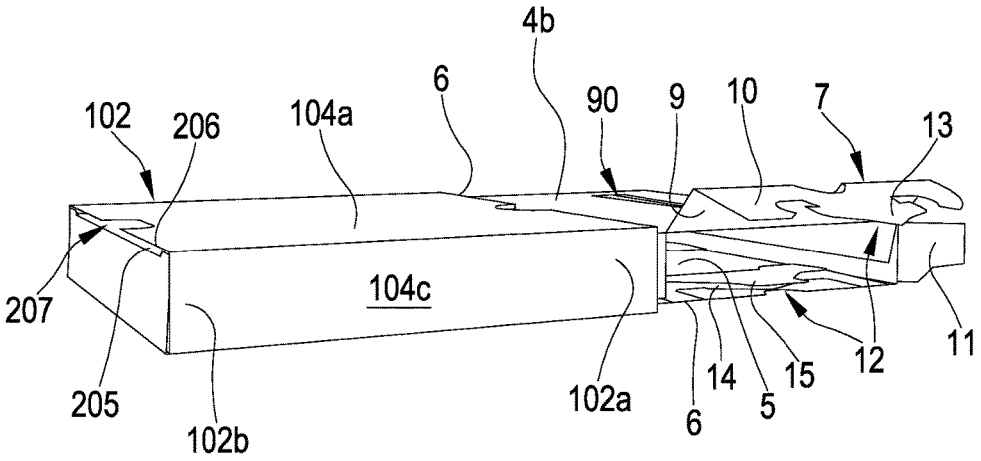

As it is visible in FIGS. 9, 24 and 25 for example, the closing system 7 further includes at least one abutment portion 11 engaged with the free edge 6 adjacent the tab 8: the abutment portion 11, in the closed condition, is configured for being interposed between the inner volume 3 and tab 8 in order to cooperate with this latter for stably holding it in said closed condition. The abutment portion 11 substantially includes a flat tab of sheet material joined in a single piece to the free edge 6 adjacent the closing portion 9. The abutment portion 11 exhibits, in a non-limiting way, a rectangular or trapezoidal shape. Also, the abutment portion 11 is configured for rotating about the free edge 6 for facing, at least in the closed condition of the container 1, the inner volume. More particularly, the abutment portion 11 is constrained to the free edge 6 in order to engage, in the closed condition of the container 1, at least part of the engagement portion 10 and/or of the closing portion 9 for stably holding the tab 8 in said condition. Advantageously, the container 1 includes two abutment portions 11 opposite to each other with respect to the tab 8: this latter is interposed between the two abutment portions 11. In such configuration (illustrated in FIG. 25 for example), the two portions 11 symmetrically operate on the tab 8 for stably holding it in the closed condition.

As hereinbefore described, the container includes a recess 27; the recess 27 is disposed on the lateral wall 4 (particularly on the front lateral wall 4*a*) configured for directly facing the engagement portion 10, particularly the first surface 10*a* of said portion 10. Therefore, the recess 27 is disposed in proximity of the first surface 10*a* and is configured for enabling to show this latter under determined operative conditions of the container 1 which will be better described in the following.

As it is visible in the attached figures, the closing system 7 can include, in a non-limiting way, a through opening 26 configured for being disposed, in the closed condition of the system itself, at the free edge 6, particularly at the recess 27. De facto, the through opening 26, in the closed condition of the closing system 7, is disposed at the recess 27 (FIG. 26): particularly, in such condition, the opening 26 and recess 27 facing and at least partially countershaped to each other.

As it is visible in the attached figures, the through opening 26 defines a closed perimetral outline, particularly exhibiting at least one selected in the group among the following shapes: rectangular, square, circular, elliptical, semicircular, triangular shape. The through opening 26 is defined on the closing portion 9 and/or on the engagement portion 10 of the tab 8. In a preferred but non-limiting embodiment of the invention, the through opening 26 is defined, without interruption, at least partially on the closing portion 9 and at least partially on the engagement portion 10 of the tab 8: the opening 26 is substantially defined on the folding line of the portions 9 and 10 of the tab 8 (FIG. 24).

As it is visible in FIGS. 9, 24 and 25 for example, the container 1 further includes at least one safety device 12 made of paper sheet material, which exhibits at least one first hooking portion 13 supported by the tab 8 and/or by the abutment portion 11, and at least one second hooking portion 14 engaged with the front wall 4*a*. The first and second hooking portions 13, 14 are configured for stably engaging each other during one first closed condition of the closing system 7, in other words during a first absolute closure of the system 7 wherein the engagement portion 10 is introduced for the first time into the inner volume 3. As it is visible in the attached figures, the second hooking portion 14 is disposed in the inner volume and substantially lies in a plane parallel to the front lateral wall 4*a*: in the closed condition of the system 7, the first hooking portion 13 is configured for being inserted at least partially into the inner volume 3 for stably engaging the second hooking portion 14. The first and/or second hooking portions 13, 14 include at least one removable portion 15 configured for being separated from the safety device 12 following a first open condition of the closing system 7, after said first closed condition, for evidencing a tampering of the container 1.

The attached figures illustrate, in a non-limiting way, a configuration of the container 1 in which the first hooking portion 13 is engaged with, particularly directly supported by, the tab 8 of the closing system 7. Advantageously, the first hooking portion 13 is only supported, although in a non-limiting way, by the engagement portion 10 of the tab 8: the two portions 10 and 13 are advantageously joined in a single piece in order to form a single body. De facto, the first hooking portion 13 includes a flat sheet body emerging, particularly without interruption, from the engagement portion 10 oppositely to the closing portion 9: therefore, the engagement portion 10 is interposed between the closing portion 9 and the first hooking portion 13. The first hooking portion 13, in the closed condition of the system 7 and when inserting the engagement portion 10 into the volume 3, is configured for being also inserted into the inner volume 3.

The body of sheet material of the first hooking portion 13 extends between a first and a second prevalent development surfaces 13*a*, 13*b* (FIG. 26) respectively facing the same direction of the first and second surfaces 10*a*, 10*b* of the engagement portion 10: the first surfaces 10*a*, 13*b* are reciprocally without interruption and directly face the front lateral wall 4*a* opposite to the rear lateral wall 4*b* directly connected (directly joined in a single piece) to the system 7. The second surfaces 10*b*, 13*b* are also reciprocally without interruption and face the inner volume 3. More particularly, the first hooking portion 13 includes at least one undercut portion 20 delimited by a gripping edge 21: the undercut portion 20, in the first closed condition of the container 1, is configured for engaging the second hooking portion 14 disposed in the inner volume. As it is visible in FIG. 27, for example, the undercut 20 includes at least one hook 22 defining a seat, the concavity thereof faces, at least during the first closed condition of the device 12, at least one of the lateral walls 4. The seat of the undercut portion 20 defines a substantially "C" shape: the respective gripping edge 21 delimits a portion of said seat which, in the first closed condition of the system 7, faces the free edge 6.

FIG. 24 represents a preferred but non-limiting configuration of the first hooking portion 13 which substantially includes two hooks 22 opposite to each other with respect to the first portion 13 itself. In such condition, the first portion 13 therefore includes two respective undercut portions 20 which, at least in the first closed condition of the container 1, are configured for both engaging the second hooking portion 14. The two undercut portions 20 include respective seats, the concavities thereof face away from each other; the concavity of the seat faces respective abutment portions 11. The presence of the two undercuts 20 substantially defines a double symmetric gripping portion on the second hooking portion 14 which makes more effective and stable the coupling between said first and second hooking portions 13, 14.

As hereinbefore described, the second hooking portion 14 of the device 12 is directly engaged into the inner volume 3. Particularly, the second hooking portion 14 is directly connected to at least one lateral wall 4 (particularly to the front lateral wall 4*a*) and develops parallel to this latter: the hooking portion 14 is configured for directly facing the engagement portion 10 at least during the closed condition of the system 7. De facto, the hooking portion 14 develops parallel to the lateral wall 4 opposite to the wall directly connected (joined in a single piece) to the closing system 7. As it is visible in FIG. 26 for example, the second hooking portion 14 is joined in a single piece to the front wall 4*a*.

The second portion 14 substantially defines a sheet engaged, particularly joined in a single piece to, inside one or more lateral walls 4. The sheet material body of the second hooking portion 14 extends between a first and second prevalent development surfaces 14*a*, 14*b* (FIG. 26) respectively facing the outside and inside of the volume 3: the first surface 14*a* of the portion 14, at least in the closed condition of the system 7, is parallel to and faces as the first surfaces 10*a*, 13*a* (the first surfaces 10*a*, 13*a*, 14*a* directly faces the lateral wall 4*a* opposite to the lateral wall 4*b* directly connected to the system 7).

In the configuration illustrated in the attached figures, the second hooking portion 14 includes, in a non-limiting way, the removable portion 15 of sheet material which extends between a first and a second surfaces 15*a*, 15*b* (FIG. 26) respectively facing the lateral wall 4*a* and lateral surface 4*b*: the surfaces 15*a*, 15*b* of the removable portion 15 are substantially extensions of the surfaces 14*a*, 14*b* of the second hooking portion 14. The removable portion 15 includes at least one undercut portion 16 which is configured for engaging, in the first closed condition of the safety device 12, the respective undercut portion 20 of the first hooking portion 13.

The undercut portion 16 of the removable portion 15 is delimited by a gripping edge 17 which, in the first closed condition of the container 1 itself, is distinct and distanced from the free edge 6: the undercut portion 16 is inside the volume and distanced from the passage opening so that the removable portion 15 can engage, in the first closed condition, the respective undercut 20 of the first hooking portion 13.

As it is visible in FIG. 24 for example, the undercut portion 16 of the removable portion 15 includes at least one hook 18 defining a seat exhibiting a substantially "C" shape: the gripping edge 17 delimits the portion of the seat facing away from the free edge 6. More particularly, it is observed that the gripping edge 17 of the removable portion 15, in the first closed condition of the container 1 itself, is interposed between the free edge 6 and the respective gripping edge 21 of the first hooking portion 13.

As hereinbefore described, the first and second hooking portions 13, 14 of the safety device 12 are configured for defining a first closed condition substantially defined by the first engagement/coupling of said portions. Before the first closed condition, the first hooking portion 13 is disposed outside the inner volume 3, while the second hooking portion 14 lies into the volume (this condition is illustrated in FIG. 24). Then, the closing system 7 is guided for the first time into the volume 3 as illustrated in FIGS. 25 and 26 for example: during such step, the system 12 is configured for defining the closed condition of the container 1 and at the same time the first and second hooking portions 13, 14 engage each other for the first time. De facto, during the first closed condition of the container 1, the hook 18 of the removable portion 15 engages the hook 22 of the first portion 13: the first closed condition is illustrated in FIG. 26. Still more particularly, during the first closed condition, the sheet material body of the first hooking portion 13 is configured for sliding, initially behind the removable portion (the removable portion 15 is interposed between the first hooking portion 13 and a lateral wall 4), then is configured for passing through the seat 19 and for being interposed between the lateral wall 4 and second hooking portion 14. In the closed condition, the hook 18 of the removable portion 15 abuts and is stably engaged with the hook 22 of the first portion 13: in such condition, the first portion 13 is completely inserted inside the seat 17 of the removable portion 15 and the respective undercuts 16 and 20 define a stable engagement condition between the portions 13 and 14.

It is useful to observe, for example from FIG. 25, that the recess 27 is advantageously disposed at the removable portion 15 of the safety device 12 and at the engagement portion 10 of the tab 8. The recess 27 is configured for enabling to show the removable portion 15, particularly of the first surface 15*a*, before the first open condition of the container 1 (during the first closed condition of the container 1); the recess 27 is further configured for enabling to show the engagement portion 10, particularly the first surface 10*a*, after the first open condition of the container 1, for evidencing a tampering of the container 1.

Figure 27:
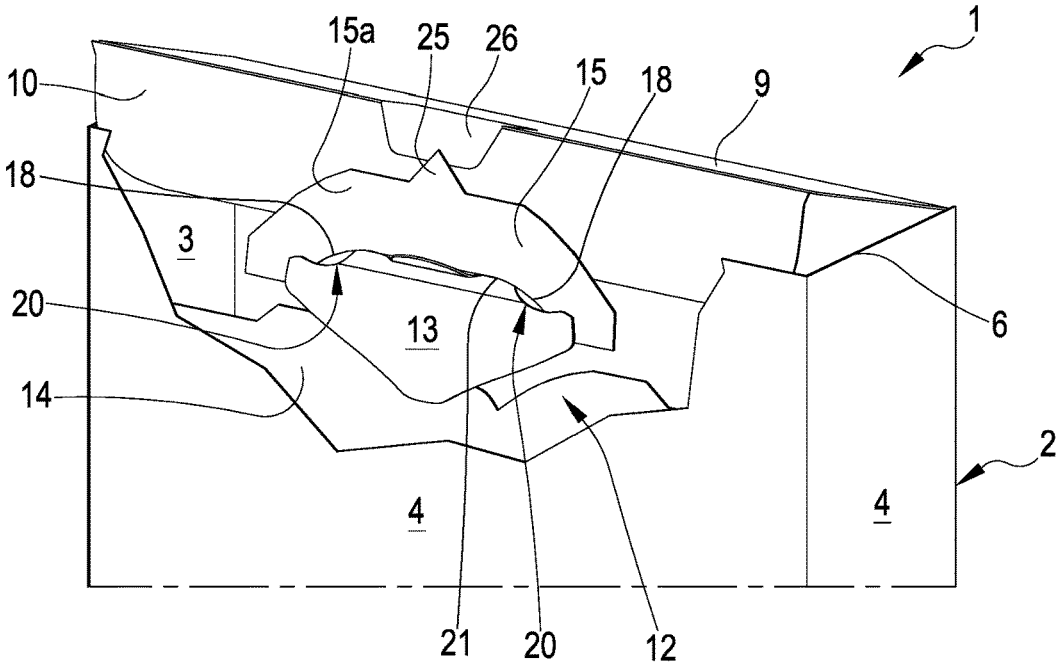

The stable engagement between the removable portion 15 and first hooking portion 13 opposes the opening of the container 1; the user when opens the container for the first time, notices a substantial resistance from the same which is a proof that this latter has never been opened. The safety device 12, during the first open condition, is configured for enabling to separate the first removable portion 15 from the second hooking portion 14. The first open condition is illustrated in FIG. 27 for example: during the first open condition of the system 7, the first hooking portion 13 grips the removable portion 15 (the grip is between the hooks 18 and 22) and tears it from the second portion 14.

Figure 28:
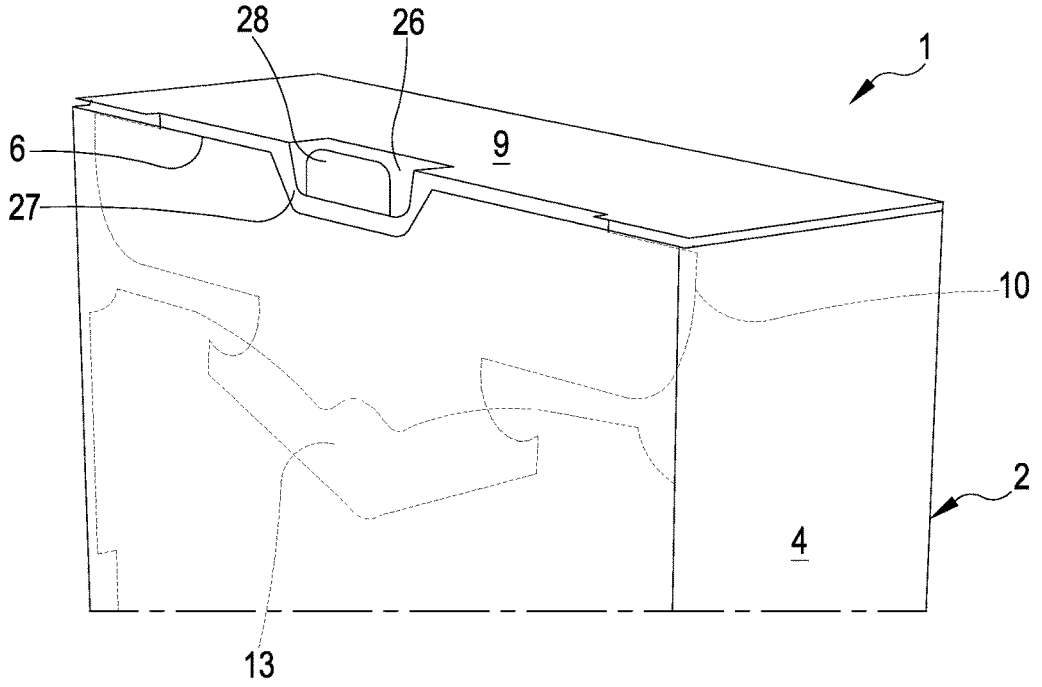

After the first open condition, the device 12 is capable of evidencing a tampering because the system 7 is easier to open: the user does not detect, during the opening, any resistance on the engagement portion 10 (see FIG. 28 which clearly shows the absence of the removable portion 15). Moreover, after the first open condition, the recess 27 enables to show the engagement portion 10 in place of the removable portion 15 (as an alternative enables to show the inner volume 3): in such condition, the user can easily detect the tampering of the container 1 without opening the same. Advantageously, it is possible to differentiate the surfaces 15*a* and 10*a* respectively of the removable portion 15 and engagement portion 10 in this way said surfaces can be better identified and the tampering is in this way emphasized. For example, it is possible to provide two different colors for the surfaces 15*a* and 10*a*: in this way, the user can detect a tampering of the container 1 only by recognizing the color of the engagement portion 10 rather than the one of the removable portion 15.

It is observed that the above described solution is a preferred even though non-limiting configuration of the container 1. De facto, the removable portion 15 could form, in an undifferentiated way, at least part of the first and/or of the second hooking portions 13, 14. For example, the removable portion 15 could define the respective undercut 20 and therefore the hook 22 of the first hooking portion 13: in this case, when opening for the first time the container, the removable portion 15 will be configured for being separated from the first portion 13. As hereinbefore described, it is not excluded the possibility of defining at least one removable portion 15 of the first hooking portion 13 and at least one removable portion of the second hooking portion 14.

As illustrated in FIGS. 24 to 27, the removable portion 15 can include at least one tactilely perceptible projection 25 emerging from the inner volume 3: the removable portion 15, with the projection 25, is configured for separating from the safety device 12 following a first open condition of the closing system 7 after the first closed condition, for evidencing a tampering of the container 1.

More particularly, the projection 25 of the removable portion 15, in the first closed condition of the closing system 7 and before the first open condition of the container 1, lies on a plane parallel to the engagement portion 10 and projects from the free edge 6, particularly transversally to the closing portion 9. Still more particularly, the projection 25, in the first closed condition of the closing system 7 and before the first closed condition of the container 1, is configured for being disposed at the recess 27 and for emerging besides this latter and/or besides the free edge 6. De facto, the projection 25, in the first closed condition of the closing system 7 and before the first open condition of the container 1, is configured for remaining substantially flush with the closing portion 9 of the tab 8 or is configured for emerging transversally from said closing portion 9; anyway, the projection 25, in both the configurations, is adapted to be tactilely perceptible so that the same can be distinguishable from the closing portion 9, free edge 6 and recess 27.

From the geometrical point of view, the projection 25 exhibits, according to a front view normal to the lying plane of the projection 25 itself, a shape selected in the group comprising: a triangular, square, rectangular, trapezoidal, semicircular, elliptical shape. In a preferred but non-limiting embodiment of the container 1, the projection 25 exhibits, according to a front view normal to the lying plane of the projection 25 itself, a tapered shape, particularly a triangular one, extending from the free edge 6: the tapered shape of the projection 25 is configured for making easier to tactilely perceive the same during the first closed condition of the closing system 7 and before the first open condition of the container 1. From the quantitative point of view, the projection 25 extends besides the free edge 6 by more than 1 mm, particularly from 1 to 10 mm, still more particularly from 1 to 7 mm. The tapered shape and height of the projection with respect to at least the free edge 6 of the container 1, enable to quickly and easily tactilely perceive the projection itself for example by sliding a finger on the closing portion 9 of the tab 8.

The projection 25 supported by the removable portion 15, in the first closed condition of the device 7 and before the first open condition of the container 1, is distanced from and is disposed opposite to the gripping edge 17 with respect to the removable portion 15; particularly, the projection 25 emerges oppositely to the gripping edge with respect to the removable portion 15 and as hereinbefore described, emerges from the free edge 6. De facto, the second portion 14, during the step of closing the device 7 for the first time and before the step of opening the container 1 for the first time, remains completely inside the volume 3 with the removable portion 15: only the projection 25 of the removable portion 15 emerges at least partially from the volume 3 and particularly besides the free edge 6.

When the removable portion 15 is between the lateral wall 4 of the container 1 and the engagement portion 10 of the tab 8, the projection 25, in the first closed condition of the device 7 and before the first open condition of the container 1, emerges from the free edge 6 between the tab 8 and the lateral wall 4 directly facing the engagement portion 10. On the contrary, when the removable portion 15 is behind the engagement portion 10, the projection 25 is configured for being disposed inside the through opening 26 of the tab 8; preferably, in such condition, the projection 25 crosses at least partially the passage opening 26 for emerging from the free edge 6 and possibly also from the closing portion 9 of the tab 8 (FIG. 26).

As hereinbefore described, the container 1 includes a recess 27—preferably supported by the lateral wall 4 parallel to the second hooking portion 14 of the safety device 12 and directly faces the engagement portion 10—adapted to substantially define a depression of the free edge 6; the recess 27 enables to help the projection 25 to emerge from the free edge 6 following the first closed condition and before the first open condition. De facto, the recess 27 is adapted to enable both to show and tactilely perceive the projection 25.

Following the first opening of the container 1, the removable portion 15 separates from the container (more generally from the container 1) and also the projection 25 does the same so that is no more tactilely perceptible. The absence of the projection 25 can immediately give a proof of a performed tampering of the container also without a visual indication.

FIGS. 26 and 28 illustrate a further embodiment of the safety device 12 which includes a control portion 28 of sheet material directly supported by the front lateral wall 4*a*; the control portion 28 is configured for being disposed, following the first closed condition of the system 7 and before the first open condition of the container 1, behind the engagement portion 10 so that the same is interposed between said control portion 28 and lateral wall 4*a* directly abutting against the engagement portion 10.

In such condition, the control portion 28 is completely contained in the inner volume 3 and is directly covered by the removable portion 15. Particularly, the control portion 28 is configured for being disposed immediately behind the projection 25 and immediately behind the portion of the projection emerging from the free edge 6. De facto, the top of the control portion 28 is configured for remaining inside the volume 3 at the free edge 6.

The control portion 28 is configured for being disposed, after the first open condition of the container 1, behind the engagement portion 10 so that the same is interposed between said control portion 28 and the lateral wall 4*a* abutting against the engagement portion 10; in such condition, the control portion 28 is completely contained in the inner volume 3 and faces the through opening 26 of the closing system 7.

In the embodiment illustrated in the attached figures, the control portion 28 is supported, in a non-limiting way, directly by the front lateral wall 4*a*, and includes a sheet lying parallel to the second hooking portion 14; particularly, the control portion 28 in a non-limiting way, is joined in a single piece and parallel to the second hooking portion 14 of the safety device 12.

As it is visible in FIGS. 1 to 9, for example, the container 1 includes at least one auxiliary through opening 93 defined on a lateral wall 4, particularly on the rear lateral wall 4*b*, which is delimited by an edge 94 defining the stop element 90 adapted to cooperate, as hereinbefore described with reference to the first embodiment, with the engagement portion 107 of the casing (see the schematic views in FIGS. 2, 4, 6 and 7).

The auxiliary through opening 93 is disposed on a lateral wall 4 opposite to the lateral wall 4 of the container 1 supporting the second hooking portion 14 of the safety device 12 (FIG. 9). Particularly, the second hooking portion 14 of the safety device 12 is directly supported by the front lateral wall 4*a* of the container, while the through auxiliary opening 93 is defined on the rear lateral wall 4*b* of the container 1 itself.

The through auxiliary opening 93 extends along a prevalent development direction substantially parallel to the longitudinal development direction of the container 1; the auxiliary through opening 93 exhibiting a length—measured normal to the longitudinal development direction of the container—equal to or greater than a width of the engagement portion 107 of the casing 102: said width being measured normal to the longitudinal development direction of the casing 102.

Figure 8:
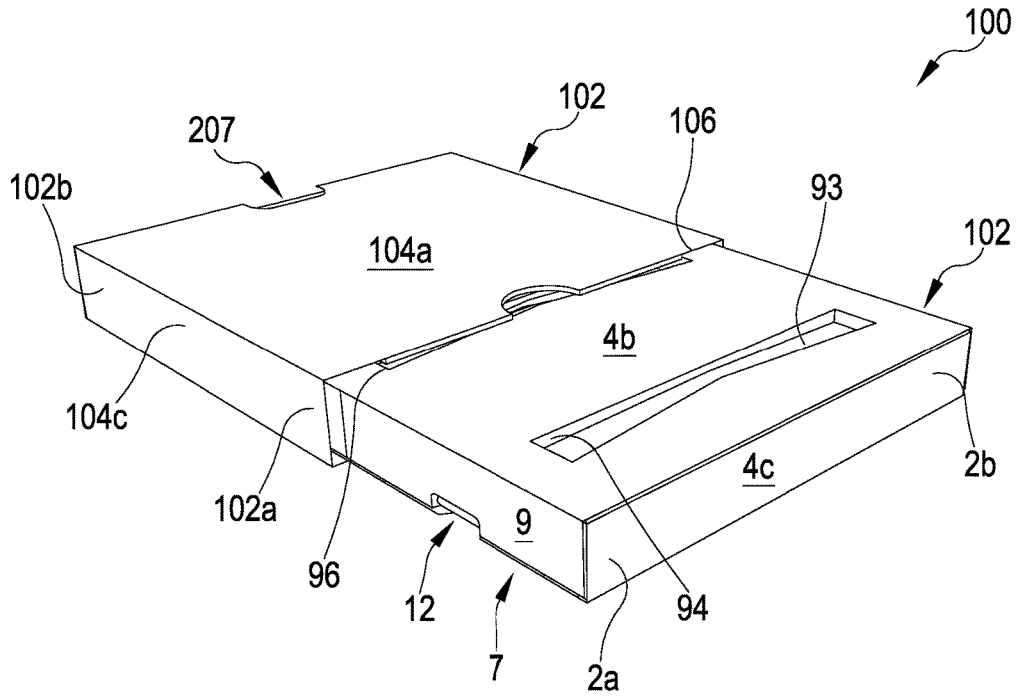
FIGS. 8 and 9 are schematic views of a package according to the present invention disposed in a second operative condition.

As illustrated in FIG. 8, for example, the container 1 can be housed into the inner volume 103 of the casing 102 so that the passage opening 5 of the container—at least in the first operative position—faces the first or second lateral wall 104*c*, 104*d* of the casing 102; if the container 1 exhibits two passage openings, one faces the lateral wall 104*c* and the other faces the lateral wall 104*d* of the casing 102.

Advantageously, the container 1 can include an auxiliary seat 96 defined on the lateral wall 4 itself (the rear lateral wall 4*b*) on which the abutment element 90 is defined; the auxiliary seat 96 being delimited by an edge 97 which defines an auxiliary stop element 95 also configured for cooperating with the engagement portion 107 of the casing 102. More particularly, the auxiliary stop portion 95—in the first operative portion of the package 100—is distanced from the opening 105 so that the stop element 90 is interposed between said passage opening 105 and the auxiliary stop portion 95 (see FIG. 4, for example).

The auxiliary stop portion 95 is configured for abutting against the engagement portion of the casing 102 for preventing the container 1 from being completely extracted from the casing 102. De facto, when somebody tries to further extract the container 1 from the casing 102—starting from the second operative position of the package—the engagement portion 107 is configured for being inserted in the seat 96 and for abutting against the edge 97 (FIG. 7) so that the container 1 is prevented from being completely extracted from the casing 102.

In the third embodiment, the package 100 includes an open device 160 as hereinbefore described with reference to the first embodiment of the package 100.

1.4 Fourth Embodiment of the Package 100

In a fourth embodiment of the package 100, the same can include a container 1 as described with reference to the first or second or third embodiment of the package 100 as hereinbefore described. Such container 1 is configured for cooperating with the casing as described with reference to the first embodiment and as illustrated in FIGS. 2, 4, 6 and 7.

In the fourth embodiment, the casing 102 differs from those described with reference to the first, second and third embodiments of the package. Particularly, in such fourth embodiment, the casing 102 includes a predetermined number of lateral walls 104 defining at least one passage opening 105 delimited by a free edge 106: the passage opening 105 is configured for putting in communication the inner volume 103 with the outer environment. The attached figures illustrate, in a non-limiting way, a configuration of the casing 102 exhibiting two passage openings opposite to each other so that this latter can substantially define a conduit or tube laterally delimited by said walls 104 and open at the longitudinal ends. Still more particularly, the casing 102 extends between a first and second longitudinal end portions 102*a*, 102*b* along a longitudinal development direction of the casing itself; the lateral walls 104 therefore define:

- a first passage opening 105 delimited by a free edge 106 and disposed at the first longitudinal end portion 102*a*,
- a second passage opening 205 delimited by a respective free edge 206 and located at the second longitudinal end portion 2*b*.

The attached figures illustrate a preferred but non-limiting configuration of the casing 102 which exhibits a rectangular prismatic shape (the flat lateral walls 104 having a rectangular shape). The casing 102 actually exhibits a front wall 104*a* and a rear wall 104*b* which face and are parallel to each other: the front wall and rear wall are connected to each other by a first and second lateral walls 104*c*, 104*d* also facing and parallel to each other. The front wall 104*a* is distanced from the rear wall 104*b*; the first and second lateral walls 104*c*, 104*d* are also distanced from each other. The casing 102 exhibits, according to a cross-section transversal to the lateral walls, a parallelogram shape, particularly a square or rectangular shape; the free edge 106 defines a parallelogram shape, particularly a square or rectangular shape. However, it is not excluded the possibility of making a casing 102 having a different shape, for example a square, trapezoidal shape.

In the embodiment of the package, the casing 102 includes an engagement portion 107 at each passage opening; the engagement portion 107 emerges, from at least one lateral wall 104*b*, inside the inner volume 103 for defining a projection (see FIG. 14, for example). In the embodiment illustrated in FIG. 29, the casing includes two engagement portions 107 respectively disposed at the first and second passage openings 105, 205.

The engagement portion 107 is directly constrained, particularly joined in a single piece, to the free edge 106, 206 of the respective passage opening: the engagement portion 107 emerges from the free edge according to a direction entering the inner volume 103. Still more particularly, the engagement portion 107 is constrained to the front lateral wall 104*a* of the casing 102.

Each engagement portion 107 includes at least one tab 107*a* of sheet material, particularly of paper sheet material, joined in a single piece to the front wall 104*a*. At least part of the tab 107*a* extends along a rectilinear development direction sloped with respect to an extension direction of the front wall 104*a* to which the tab 107*a* itself is joined in a single piece. The tab defines—with the front wall to which the tab itself is joined in a single piece—an angle equal to or greater than 1°, particularly included between 1° and 15°, still more particularly included between 1° and 5°; said angle being defined in the inner volume and being subtended between the tab 107*a* and the front and/or rear lateral walls to which the tab itself is joined in a single piece.

From the dimensional point of view, the casing 102 defines an inner volume 103 substantially greater than 20,000 $mm^3$, particularly included between 40,000 and 200,000 $mm^3$. However, the casing 102 object of the present invention, can be used for packaging medium-sized products; in such condition, the package can exhibit an inner volume greater than 500,000 $mm^3$, particularly included between 800,000 and 1,400,000 $mm^3$. However, it is not excluded the possibility of using the container 1 for packaging large-sized products; in such condition, the casing 102 can exhibit an inner volume 103 greater than the above given volumes, for example greater than 10,000 $cm^3$ and although in a non-limiting way.

The casing includes, at each free edge, a recess 327; as it is visible in the attached figures, the recess 327 contacts the free edge for defining, on this latter, a kind of depression. Advantageously, the recess 327 is defined on the front lateral wall 104*a* adapted to directly abut against a closing system 307 of the casing 102 which will be better described in the following. The recess 327 exhibits an open perimetral outline which exhibits a substantially "C" or "V" or "U" shape, the concavity thereof faces away from the inner volume 103.

Figure 29:
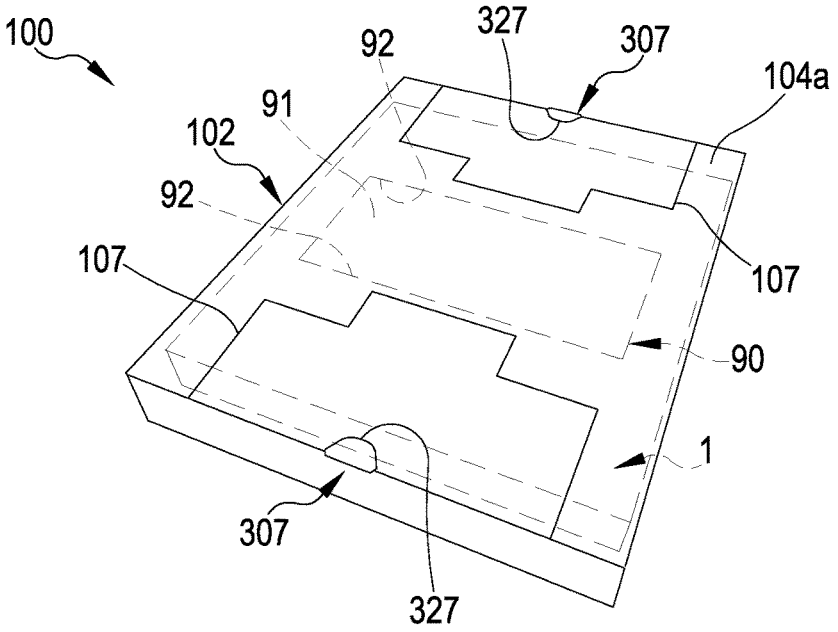
FIGS. 29 to 32 schematically illustrate a further embodiment of the package according to the present invention.

As it is visible in the attached figures, the casing 102 further includes at least one closing system 307, also made of sheet material, engaged at each free edge and movable, particularly rotatably, with respect to the lateral walls 104. Specifically, the closing system 307 is configured for defining at least one closed condition in which the system 307 itself prevents the communication between the inner volume 103 and outer environment; the closing system 307 is further configured for defining at least one open condition in which the system 307 itself enables the communication between the inner volume 103 and outer environment. De facto, the system 307 is substantially a cover adapted to cooperate with the lateral walls for managing the access to the inner volume 103*e* and therefore to the container 1 disposed inside the casing 102. Advantageously, the casing 102 includes a closing system 307 for each passage opening as illustrated in FIG. 29, for example.

The attached figures illustrate, in a non-limiting way, a configuration of the casing 102 exhibiting two passage openings; in such condition, the casing 102 exhibits two closing systems 307 engaged with the respective free edges: the systems 307 are disposed oppositely to each other with respect to the lateral walls 104. The closing system 307 is advantageously, although in a non-limiting way, joined in a single piece to the rear lateral wall 104*b*, and is rotatably about this latter, between at least the closed and open conditions.

More particularly, the closing system 307 includes at least one tab 308 which exhibits a closing portion 309 directly engaged and joined in a single piece to the free edge (particularly to the portion of the free edge of the rear lateral wall 104*b*): the closing portion 309 is the component of the tab 308 configured for preventing the passage through the opening in the closed condition of the system 307 itself. As it is visible in the attached figures, the closing portion 309 substantially includes a flat body of sheet material countershaped to the free edge of the opening. The attached figures schematically illustrate a preferred configuration of the closing portion 309 exhibiting a rectangular shape completely countershaped to the free edge. Moreover, the tab 308 exhibits at least one inserting portion 310 configured for being inserted, in the closed condition of the system 307, inside the volume 103. The inserting portion 310 is joined in a single piece to the closing portion 309: the inserting portion 310 is substantially an extension of the closing portion 309 adapted to be inserted, in the closed condition of the system 307, into the inner volume 103. As it is visible in the attached figures, also the inserting portion 310 substantially includes a flat body of sheet material having, in a non-limiting way, a rectangular shape. As it is visible for example in the cross-section view of FIG. 35, the inserting portion 310 extends between a first and second prevalent development surfaces 310*a*, 310*b* respectively facing the outside (directly facing the front lateral wall 104*a*) and facing the inner volume 103. In the closed condition of the system 307, at least one portion of the first development surface 310*a* of the inserting portion 310 faces, particularly directly contacts, part of a lateral wall 104 (particularly the lateral wall 104*a*): the surface 310*a* extends at least partially parallel to the wall 104*a* oppositely to the wall directly connected to the closing portion 309.

The closing portion 309 and inserting portion 310 exhibit a reciprocal connecting edge opposite to the free edge with respect to the closing portion 309 itself: the inserting portion 310 is rotatably with respect to the closing portion 309 about said reciprocal connecting edge. The inserting portion 310, in the closed condition of the system 307, is configured for defining, according to a cross-section and cooperatively with the closing portion 309, a substantially "L" shape: in such condition, the inserting portion 310 substantially extends parallel to a lateral wall 104*a*.

Figure 33:
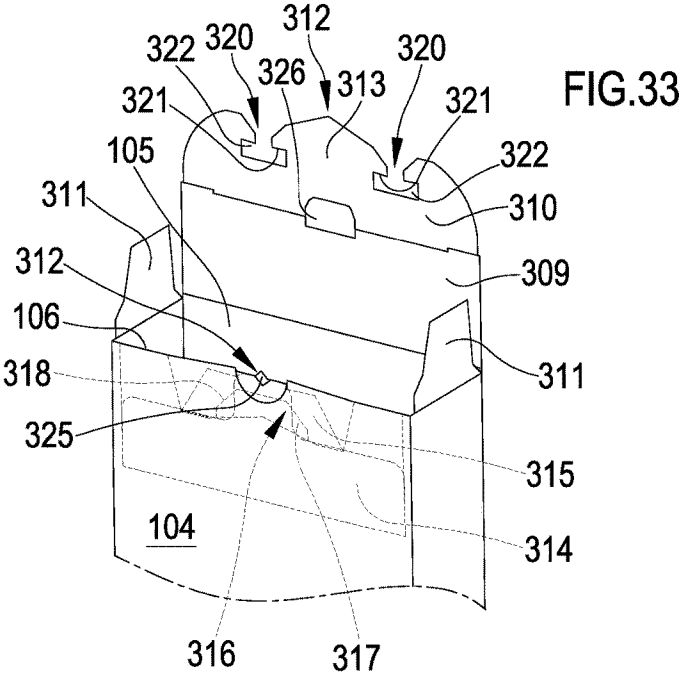

As it is visible in FIG. 33 for example, the closing system 307 further includes at least one abutment portion 311 engaged with the free edge adjacent the tab 308: the abutment portion 311, in the closed condition, is configured for being interposed between the inner volume 103 and tab 308 so that it cooperates with this latter for stably holding it in said closed condition. The abutment portion 311 substantially includes a flat tab of sheet material joined in a single piece to the free edge adjacent the closing portion 309. The abutment portion 311 exhibits, in a non-limiting way, a rectangular or trapezoidal shape. Also, the abutment portion 311 is configured for rotating about the free edge for facing, at least in the closed condition of the casing 102, the inner volume 103. More particularly, the abutment portion 311 is constrained to the free edge in order to engage, in the closed condition of the casing 102, at least part of the inserting portion 310 and/or of the closing portion 309 for stably holding the tab 308 in said condition. Advantageously, the casing 102 includes two abutment portions 311 opposite to each other with respect to the tab 308: this latter is interposed between the two abutment portions 311. In such configuration, the two portions 311 symmetrically operate on the tab 8 for stably holding it in the closed condition.

As hereinbefore described, the container includes a recess 327; the recess 327 is disposed on the lateral wall 104 (particularly on the front lateral wall 104*a*) configured for directly facing the inserting portion 310, particularly the first surface 310*a* of said portion 310. Therefore, the recess 327 is disposed in proximity of the first surface 310*a* and is configured for enabling to show this latter under determined operative conditions of the casing 102 which will be better described in the following.

As it is visible in the attached figures, the closing system 307 can include, in a non-limiting way, a through opening 326 configured for being disposed, in the closed condition of the system itself, at the free edge, particularly at the recess 327. De facto, the through opening 326, in the closed condition of the closing system 37, is disposed at the recess 327 (FIG. 35): particularly, in such condition, the opening 326 and recess 327 face and at least are partially countershaped to each other.

As it is visible in the attached figures, the through opening 326 defines a closed perimetral outline, particularly exhibiting at least one selected in the group among the following shapes: rectangular, square, circular, elliptical, semicircular, triangular shape. The through opening 326 is defined on the closing portion 309 and/or on the inserting portion 310 of the tab 308. In a preferred but non-limiting embodiment of the invention, the through opening 326 is defined, without interruption, at least partially on the closing portion 309 and at least partially on the inserting portion 310 of the tab 308: the opening 326 is substantially defined on the folding line of the portions 309 and 310 of the tab 308 (FIG. 33).

Figure 34:
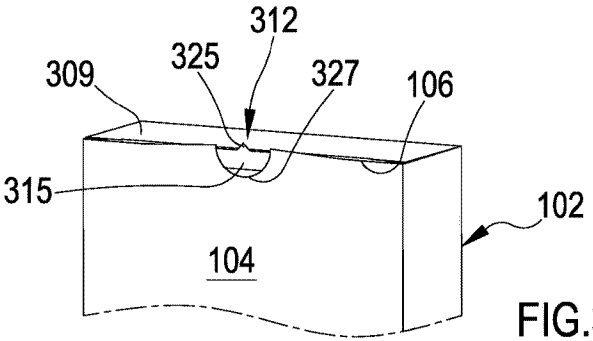
Figure 36:
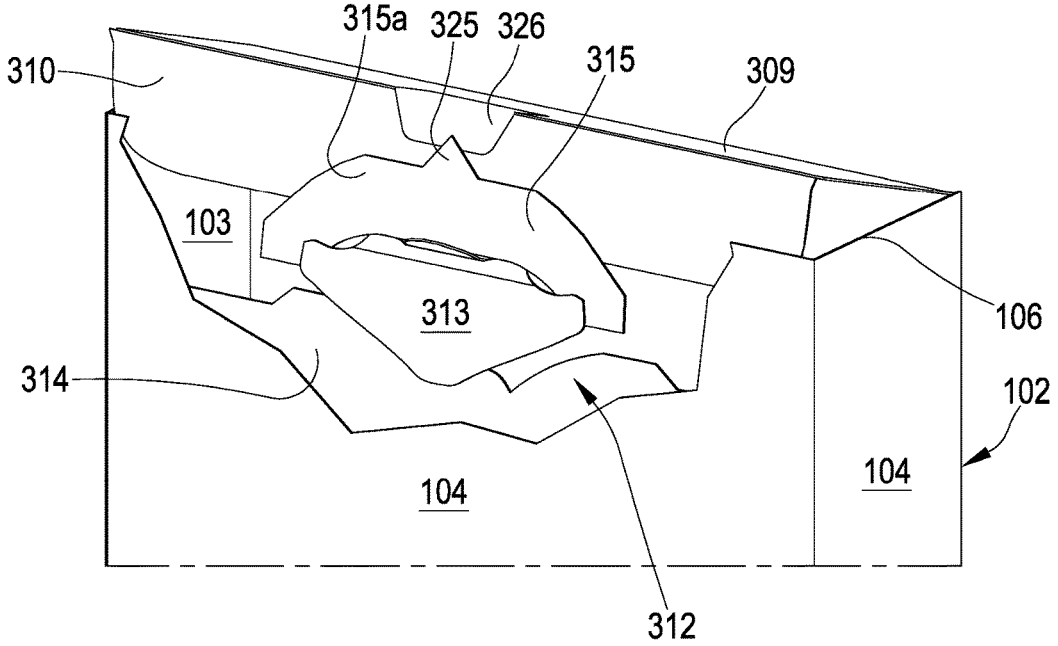

As it is visible in FIGS. 33, 34 and 36 for example, the casing 102 further includes at least one safety device 312, made of paper sheet material, which exhibits at least one first hooking portion 313 supported by the tab 308 and/or by the abutment portion 311, and at least one second hooking portion 314 engaged with the front wall 104*a*. The first and second hooking portions 313, 314 are configured for stably engaging with each other during one first closed condition of the closing system 307, in other words during a first absolute closure of the system 307 in which the inserting portion 310 is introduced for the first time into the inner volume 103. As it is visible in the attached figures, the second hooking portion 314 is disposed in the inner volume 103 and substantially lies in a plane parallel to the front lateral wall 104*a*: in the closed condition of the system 307, the first hooking portion 313 is configured for being inserted at least partially into the inner volume 103 for stably engaging the second hooking portion 314. The first and/or second hooking portions 313, 314 include at least one removable portion 315 configured for being separated from the safety device 312 following a first open condition of the closing system 307, after said first closed condition, for evidencing a tampering of the casing 102.

The attached figures illustrate, in a non-limiting way, a configuration of the casing 102 wherein the first hooking portion 313 is engaged with, particularly directly supported by, the tab 308 of the closing system 307. Advantageously, the first hooking portion 313 is only supported, although in a non-limiting way, by the inserting portion 310 of the tab 308: the two portions 310 and 313 are advantageously joined in a single piece in order to form a single body. De facto, the first hooking portion 313 includes a flat sheet body emerging, particularly without interruption, from the engagement portion 130 oppositely to the closing portion 309: therefore, the inserting portion 310 is interposed between the closing portion 309 and the first hooking portion 313. The first hooking portion 313, in the closed condition of the system 307 and therefore when inserting the inserting portion 310 into the volume 103, is configured for being also inserted into the inner volume 103.

The sheet material body of the first hooking portion 313 extends between a first and a second prevalent development surfaces 313*a*, 313*b* (FIG. 35) respectively facing the same direction of the first and second surfaces 310*a*, 310*b* of the inserting portion 310: the first surfaces 310*a*, 313*a* are reciprocally without interruption and directly face the front lateral wall 104*a* opposite to the rear lateral wall 104*b* directly connected (directly joined in a single piece) to the system 307. The second surfaces 310*b*, 313*b* are reciprocally also without interruption and face the inner volume 103.

More particularly, the first hooking portion 313 includes at least one undercut portion 320 delimited by a gripping edge 321: the undercut portion 320, in the first closed condition of the casing 102, is configured for engaging the second hooking portion 314 disposed in the inner volume 103. As it is visible in FIG. 33, for example, the undercut 320 includes at least one hook 322 defining a seat, the concavity thereof faces, at least during the first closed condition of the device 312, at least one of the lateral walls 104. The seat of the undercut portion 320 defines a substantially "C" shape: the respective gripping edge 321 delimits a portion of said seat which, in the first closed condition of the system 307, faces the free edge.

FIG. 33 represents a preferred but non-limiting configuration of the first hooking portion 313 which substantially includes two hooks 322 opposite to each other with respect to the first portion 313 itself. In such condition, the first portion 313 therefore includes two respective undercut portions 320 which, at least in the first closed condition of the casing 102, are configured for both engaging the second hooking portion 314. The two undercut portions 320 include respective seats, the concavities thereof face away from each other; the concavity of the seats faces respective abutment portions 311. The presence of the two undercuts 320 substantially defines a double symmetric grip on the second hooking portion 314 which makes more effective and stable the coupling between said first and second hooking portions 313, 314.

As hereinbefore described, the second hooking portion 314 of the device 212 is directly engaged into the inner volume 103. Particularly, the second hooking portion 414 is directly connected to at least one lateral wall 104 (particularly to the front lateral wall 104*a*) and develops parallel to this latter: the hooking portion 314 is configured for directly facing the inserting portion 310 at least during the closed condition of the system 307. De facto, the hooking portion 314 develops parallel to the lateral wall 104 opposite to the wall directly connected (joined in a single piece) to the closing system 307. As it is visible in FIG. 34 for example, the second hooking portion 314 is joined in a single piece to the front wall 104*a*.

The second portion 314 substantially defines a sheet engaged, particularly joined in a single piece, inside one or more lateral walls 104. The sheet material body of the second hooking portion 314 extends between a first and second prevalent development surfaces 314*a*, 314*b* (FIG. 35) respectively facing the outside and the inside of the volume 103: the first surface 314*a* of the portion 314, at least in the closed condition of the system 307, is parallel to and faces as the first surfaces 310*a*, 313*a* (the first surfaces 310*a*, 313*a*, 314*a* directly facing the lateral wall 104*a* opposite to the lateral wall 104*b* directly connected to the system 307).

In the configuration illustrated in the attached figures, the second hooking portion 314 includes, in a non-limiting way, the removable portion 315 of sheet material which extends between a first and a second surfaces 315*a*, 315*b* (FIG. 35) respectively facing the lateral wall 104*a* and lateral surface 104*b*: the surfaces 315*a*, 315*b* of the removable portion 315 are substantially extensions of the surfaces 314*a*, 314*b* of the second hooking portion 314. The removable portion 315 includes at least one undercut portion 316 which is configured for engaging, in the first closed condition of the safety device 312, the respective undercut portion 320 of the first hooking portion 313.

The undercut portion 316 of the removable portion 315 is delimited by a gripping edge 317 which, in the first closed condition of the casing 102 itself, is distinct and distanced from the free edge: the undercut portion 316 is inside the volume and distanced from the passage opening so that the removable portion 315 can engage, in the first closed condition, the respective undercut 320 of the first hooking portion 313.

As it is visible in FIG. 33 for example, the undercut portion 316 of the removable portion 315 includes at least one hook 318 defining a seat exhibiting a substantially "C" shape: the gripping edge 317 delimits the portion of the seat facing away from the free edge. More particularly, it is possible to note that the gripping edge 317 of the removable portion 315, in the first closed condition of the casing 102 itself, is interposed between the free edge and the respective gripping edge 321 of the first hooking portion 313.

Figure 35:
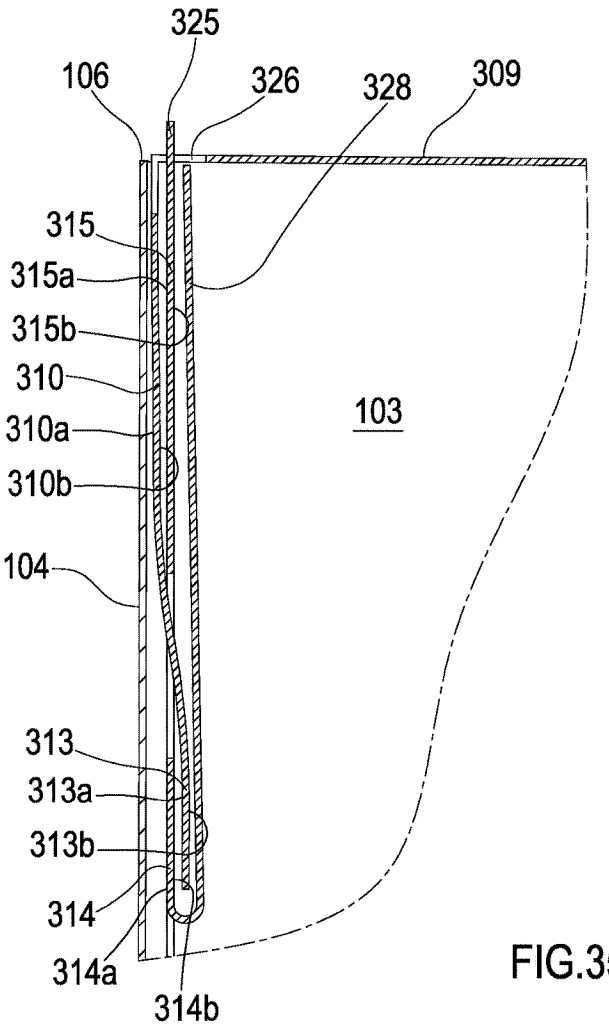
FIGS. 33 to 37 are schematic details of the casing of the package according to FIGS. 29 to 32.

As hereinbefore described, the first and second hooking portions 313, 314 of the safety device 312 are configured for defining a first closed condition substantially defined by the first engagement/coupling of said portions. Before the first closed condition, the first hooking portion 313 is disposed outside the inner volume 103, while the second hooking portion 314 lies into the volume (this condition is illustrated in FIG. 33). Then, the closing system 307 is guided for the first time into the volume 103 as illustrated in FIGS. 34 and 35 for example: during such step, the system 312 is configured for defining the closed condition of the casing 102 and for the first time there is the engagement between the first and second hooking portions 313, 314. De facto, during the first closed condition of the casing 102, the hook 318 of the removable portion 315 engages the hook 322 of the first portion 313: the first closed condition is illustrated in FIG. 35. Still more particularly, during the first closed condition, the sheet material body of the first hooking portion 313 is configured for sliding, initially behind the removable portion (the removable portion 315 is interposed between the first hooking portion 313 and a lateral wall 104), then crosses the seat 319 and is interposed between the lateral wall 104 and second hooking portion 314. In the closed condition, the hook 318 of the removable portion 315 abuts and is stably engaged with the hook 322 of the first portion 313: in such condition, the first portion 313 is completely inserted inside the seat 317 of the removable portion 315 and the respective undercuts 316 and 320 define a stable engagement condition between the portions 313 and 314. It is useful to note, for example from FIG. 34, that the recess 327 is advantageously disposed at the removable portion 315 of the safety device 312 and at the inserting portion 310 of the tab 308. The recess 327 is configured for enabling to show the removable portion 315, particularly of the first surface 315*a*, before the first open condition of the casing 102 (during the first closed condition of the container 1); the recess 327 is further configured for enabling to show the inserting portion 310, particularly the first surface 310*a*, after the first open condition of the casing 102, for evidencing a tampering of the casing 102.

The stable engagement between the removable portion 315 and first hooking portion 313 opposes the opening of the casing 102; the user when opens the container for the first time, detects a substantial resistance when opening the same which is a proof that this latter was not already opened. The safety device 312, during the first open condition, is configured for enabling to separate the removable portion 315 from the second hooking portion 314. The first open condition is illustrated in FIG. 36 for example: during the first opening of the system 307, the first hooking portion 313 grips the removable portion 315 (the grip is between the hooks 318 and 322) and tears it from the second portion 314.

Figure 37:
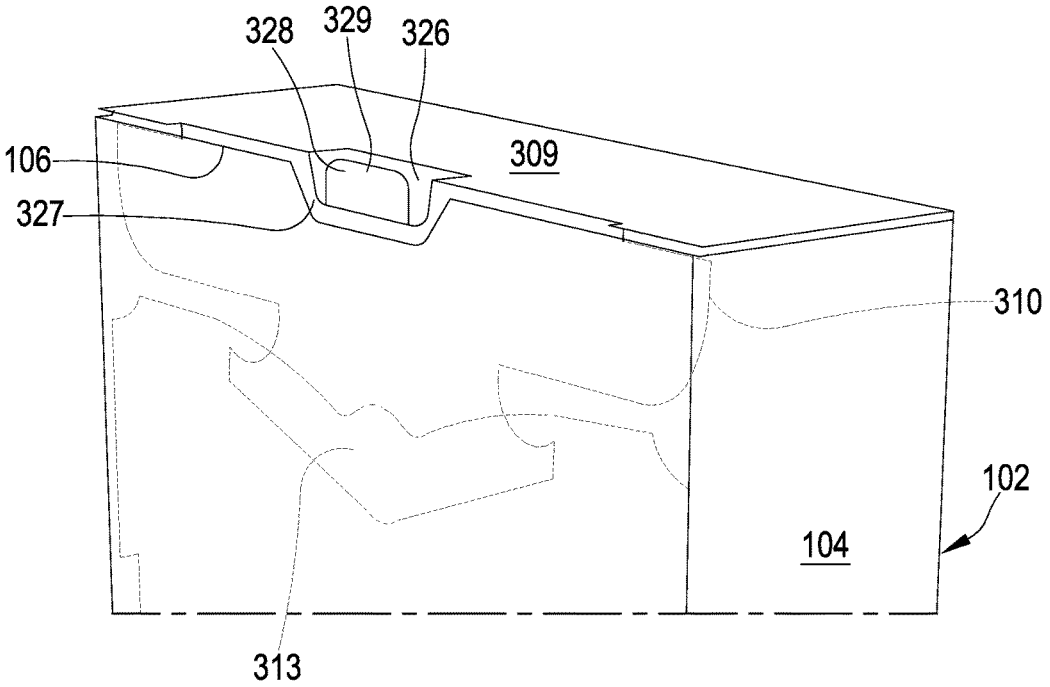

Following the first open condition, the device 312 is capable of evidencing a tampering because the system opening 307 is easy to open: the user does not perceive, when opening, a resistance on the inserting portion 310 (see FIG. 37 wherein it is evident the absence of the removable portion 315). Moreover, after the first open condition, the recess 327 enables to show the inserting portion 310 instead of the removable portion 315 (as an alternative enables to show the inner volume 103): in such condition, the user can be easily aware of e tampering of the casing 102 without opening the same. Advantageously, it is possible to make different the surfaces 315*a* and 310*a* respectively of the removable portion 315 and inserting portion 310 in order to make easier to recognize said surfaces, emphasizing in this way the tampering. For example, it is possible to provide two different colors of the surfaces 315*a* and 310*a*: in this way, the user can be aware of the tampering of the casing 102 only by recognizing the color of the inserting portion 310 rather than the one of the removable portion 315.

It is useful to note that the above described solution is a preferred although in a non-limiting configuration of the casing 102. De facto, the removable portion 315 can form part of either the first and/or the second hooking portions 313, 314. For example, the removable portion 315 can define the respective undercut 320 and therefore the hook 322 of the first hooking portion 313: in this way, when opening for the first time the container, the removable portion 315 would be configured for separating from the first portion 313. As hereinbefore described, it is not excluded the possibility of defining at least one removable portion 315 of the first hooking portion 313 and at least one removable portion of the second hooking portion 314.

As illustrated in FIGS. 33 to 36, the removable portion 315 can include at least one tactilely perceptible projection 325 emerging from the inner volume 103: the removable portion 315, together with the projection 325, is configured for separating from the safety device 312 following a first open condition of the closing system 307 after the first closed condition, for evidencing a tampering of the casing 102.

More particularly, the projection 325 of the removable portion 315, in the first closed condition of the closing system 307 and before the first open condition of the casing 102, lies on a plane parallel to the inserting portion 310 and projects from the free edge, particularly transversally to the closing portion 309. Still more particularly, the projection 325, in the first closed condition of the closing system 307 and before the first open condition of the casing 102, is configured for being disposed at the recess 327 and for emerging besides this latter and/or besides the free edge. De facto, the projection 325, in the first closed condition of the closing system 307 and before the first open condition of the casing 102, is configured for remaining substantially flush with the closing portion 309 of the tab 308 or is configured for emerging transversally from said closing portion 309; anyway, the projection 325, in both the configurations, is adapted to be tactilely perceivable so that the same can be distinguishable from the closing portion 309, of the free edge and from the recess 327.

From the geometrical point of view, the projection 325 exhibits, according to a front view normal to the lying plane of the projection 325 itself, a shape selected in the group included among: triangular, square, rectangular, trapezoidal, semicircular, elliptical shape. In a preferred but non-limiting embodiment of the casing 102, the projection 325 exhibits, according to a front view normal to the lying plane of the projection 325 itself, a tapered shape, particularly a triangular one, extending from the free edge: the tapered shape of the projection 325 is configured for making easier to tactilely perceive the same during the first closed condition of the closing system 307 and before the first open condition of the casing 102. From the quantitative point of view, the projection 325 extends besides the free edge by an amount greater than 1 mm, particularly from 1 to 10 mm, still more particularly from 1 to 7 mm. The tapered shaped and height of the projection with respect to at least the free edge, enable to easily and quickly tactilely perceive the projection itself for example by sliding a finger on the closing portion 309 of the tab 308.

The projection 325 supported by the removable portion 315, in the first closed condition of the device 307 and before the first open condition of the casing 102, is distanced from and is disposed oppositely to the gripping edge 317 with respect to the removable portion 315; particularly, the projection 325 emerges oppositely to the gripping edge with respect to the removable portion 315 and, as hereinbefore described, emerges from the free edge. De facto, the second portion 314, in the first closing step of the device 307 and before the first opening step the casing 102, remains completely inside the volume 103 with the removable portion 315: only the projection 325 of the removable portion 315 emerges at least partially from the volume 103 and particularly besides the free edge.

When the removable portion 315 is between the lateral wall 104 and the inserting portion 310 of the tab 308, the projection 325, in the first closed condition of the device 307 and before the first open condition of the casing 102, emerges from the free edge between the tab 308 and the lateral wall 104 directly facing the inserting portion 310. On the contrary, when the removable portion 315 should be located behind the engagement portion 130, the projection 325 is configured for being disposed inside the through opening 326 of the tab 308; preferably, in such condition, the projection 325 crosses at least partially the passage opening 326 for emerging from the free edge and possibly also from the closing portion 309 of the tab 308 (FIG. 35).

As hereinbefore described, the casing 102 includes a recess 327—preferably supported by the lateral wall 104 parallel to the second hooking portion 314 of the safety device 312 and directly facing the inserting portion 310—adapted to substantially define a depression of the free edge; the recess 327 enables the projection 325 to easily emerge from the free edge following the first closed condition and before the first open condition. De facto, the recess 327 is adapted to enable both to show and tactilely perceive the projection 325.

Following the first opening condition of the casing 102, the removable portion 315 separates from the casing 102 and also the projection 325 which is no more tactilely perceivable. The absence of the projection 325 can immediately give a proof that the casing 102 was tampered also without a visual indication.

FIGS. 35 and 37 illustrate a further embodiment of the safety device 312 which includes a control portion 328 of sheet material directly supported by the front lateral wall 104*a*; the control portion 328 is configured for being disposed, following the first closed condition of the system 307 and before the first open condition of the casing 102, behind the inserting portion 310 so that the same is interposed between said control portion 328 and lateral wall 104*a* directly abutting against the inserting portion 310.

In such condition, the control portion 328 is completely contained in the inner volume 103 and is directly covered by the removable portion 315. Particularly, the control portion 328 is configured for being disposed immediately behind the projection 325 and immediately behind the portion of the projection emerging from the free edge. De facto, the top of the control portion 328 is configured for remaining inside the volume 103 at the free edge.

The control portion 328 is configured for being disposed, after the first open condition of the casing 102, behind the inserting portion 310 so that the same is interposed between said control portion 328 and the lateral wall 104*a* abutting against the inserting portion 310; in such condition, the control portion 328 is completely contained into the inner volume 103 and faces the through opening 326 of the closing system 307.

In the embodiment illustrated in the attached figures, the control portion 328 is supported, in a non-limiting way, directly by the front lateral wall 104*a*, and includes a sheet lying parallel to the second hooking portion 314; particularly, the control portion 328, in a non-limiting way, is joined in a single piece and parallel to the second hooking portion 314 of the safety device 312.

In the fourth embodiment, the package 100 includes an open device 160 as described with reference to the first embodiment of the package.

2. Process of Making the Package 100

Moreover, it is an object of the present invention a process of making the package 100 according to the above given description and according to anyone of the attached claims.

The process includes a step of providing the casing 102 which is obtained by folding a first flat semifinished product 500 of sheet material, particularly of paper sheet material.

Figure 10:
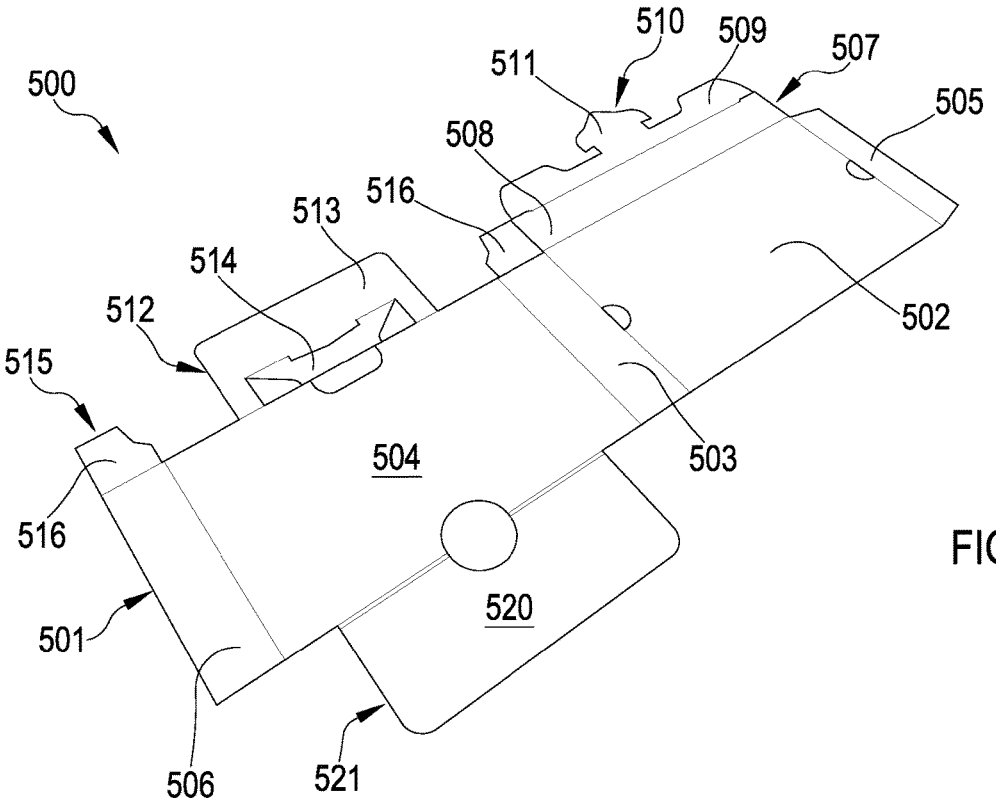
FIG. 10 illustrates a first semifinished product for making a casing of the package according to the present invention.
Figure 38:
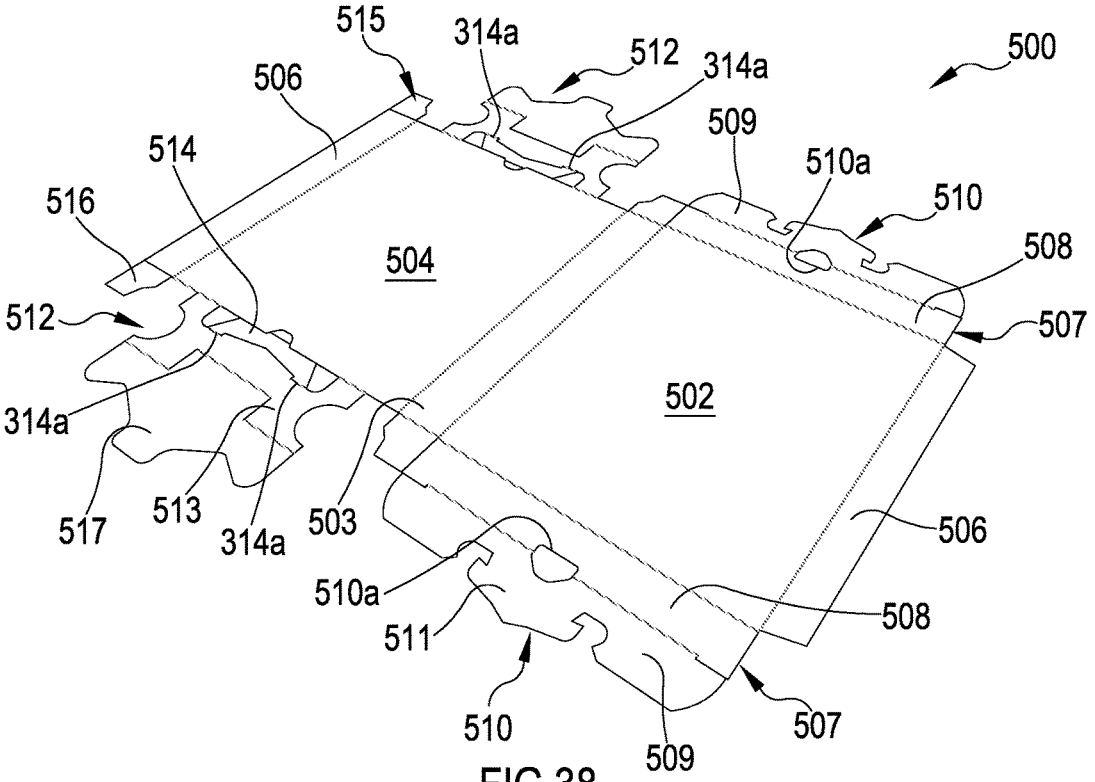
FIG. 38 is a perspective view of an embodiment variant of the first semifinished product for making the casing of the package according to FIGS. 29 to 32.
Figure 39:
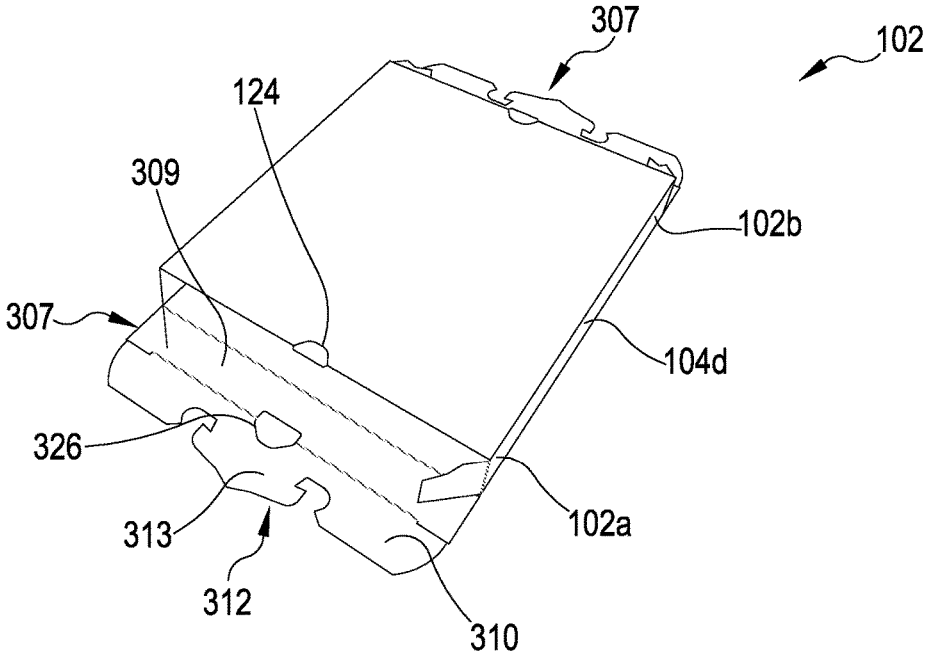
FIG. 39 is a perspective view of the casing of the package according to FIGS. 29 to 32.
Figure 40:
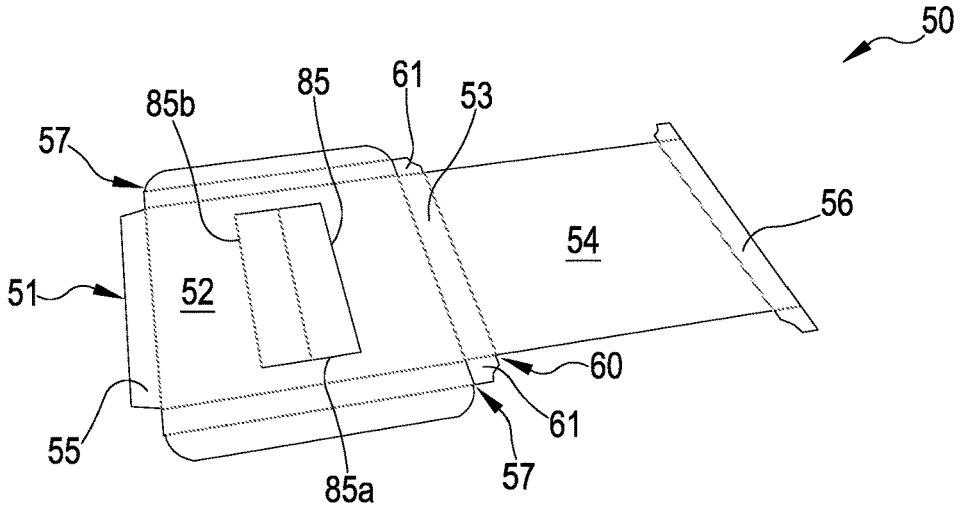
FIG. 40 is a perspective view of an embodiment variant of a first semifinished product for making a casing of the package according to the present invention.
Figure 41:
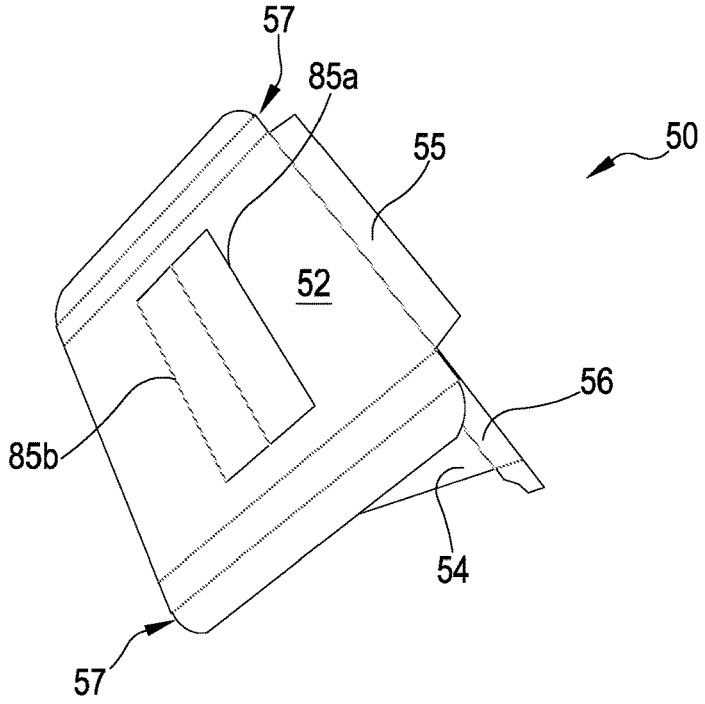
FIGS. 41 to 43 schematically illustrate the step of making the container in FIG. 40.
Figure 42:
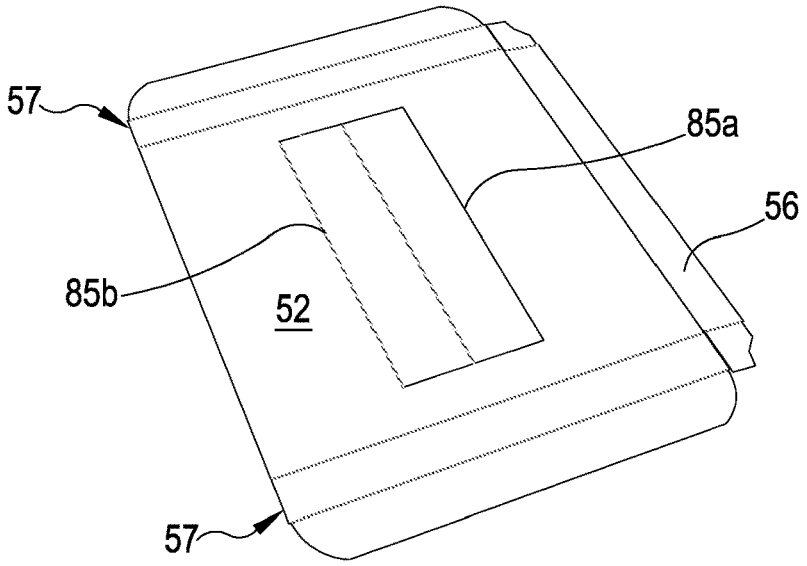
Figure 43:
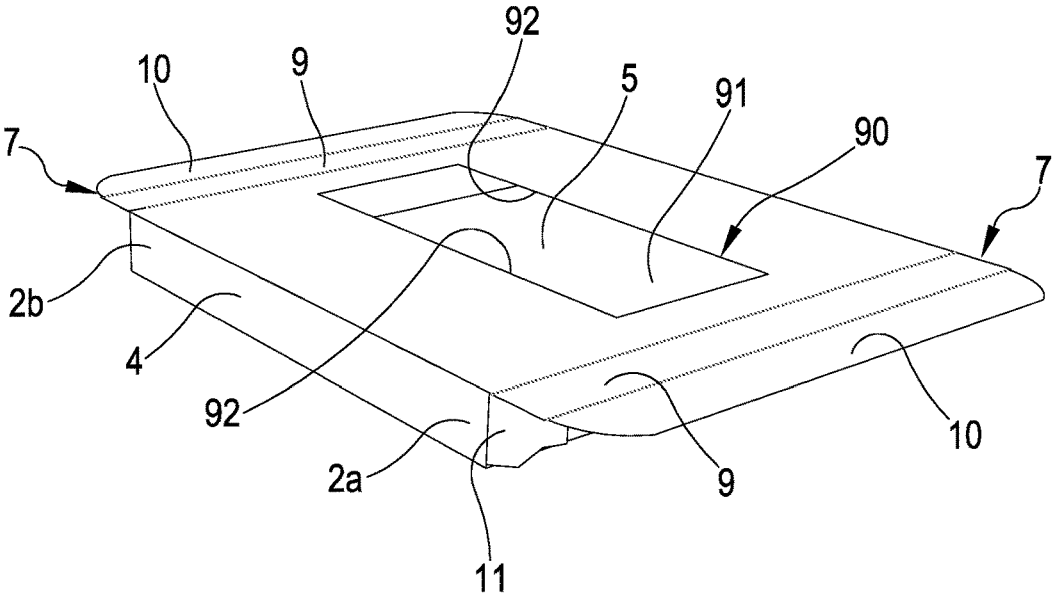
Figure 50:
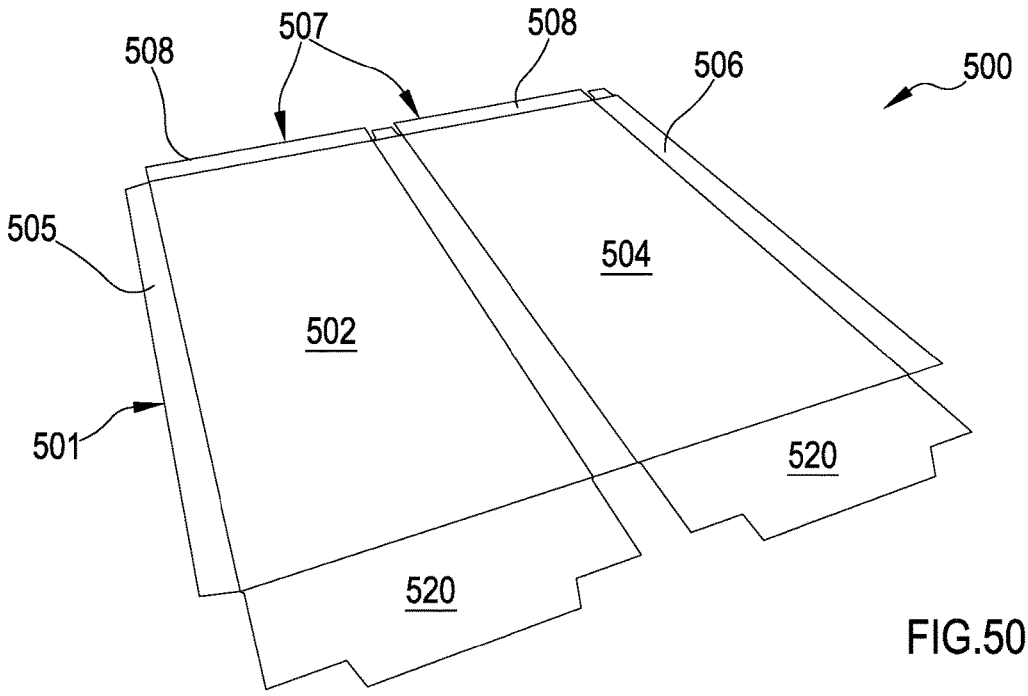
FIG. 50 is a perspective view of an embodiment variant of a first semifinished product for making the casing of the package in FIG. 44.
Figure 51:
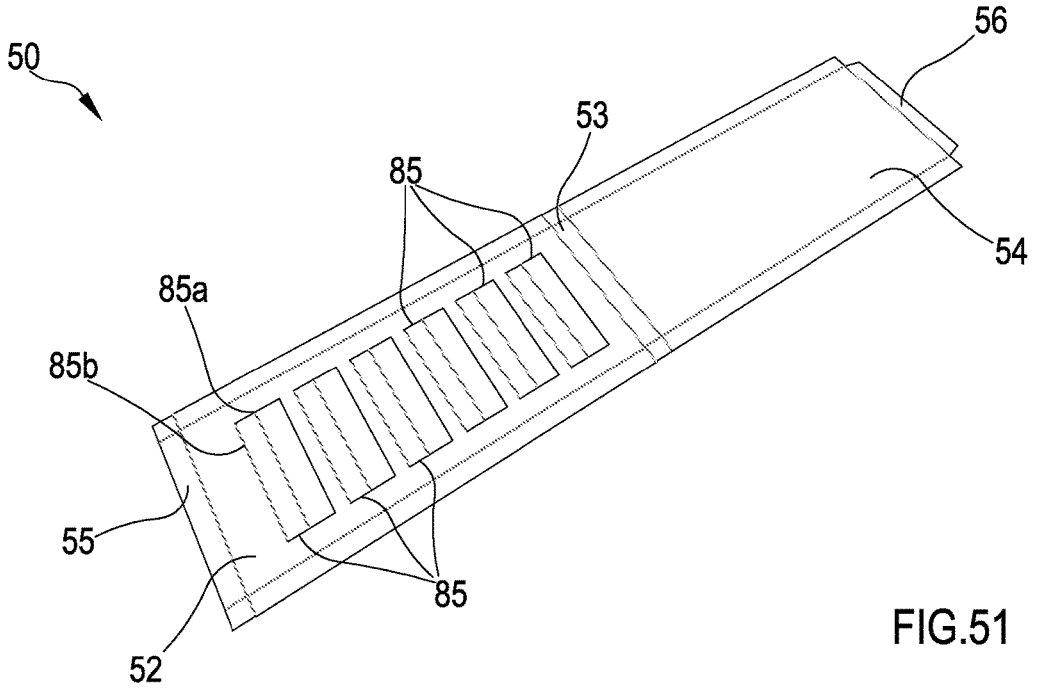
FIG. 51 is a perspective view of an embodiment variant of the second semifinished product for making the container of the package of FIG. 44.
Figure 52:
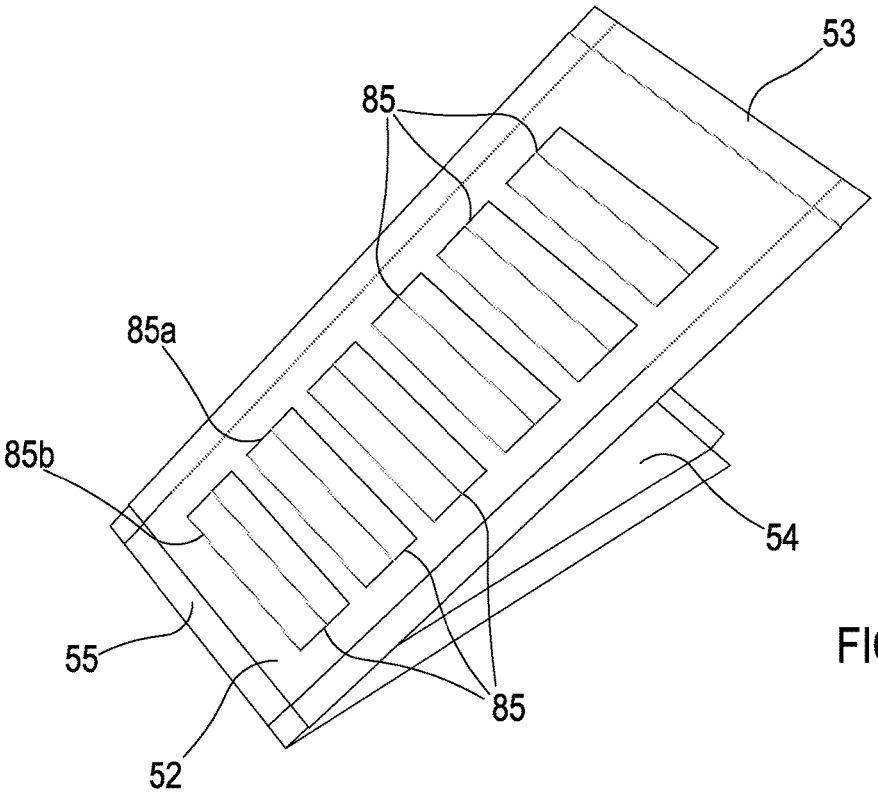
FIGS. 52 and 53 schematically illustrate the step of making the container in FIG. 51.
Figure 53:
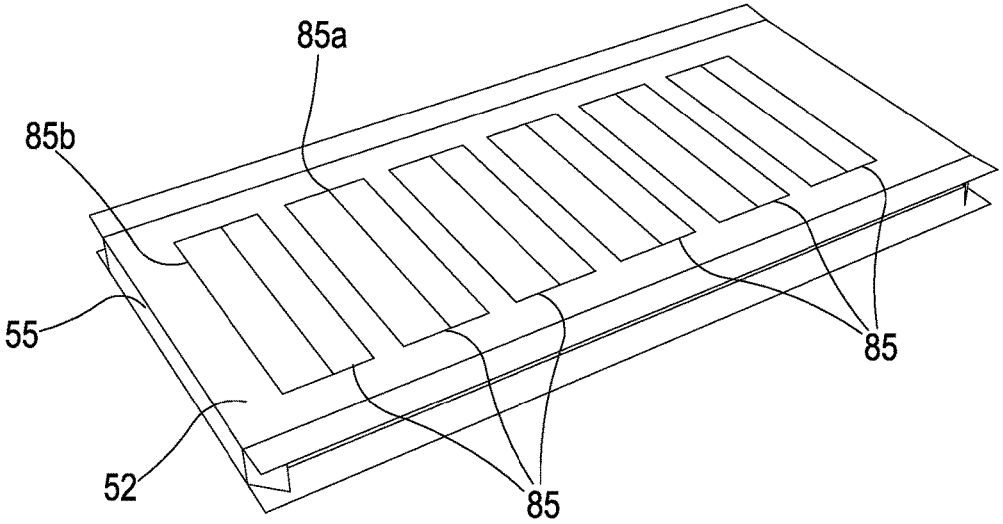

The first semifinished product 500—as illustrated in FIGS. 10, 38 and 50—includes:

- a first sheet 501 comprising at least one first and one second portions 502, 504 interconnected by a central connecting portion 503, the first sheet 501 further comprising at least one first and one second lateral connecting portions 505, 506, the first portion 502 being interposed between the first lateral connecting portion 505 and the central connecting portion 503, the second portion 504 being interposed between the central connecting portion 503 and the second lateral connecting portion 506, each of said portions 502, 503, 504, 505, 506 comprising at least one first and one second longitudinal edges opposite to each other and one first and one second end edges opposite to each other, the first end edges of the portions 502, 503, 504, 505, 506 of the first sheet 501 defining a first end edge of said first sheet, the second end edges of the portions 502, 503, 504, 505, 506 of the first sheet 501 defining a second end edge of said first sheet, said portions 502, 504, said central connecting portion 503 and said lateral connecting portions 505, 506 being joined along the longitudinal edges and being aligned along a single connecting direction,
- a second sheet 521 connected and joined in a single piece to the first end edge of the second portion 504 of the first sheet 501.

Figure 11:
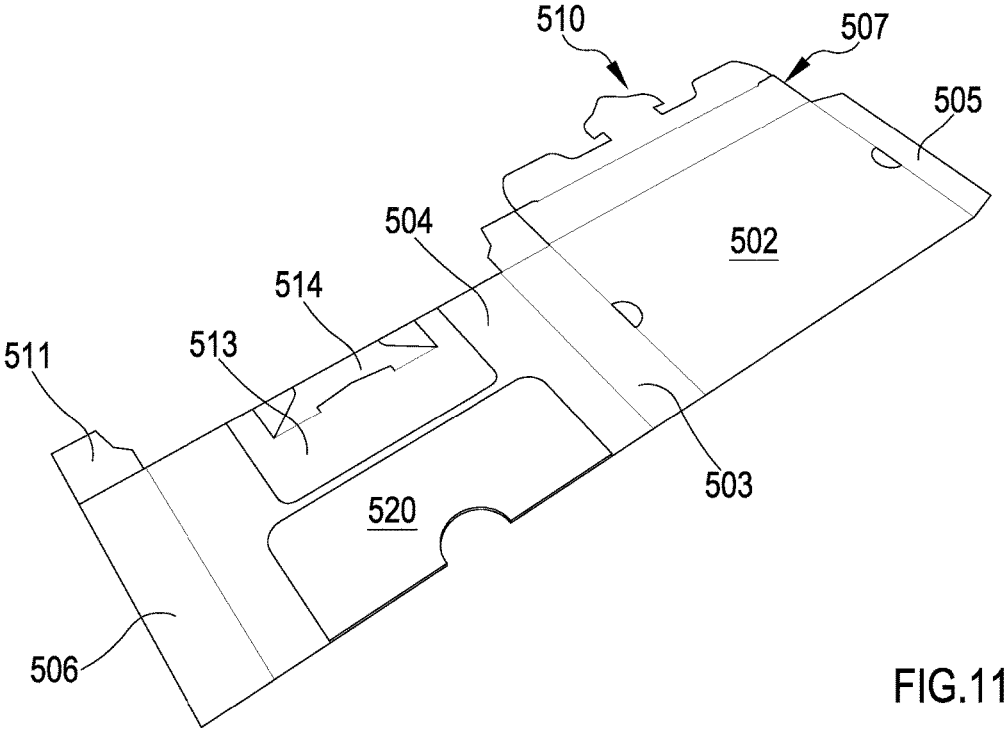
FIGS. 11 to 13 schematically illustrate the steps of making said casing.
Figure 12:
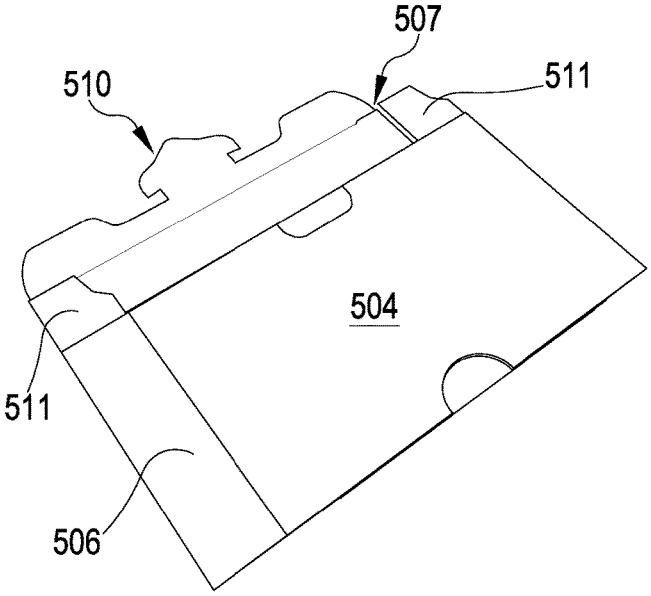
Figure 13:
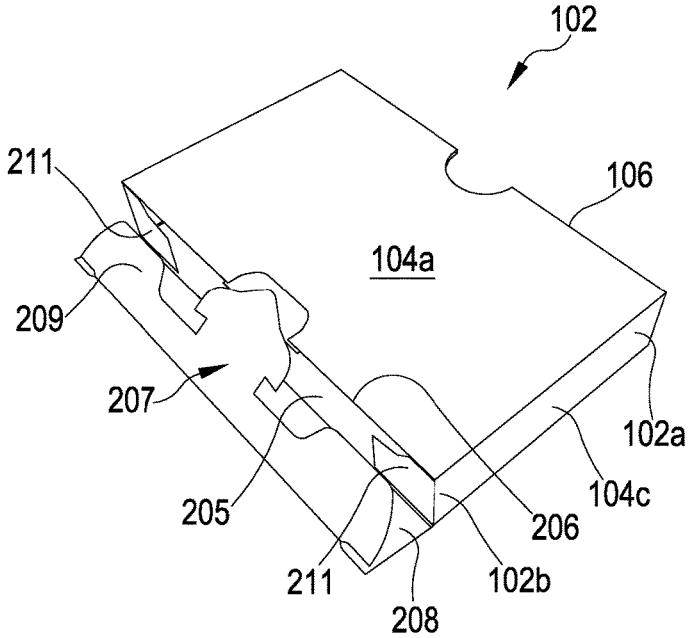

In an embodiment, the process includes the steps of:

- folding the second sheet 521 on the second portion 504 of the first sheet 501, for defining said engagement portion 107 (see FIG. 11 for example)
- folding the first sheet 501 along the longitudinal edges of the portions of the central sheet itself in order to define the casing 102 exhibiting at least the opening 105. Such step includes to constrain, for example by gluing, said first and second lateral connecting portions 505, 506.

Such process enables to define a casing according to the first above described embodiment.

In an embodiment variant illustrated in FIG. 10 for example, the first semifinished product 500 further includes:

- a third sheet 507 connected to the second end edge of the first portion 502 of the first sheet 501, the second sheet 507 comprising a first and second portions 508, 509 joined in a single piece to each other, the first portion 508 of the second sheet 507 being interposed between the first portion 502 of the first sheet 501 and the second portion 509 of the second sheet 507,
- a fourth sheet 510 exhibiting at least one portion 511 joined in a single piece to the second portion 509 of the third sheet 507, the second portion 509 of the third sheet 507 being interposed between the first portion 507 of the third sheet 507 itself and the portion 511 of the fourth sheet 510,
- a fifth sheet 512 connected to the second end edge of the second portion 504 of the first sheet 501, the fifth sheet 512 comprising a first portion and second portion 513, 514, the fifth sheet 512 and third sheet 507 being disposed on the same end edge of the first sheet 501 oppositely to the second sheet 521.

Moreover, the process further includes at least the following steps:

- folding the fifth sheet 512 on the second portion 504 of the first sheet 501 for defining the second hooking portion 214 of the occluding system 207,
- folding the second sheet 521 on the second portion 504 of the first sheet 501,
- after folding the second sheet and fifth sheet, folding the first sheet 501 along the longitudinal edges of the portions of the central sheet itself for defining the casing 102 exhibiting at least the opening 105. Such step includes constraining, for example by gluing, the first and second lateral connecting portions 505, 506,
- after folding the first sheet, folding the third and fourth sheets for defining the occluding system 207.

This latter described variant of the described process enables to define the second embodiment of the casing 102.

In a further embodiment variant as illustrated in FIG. 38, the first semifinished product 500 includes:

- at least one third sheet 507 connected to the second end edge of the first portion 502 of the first sheet 501, the second sheet 507 comprising a first and second portions 508, 509 joined in a single piece to each other, the first portion 508 of the second sheet 507 being interposed between the first portion 502 of the first sheet 501 and the second portion 509 of the second sheet 507, at least one fourth sheet 510 exhibiting at least one portion 511 joined in a single piece to the second portion 509 of the third sheet 507, the second portion 509 of the third sheet 507 being interposed between the first portion 507 of the third sheet 507 itself and the portion 511 of the fourth sheet 510, at least one fifth sheet 512 connected to the second end edge of the second portion 504 of the first sheet 501, the fifth sheet 512 comprising a first portion and second portion 513, 514, the fifth sheet 512 and the third sheet 507 being disposed on the same end edge of the first sheet 501 oppositely to the second sheet 521, said second portion 514 of the fifth sheet 512 being constrained to the first portion 513 of the fifth sheet 512 itself by at least one weakening line 514*a*.

The process includes at least the following steps:

folding the fifth sheet 512 on the second portion 504 of the first sheet 501 for defining the second hooking portion 314 of the closing system 307, folding the second sheet 521 on the second portion 504 of the first sheet 501, after folding the second sheet and fifth sheet, folding the first sheet 501 along the longitudinal edges of the portions of the central sheet itself for defining the casing 102 exhibiting at least the first and second openings 105, 205, after folding the first sheet, folding the third and fourth sheets for defining the closing system 307.

Figure 30:
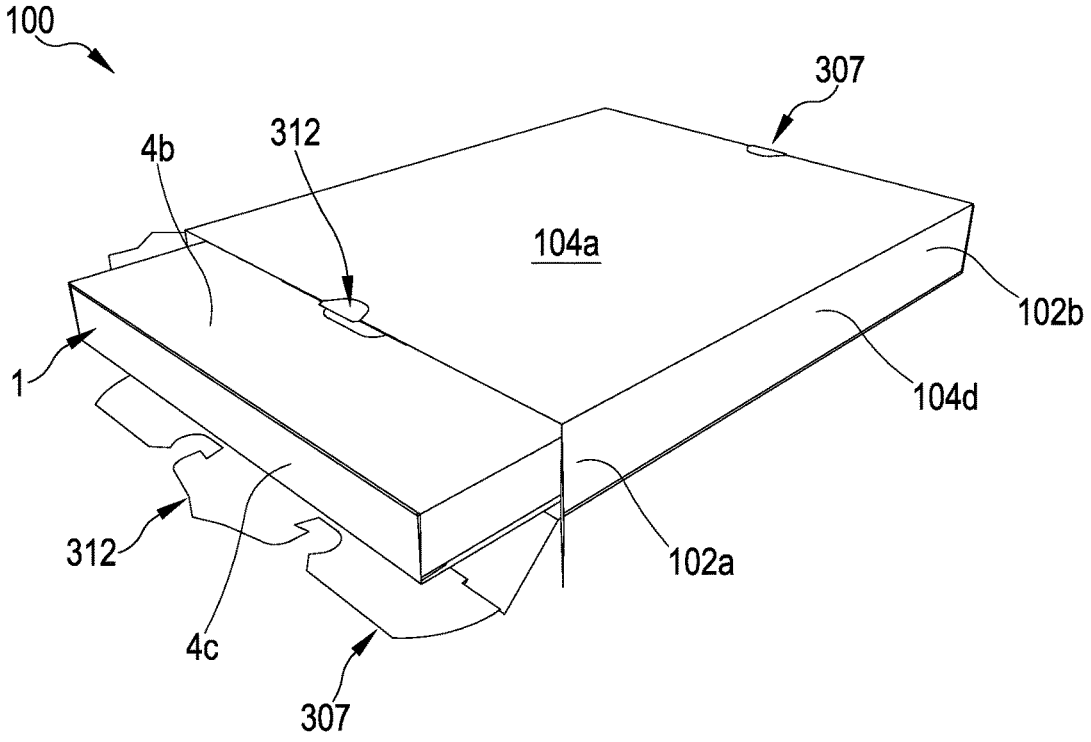
Figure 31:
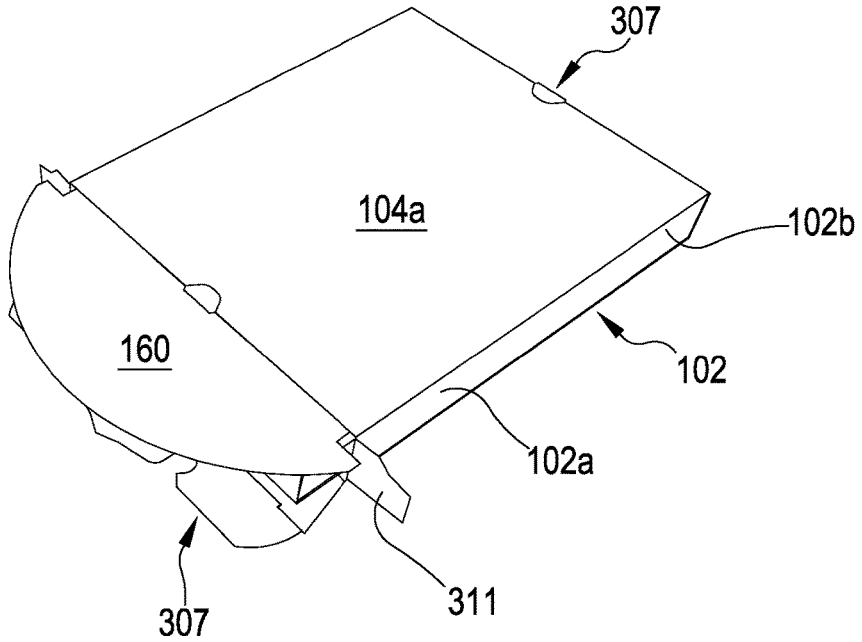
Figure 32:
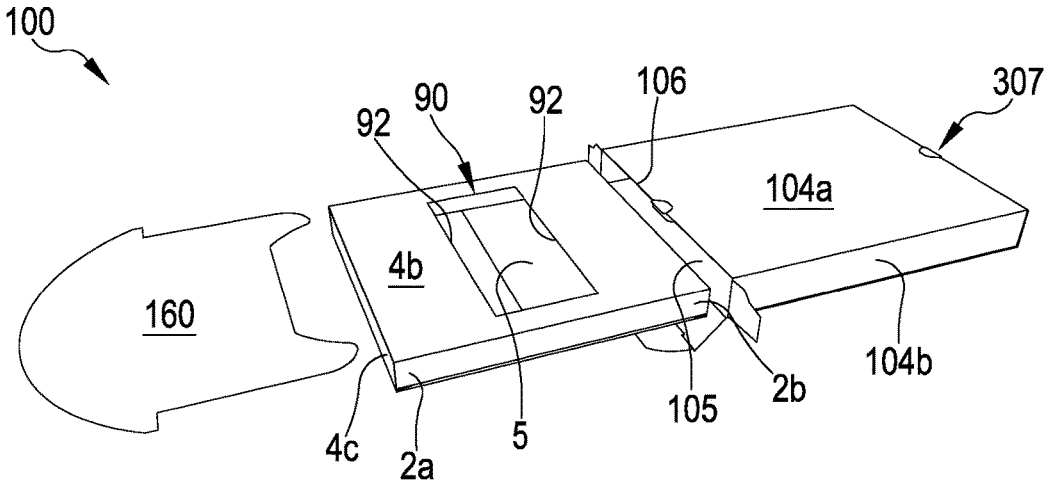

Advantageously, the first semifinished product 500 includes a second, third, fourth and fifth sheets for each end edge for defining a casing 102 having a tubular form, a first and second through openings being at the longitudinal ends 102*a*, 102*b*: for each opening, the casing includes a closing system 307 and safety system 312 as illustrated in FIGS. 29, 30.

Moreover, the process includes a step of providing the container 1; such step provides folding a second semifinished product 50 of sheet material, particularly of a paper sheet. The second semifinished product 50 includes at least one first sheet 51 comprising at least one first and one second portions 52, 54 interconnected by a central connecting portion 53. Moreover, the first sheet 51 includes at least one first and one second lateral connecting portions 55, 56, the first portion 52 is interposed between the first lateral connecting portion 55 and the central connecting portion 53; the second portion 54 is interposed between the central connecting portion 53 and the second lateral connecting portion 56: each of said portions 52, 53, 54, 55, 56 includes at least one first and one second longitudinal edges opposite to each other and one first and one second end edges opposite to each other. The first end edges of the portions 52, 53, 54, 55, 56 of the first sheet 51 define a first end edge of said first sheet. The second end edges of the portions 52, 53, 54, 55, 56 of the first sheet 51 define a second end edge of said first sheet. The portions 52, 54, the central connecting portion 53 and said lateral connecting portions 55, 56 are joined along the longitudinal edges and are aligned along a single connecting direction. The first sheet exhibits, on the first portion 52, at least one cut 85*a*.

The process provides a step of folding the first sheet 51 along the longitudinal edges of the portions of the central sheet itself by joining said lateral connecting portions 55, 56 for defining the container exhibiting at least the opening 5. During such folding step, the first and second lateral connecting portions 55, 56 are constrained, for example by gluing, to each other. The cut 85*a* is adapted to define on the first sheet 51, at least one stop element 90.

The first portion 52 can include a plurality of cuts 85*a* for defining a plurality of stop elements 90. The cut 85*a* can exhibit a closed outline for defining, on the first portion 52, a cavity passing through the sheet. As an alternative, the cavity 85*a* can exhibit, as illustrated in the attached figures, an open outline defining, on the first portion, a tab 85 connected to the first portion by a creasing 85*b*, in such condition, following the step of folding the first sheet, the process provides folding the tab 85 for defining said stop element 90.

Moreover, the first sheet 51 includes at least one through groove 75 (see FIG. 20, for example) disposed on the first and/or on the second portions 52, 54 which is configured for defining the recess 27. The groove 75 is made substantially at the first and/or second end edges of said portions 52, 54. Particularly, the through groove 74 is defined on at least one transversal edge of the first or second portion 52, 54 of the first sheet 51; in FIG. 20, the groove 75 is defined at the transversal edges of the second portion 54. The through groove 75 defines an open outline having a substantially "C" (FIG. 20), or "U" or "V" shape.

In an embodiment variant, the second semifinished product 50 further includes:

at least one second sheet 57 connected to the first and/or second end edges of the first portion 52 of the first sheet 51, the second sheet 57 comprising a first and second portions 58, 59 joined in a single piece to each other, the first portion 58 of the second sheet 57 being interposed between the first portion 52 of the first sheet 51 and the second portion 59 of the second sheet 57. In an embodiment, the second sheet comprising a through opening 74 adapted to define the through opening 26.

at least one third sheet 60 exhibiting at least one portion 61 connected to at least one central and/or lateral connecting portions of the first sheet 51 and emerging with respect to this latter from the same side from which the second sheet 57 emerges, at least one fourth sheet 62 comprising at least one portion 63 joined in a single piece to the second portion 59 of the second sheet 57 and/or to the portion 61 of the third sheet 60, the portion 63 of the first sheet 62 longitudinally emerging from the second and/or third sheets 57, 60 oppositely to the first sheet 51, said fourth sheet 62 being configured for defining the first hooking portion 13 of the container 1, at least one fifth sheet 64 comprising at least one portion 65 joined in a single piece to the first sheet 51 and configured for defining the second hooking portion 14 of the container 1.

The fourth and/or fifth sheets 62, 64 comprising a step of forming, on the respective portion 63, 65, at least one further portion 66 joined in a single piece to said portion 63, 65 by a weakening line 67, said further portion being configured for defining the removable portion 15, optionally supporting at least one projection 25.

The process includes at least the following steps:

folding the portion 65 of the fifth sheet 64 on the second portion 54*a* of the first sheet 51, said portion 65 of the fifth sheet 64 forming the second hooking portion 14 of the safety device 12, folding the first sheet 51 along the longitudinal edges of the portions of the central sheet itself by joining said lateral connecting portions 55, 56 for defining the container 1 exhibiting at least one opening 5. Such step provides constraining, for example by gluing, said first and second lateral connecting portions 55, 56, folding the portion 61 of the third sheet 60 in order to form the abutment portion 11 of the container 1, folding the first and second portions of the second sheet for respectively forming the closing portion 9 and inserting portion 10 of the closing system 7, at the end of the folding steps, the removable portion 15 being completely contained in the inner volume 3 of the container 1.

At the end of the steps of providing the casing 102 and container 1, the process can include at least one step of at least partially inserting the container 1 into the inner volume 103 of the casing 102 so that the engagement portion 107 of this latter abuts against the abutment element 90 of the container 1 for defining the first operative position.

Moreover, the process can include a step of making the open device 160 by cutting a flat precursor sheet of paper material.

What is claimed is:

1. A package, comprising:

a casing made of sheet material and defining an inner volume, the casing comprising a first plurality of lateral walls defining a first passage opening delimited by a first free edge, the casing comprising an engagement portion extending from a lateral wall of the first plurality of lateral walls inside of the inner volume to provide a projection, wherein the engagement portion extends from the first free edge of the casing in a direction towards the inner volume; and a container of sheet material, separate from the casing, and configured for housing a product, the container comprising a second plurality of lateral walls defining a second passage opening delimited by a second free edge, the second passage opening of the container being configured for insertion and withdrawal of the product from the container, and the container being configurable between:

a first operative position in which the container is at least partially housed in the casing and in which the second passage opening is at least partially defined inside of the inner volume of the casing to prevent insertion and withdrawal of the product from the container, and a second operative position in which the container is at least partially positioned outside of the inner volume of the casing and in which the second passage opening is located outside of the casing to permit insertion and withdrawal of the product from the container, wherein the container further comprises a stop element associated with at least one lateral wall of the second plurality of lateral walls and configured for abutting, in the first operative position, the engagement portion of the casing for preventing the container from switching from the first operative position to the second operative position, and wherein the package further comprises a slot defined between at least one lateral wall of the first plurality of lateral walls and at least one lateral wall of the second plurality of lateral walls, the slot configured for enabling, at least in the first operative position, insertion of an open device configured to permit disengagement of the stop element from the engagement portion for enabling the container to switch from the first operative position to the second operative position.

2. The package according to claim 1, wherein the engagement portion of the casing is made of a paper sheet material.

3. The package according to claim 1, wherein the first plurality of walls comprises a front wall and a rear wall facing and parallel to each other, the front wall and the rear wall being connected to each other by first and second lateral walls of the first plurality of walls that are also facing and parallel to each other, the front wall being spaced from the rear wall, the first and second lateral walls being spaced from each other, and the engagement portion of the casing emerging from at least one of the front wall and the rear wall.

4. The package according to claim 3, wherein the engagement portion comprises a tab that is integrally joined to the front wall, at least part of the tab extending in a direction that is sloped with respect to an extension direction of the front wall to which the tab is integrally joined.

5. The package according to claim 3, wherein a second plurality of walls comprises a front wall and a rear wall facing and parallel to each other, the front and rear walls of the container facing the rear wall and the front wall respectively of the first plurality of walls, the front wall and the real wall of the second plurality of walls being connected to each other by first and second lateral walls of the plurality of second walls also facing and parallel to each other, the front wall of the first plurality of walls being spaced from the rear wall of the first plurality of walls, the first and second lateral walls of the second plurality of walls being spaced from each other, the container being substantially counter-shaped to the casing, and wherein the container comprises, at the rear lateral wall of the second plurality of walls, a seat delimited by a stop wall that delimits at least partially the second passage opening of the container and further defines at least part of the stop element, the second passage opening of the container facing the front wall of the first plurality of walls.

6. The package according to claim 1, wherein the slot is defined between the lateral wall of the first plurality of walls that supports the engagement portion and the lateral wall of the container on which the stop element is defined, wherein the slot extends along the lateral wall of the first plurality of walls that supports the engagement portion.

7. The package according to claim 1, wherein the casing extends in a longitudinal direction between first and second longitudinal end portions, the first passage opening of the casing being defined at the first longitudinal end portion, the casing defining a third passage opening delimited by a third free edge at the second longitudinal end portion, the casing further comprising an occluding system made of sheet material engaged at the third free edge of the third passage opening, the occluding system being configured for irreversibly closing the third passage opening, and the occluding system being configured for preventing exterior access to the inner volume of the casing through the third passage opening.

8. The package according to claim 7, wherein the occluding system comprises:

a tab having a closing portion engaged with the third free edge of the third passage opening and an inserting portion inserted inside of the inner volume of the casing, a first hooking portion supported by the tab of the occluding system and positioned in the inner volume of the casing, a second hooking portion engaged with the casing and positioned inside of the inner volume, the second hooking portion being configured for cooperating with the first hooking portion of the occluding system, wherein the first and second hooking portions are stably engaged with each other inside of the casing and configured for irreversibly occluding the third passage opening, wherein the closing portion of the tab of the occluding system has a shape delimited by a closed outer perimeter counter-shaped and substantially the same as a shape of the third passage opening, the closing portion of the occluding system substantially covering the third passage opening, wherein the closing portion of the occluding system is devoid of through openings, and wherein the closing portion is integrally joined to the inserting portion, the closing portion and inserting portion defining a single continuous body of sheet material having a substantially "L" shape delimited by a single closed outer perimeter devoid of through openings, and defined inside of the closed outer perimeter.

9. The package according to claim 1, wherein the opening device is made of sheet material and is configured for being inserted at least partially through the slot for enabling disengagement of the stop element from the engagement portion in the first operative position.

10. The package according to claim 1, wherein the container defines an inner volume configured for housing a product, the container extending between first and second end portions, the second passage opening being defined at the first end portion, the container comprising a closing system made of sheet material and engaged at the second free edge of the container and rotatable with respect to the second plurality of lateral walls, the closing system of the container being configured for defining a closed condition in which the closing system substantially occludes the second passage opening and prevents communication between the inner volume of the container and an outer environment exterior to the container, the closing system of the container being further configured for defining an open condition in which the closing system enables communication between the inner volume of the container and the outer environment, the closing system of the container comprising a tab comprising a closing portion engaged with the second free edge of the second passage opening and rotatable with respect to the second free edge, the tab further comprising an inserting portion configured for being inserted, in the closed condition of the closing system, in the inner volume of the container, the container further comprising a safety device made of sheet material and stably engageable at least partially with at least one lateral wall of the second plurality of walls and at least partially with the closing system following a first closed condition of the closing system, the safety device of the container comprising at a removable portion configured for separating from the safety device following a first open condition of the closing system of the container after the first closed condition exposing a tampering with the container.

11. The package according to claim 10, wherein the safety device of the container comprises:

a first hooking portion supported by the tab of the closing system of the container, a second hooking portion engaged at least with a lateral wall of the second plurality of lateral walls and configured for cooperating with the first hooking portion of the safety device, the first and the second hooking portions of the safety device being configured for stably engaging each other during a first closed condition of the closing system, at least one of the first and the second hooking portions of the safety device of the container comprising a removable portion configured for separating from the safety device following a first open condition of the closing system of the container after said first closed condition for exposing the tampering.

12. The package according to the claim 11, wherein the second hooking portion of the safety device is positioned in the inner volume of the container and substantially lies in a plane parallel to a lateral wall of the second plurality of lateral walls, and wherein in the closed condition of the closing system of the container, the first hooking portion of the safety device is configured for being inserted at least partially in the inner volume of the container for stably engaging the second hooking portion of the safety device.

13. The package according to claim 11, wherein the second hooking portion of the safety device of the container is integrally joined with the front wall of the second plurality of walls, the container comprising a through recess defined on the front lateral wall, the through recess being defined at the second free edge of the second passage opening of the container, wherein the through recess is configured to provide an exterior display of the removable portion before the first open condition of the container.

14. A package, comprising:

a casing made of sheet material and defining an inner volume, the casing comprising a first plurality of lateral walls defining a first passage opening delimited by a first free edge, the casing comprising an engagement portion extending from a lateral wall of the first plurality of lateral walls inside of the inner volume to provide a projection; and a container made of sheet material, separate from the casing, and configured for housing a product, the container comprising a second plurality of lateral walls defining a second passage opening delimited by a second free edge, the second passage opening of the container being configured for insertion and withdrawal of the product from the container, and the container being configurable between:

a first operative position in which the container is at least partially housed in the casing and in which the second passage opening is at least partially defined inside of the inner volume of the casing to prevent insertion and withdrawal of the product from the container, and a second operative position in which the container is at least partially positioned outside of the inner volume of the casing and in which the second passage opening of is defined outside of the casing to permit insertion and withdrawal of the product from the container, wherein the container comprises a stop element associated with at least one lateral wall of the second plurality of lateral walls and configured for abutting, in the first operative position, the engagement portion of the casing for preventing the container from switching from the first operative position to the second operative position, wherein the package further comprises a slot defined between at least one lateral wall of the first plurality of walls and at least one lateral wall of the second plurality of walls, the slot configured for enabling, at least in the first operative position, insertion of an open device configured to permit disengagement of the stop element from the engagement portion of the casing for enabling the container to switch from the first operative position to the second operative position, wherein the casing extends between first and second longitudinal end portions, the first passage opening of the casing being defined at the first longitudinal end portion, the casing defining a third passage opening at the second longitudinal end portion and delimited by a third free edge, the casing comprising an occluding system made of sheet material and engaged at the third free edge of the third passage opening, the occluding system being configured for irreversibly closing the third passage opening, and the occluding system being configured for preventing exterior access to the inner volume of the casing through the third passage opening, wherein the occluding system comprises a tab having a closing portion engaged with the third free edge of the third passage opening and an inserting portion inserted inside of the inner volume of the casing, the occluding system further comprising:

a first hooking portion supported by the tab of the occluding system and positioned in the inner volume of the casing, a second hooking portion engaged with the casing and positioned inside of the inner volume, the second hooking portion being configured for cooperating with the first hooking portion of the occluding system, the first and second hooking portions of the occluding system being stably engaged with each other inside of the casing and being configured for irreversibly occluding the third passage opening, the closing portion of the tab of the occluding system having a shape delimited by a closed outer perimeter counter-shaped and substantially the same as a shape of the third passage opening, the closing portion of the occluding system substantially covering the third passage opening, the closing portion of the occluding system being devoid of through openings, wherein the closing portion is integrally joined to the inserting portion, the closing portion and the inserting portion together defining a single continuous body of sheet material having a substantially "L" shape delimited by a single closed outer perimeter devoid of through openings and defined inside of the closed outer perimeter.

15. The package according to claim 14, wherein the slot is defined between the lateral wall of the first plurality of walls directly supporting the engagement portion and the lateral wall of the second plurality of walls on which the stop element is defined, wherein the slot extends along the lateral wall of the first plurality of walls that supports the engagement portion.

16. The package according to claim 14, comprising an opening device made of sheet material and configured for being inserted at least partially through the slot for enabling disengagement of the stop element of the container from the engagement portion of the casing in the first operative position.

* * * * *